US007156363B2

(12) United States Patent
Parsons et al.

(10) Patent No.: US 7,156,363 B2
(45) Date of Patent: Jan. 2, 2007

(54) BATHROOM FLUSHERS WITH NOVEL SENSORS AND CONTROLLERS

(75) Inventors: Natan E. Parsons, Brookline, MA (US); Fatih Guler, Winchester, MA (US); Kay Herbert, Winthrop, MA (US); Xiaoxiong Mo, Lexington, MA (US); Gregory P. Greene, Waltham, MA (US)

(73) Assignee: Arichell Technologies, Inc., Newton, MA (US)

( * ) Notice: Subject to any disclaimer, the term of this patent is extended or adjusted under 35 U.S.C. 154(b) by 0 days.

(21) Appl. No.: 10/877,075

(22) Filed: Jun. 25, 2004

(65) Prior Publication Data

US 2004/0232370 A1 Nov. 25, 2004

Related U.S. Application Data

(63) Continuation of application No. PCT/US02/41576, filed on Dec. 26, 2002.

(60) Provisional application No. 60/391,282, filed on Jun. 24, 2002, provisional application No. 60/362,166, filed on Mar. 5, 2002, provisional application No. 60/343,618, filed on Dec. 26, 2001.

(51) Int. Cl.
*F16K 31/02* (2006.01)

(52) U.S. Cl. ..... 251/30.04; 251/129.06; 251/129.22

(58) Field of Classification Search ..... 251/129.06, 251/30.04, 129.22
See application file for complete search history.

(56) References Cited

U.S. PATENT DOCUMENTS

| | | | | |
|---|---|---|---|---|
| 207,482 | A | 8/1878 | Blessing | 137/188 |
| 1,501,331 | A | 7/1924 | Gulick | 137/245 |
| 2,471,328 | A | 5/1949 | Jones | 137/403 |
| 2,619,122 | A | 11/1952 | Hunter | 251/120 |
| 2,619,986 | A | 12/1952 | Goepfrich et al. | 251/129.17 |
| 2,685,301 | A | 8/1954 | Dreier | 137/386 |
| 2,827,073 | A | 3/1958 | Owens | 137/426 |
| 2,842,400 | A | 7/1958 | Booth et al. | 239/569 |
| 2,877,791 | A | 3/1959 | Rich | 137/487 |
| 2,923,314 | A | 2/1960 | Badger, Jr. et al. | 137/414 |
| 2,986,155 | A | 5/1961 | Doyle | 137/218 |
| 2,999,191 | A | 9/1961 | Muradian et al. | 361/195 |
| 3,019,453 | A | 2/1962 | Radcliffe | 4/249 |
| 3,034,151 | A | 5/1962 | Filliung | 4/249 |

(Continued)

FOREIGN PATENT DOCUMENTS

EP 0848193 A1 6/1998

(Continued)

OTHER PUBLICATIONS

International Search Report issued in PCT Application PCT/US02/41576 mailed on May 23, 2003.

*Primary Examiner*—John Bastianelli
(74) *Attorney, Agent, or Firm*—Ivan David Zitkovsky

(57) ABSTRACT

A bathroom flusher (10) includes a body having an inlet (12) in communication with a supply line and an outlet (16) in communication with a flush conduit, a valve assembly in the body positioned to close water flow between the inlet and the outlet upon sealing action of a moving member (60, 60A, 60B, 60C, 130, 210, 215, 526, or 628) at a valve seat (70, 70A, 140, 209, 251A, 526 or 625) thereby controlling flow from the inlet to the outlet, and an actuator (62) for actuating operation of the moving member. The bathroom flusher includes one of several novel sensors and is controlled by one of several novel controllers, as described. The controllers may execute a novel control algorithm.

27 Claims, 39 Drawing Sheets

U.S. PATENT DOCUMENTS

| | | | | | |
|---|---|---|---|---|---|
| 3,056,143 | A | | 10/1962 | Foster | 4/249 |
| 3,058,485 | A | | 10/1962 | McQueen | 137/403 |
| 3,098,635 | A | | 7/1963 | Delaporte et al. | 251/54 |
| 3,242,940 | A | | 3/1966 | Sirotek | 137/218 |
| 3,254,664 | A | | 6/1966 | Delaney et al. | 137/244 |
| 3,285,261 | A | | 11/1966 | Chaney | 137/505.12 |
| 3,318,565 | A | | 5/1967 | Cutler | 251/45 |
| 3,369,205 | A | | 2/1968 | Hamrick | 335/177 |
| 3,373,449 | A | | 3/1968 | Rusnok | 4/305 |
| 3,386,462 | A | | 6/1968 | Walters | 137/244 |
| 3,400,731 | A | | 9/1968 | McCormack | 137/245 |
| 3,429,333 | A | | 2/1969 | Schoepe et al. | |
| 3,495,803 | A | | 2/1970 | Schoepe et al. | 251/25 |
| 3,495,804 | A | | 2/1970 | Muller et al. | 251/36 |
| 3,559,675 | A | | 2/1971 | Schoepe et al. | 137/436 |
| 3,586,017 | A | | 6/1971 | Walters | 137/59 |
| 3,606,241 | A | | 9/1971 | Bornholdt | 251/52 |
| 3,693,649 | A | | 9/1972 | Gordon et al. | 137/414 |
| 3,740,019 | A | | 6/1973 | Kessell et al. | 251/129.17 |
| 3,763,881 | A | | 10/1973 | Jones | 137/414 |
| 3,778,023 | A | | 12/1973 | Billeter | 251/30.01 |
| 3,791,619 | A | | 2/1974 | Pett | 251/45 |
| 3,802,462 | A | | 4/1974 | Trösch | 137/556 |
| 3,812,398 | A | | 5/1974 | Kozel et al. | 251/331 |
| 3,821,967 | A | | 7/1974 | Sturman | 137/624.15 |
| 3,842,857 | A | | 10/1974 | McCormack | 137/242 |
| 3,895,645 | A | | 7/1975 | Johnson | 137/403 |
| 4,010,769 | A | | 3/1977 | De Lorenzo et al. | 137/312 |
| 4,065,095 | A | | 12/1977 | Johnson | 251/118 |
| 4,097,786 | A | | 6/1978 | Lund | 318/282 |
| 4,105,186 | A | | 8/1978 | Eby | 251/35 |
| 4,135,696 | A | | 1/1979 | Saarem et al. | 251/30.02 |
| 4,141,091 | A | | 2/1979 | Pulvari | 4/313 |
| 4,206,901 | A | | 6/1980 | Williams | 251/35 |
| 4,231,287 | A | | 11/1980 | Smiley | 92/94 |
| 4,272,052 | A | | 6/1981 | Gidner | 251/39 |
| 4,280,680 | A | | 7/1981 | Payne | 251/175 |
| 4,295,485 | A | | 10/1981 | Waterfield | 137/74 |
| 4,295,631 | A | | 10/1981 | Allen | 251/30.03 |
| 4,295,653 | A | | 10/1981 | Coles | 277/320 |
| 4,304,391 | A | | 12/1981 | Yamaguchi | 251/129.05 |
| 4,309,781 | A | | 1/1982 | Lissau | 4/304 |
| 4,383,234 | A | | 5/1983 | Yatsushiro et al. | 335/253 |
| 4,488,702 | A | | 12/1984 | Lapeyre | 251/46 |
| 4,505,451 | A | | 3/1985 | Jonas | 251/285 |
| 4,570,272 | A | | 2/1986 | Kawaguchi et al. | 4/302 |
| 4,595,170 | A | * | 6/1986 | Livet | 251/129.01 |
| 4,597,895 | A | | 7/1986 | Bartlett | 252/392 |
| 4,604,735 | A | | 8/1986 | Parsons | 367/93 |
| 4,609,178 | A | | 9/1986 | Baumann | 251/229 |
| 4,611,356 | A | | 9/1986 | Lin | 4/301 |
| 4,709,427 | A | | 12/1987 | Laverty, Jr. | 4/427 |
| 4,729,342 | A | | 3/1988 | Loctin | 119/163 |
| 4,756,031 | A | | 7/1988 | Barrett | 4/407 |
| 4,771,204 | A | * | 9/1988 | Siegal | 251/129.01 |
| 4,787,411 | A | | 11/1988 | Moldenhauer | 137/244 |
| 4,793,588 | A | | 12/1988 | Laverty, Jr. | 251/30.03 |
| 4,796,662 | A | | 1/1989 | Hoffmann et al. | 137/596.16 |
| 4,805,247 | A | | 2/1989 | Laverty, Jr. | 4/304 |
| 4,823,414 | A | | 4/1989 | Piersimoni et al. | 4/623 |
| 4,823,825 | A | | 4/1989 | Buchl | 137/1 |
| 4,826,132 | A | | 5/1989 | Moldenhauer | 251/129.17 |
| 4,832,582 | A | | 5/1989 | Buffet | 417/413.1 |
| 4,839,039 | A | | 6/1989 | Parsons et al. | 210/143 |
| 4,887,032 | A | | 12/1989 | Hetrick | 324/207.16 |
| 4,891,864 | A | | 1/1990 | Laverty, Jr. | 91/399 |
| 4,893,645 | A | | 1/1990 | Augustinas et al. | 137/315.03 |
| 4,894,698 | A | | 1/1990 | Hijikigawa et al. | 257/254 |
| 4,894,874 | A | | 1/1990 | Wilson | 4/623 |
| 4,907,748 | A | * | 3/1990 | Gardner et al. | 251/129.06 |
| 4,910,487 | A | | 3/1990 | Kleinhappl | 335/234 |
| 4,911,401 | A | | 3/1990 | Holcomb et al. | 251/30.03 |
| 4,921,208 | A | | 5/1990 | LaMarca | 251/30.04 |
| 4,921,211 | A | | 5/1990 | Novak et al. | 251/129.04 |
| 4,932,430 | A | | 6/1990 | Fernstrom | 137/85 |
| 4,941,215 | A | | 7/1990 | Liu | 4/406 |
| 4,941,219 | A | | 7/1990 | Van Marcke | 4/623 |
| 4,944,487 | A | | 7/1990 | Holtermann | 251/129.17 |
| 4,977,929 | A | | 12/1990 | Chinnock et al. | 137/863 |
| 4,988,074 | A | | 1/1991 | Najmolhoda | 251/129.08 |
| 4,989,277 | A | * | 2/1991 | Tsutsui et al. | 251/129.06 |
| 4,998,673 | A | | 3/1991 | Pilolla | 239/67 |
| 5,025,516 | A | | 6/1991 | Wilson | 4/623 |
| 5,027,850 | A | | 7/1991 | Peterson et al. | 137/245 |
| 5,029,805 | A | * | 7/1991 | Albarda et al. | 251/129.06 |
| 5,032,812 | A | | 7/1991 | Banick et al. | 335/17 |
| 5,036,553 | A | | 8/1991 | Sanderson | 4/313 |
| 5,058,856 | A | * | 10/1991 | Gordon et al. | 251/11 |
| 5,074,520 | A | | 12/1991 | Lee et al. | 251/40 |
| 5,085,399 | A | * | 2/1992 | Tsutsui et al. | 251/129.06 |
| 5,109,885 | A | | 5/1992 | Tauscher | 137/596.17 |
| 5,125,621 | A | | 6/1992 | Parsons et al. | 251/30.03 |
| 5,127,625 | A | | 7/1992 | Kleinhappl | 251/129.17 |
| 5,169,118 | A | | 12/1992 | Whiteside | 251/30.03 |
| 5,188,337 | A | | 2/1993 | Mertens et al. | 251/129.17 |
| 5,195,720 | A | | 3/1993 | Nortier et al. | 251/129.04 |
| 5,213,303 | A | | 5/1993 | Walker | 251/30.02 |
| 5,213,305 | A | | 5/1993 | Whiteside et al. | 251/40 |
| 5,224,685 | A | | 7/1993 | Chiang et al. | 251/129.04 |
| 5,232,194 | A | | 8/1993 | Saadi et al. | 251/40 |
| 5,244,179 | A | | 9/1993 | Wilson | 251/30.03 |
| 5,245,024 | A | | 9/1993 | Scarpa et al. | 536/56 |
| 5,251,188 | A | | 10/1993 | Parsons et al. | 367/140 |
| 5,265,594 | A | | 11/1993 | Olsson et al. | 128/204.18 |
| 5,265,843 | A | | 11/1993 | Kleinhappl | 251/129.17 |
| 5,295,655 | A | | 3/1994 | Wilson et al. | 251/40 |
| 5,313,673 | A | | 5/1994 | Saadi et al. | 4/313 |
| 5,315,719 | A | | 5/1994 | Tsutsui et al. | 4/300 |
| 5,335,694 | A | | 8/1994 | Whiteside | 137/625.37 |
| 5,375,811 | A | | 12/1994 | Reinicke | 251/129.16 |
| D354,113 | S | | 1/1995 | Wortier et al. | D23/233 |
| D355,478 | S | | 2/1995 | Allen et al. | D23/249 |
| 5,408,369 | A | | 4/1995 | Miura et al. | 360/75 |
| D357,976 | S | | 5/1995 | Allen et al. | D23/249 |
| 5,412,816 | A | | 5/1995 | Paterson et al. | 4/623 |
| 5,431,181 | A | | 7/1995 | Saadi et al. | 137/15.11 |
| 5,433,245 | A | | 7/1995 | Prather et al. | 137/554 |
| 5,456,279 | A | | 10/1995 | Parsons et al. | 137/245 |
| 5,474,303 | A | | 12/1995 | Coles | 277/317 |
| 5,481,187 | A | | 1/1996 | Marcott et al. | 324/207.16 |
| 5,508,510 | A | | 4/1996 | Laverty et al. | 250/221 |
| 5,539,198 | A | | 7/1996 | McMichael et al. | 250/221 |
| 5,548,119 | A | | 8/1996 | Nortier | 250/341.1 |
| 5,555,912 | A | | 9/1996 | Saadi et al. | 137/801 |
| 5,566,702 | A | | 10/1996 | Philipp | 137/1 |
| 5,574,617 | A | | 11/1996 | Shimanuki et al. | 361/154 |
| 5,583,434 | A | | 12/1996 | Moyers et al. | 324/207.16 |
| 5,584,465 | A | | 12/1996 | Ochsenreiter | 251/65 |
| 5,600,237 | A | | 2/1997 | Nippert | 324/207.16 |
| 5,636,601 | A | | 6/1997 | Moriya et al. | 123/90.11 |
| 5,668,366 | A | | 9/1997 | Mauerhofer | 250/221 |
| 5,680,879 | A | | 10/1997 | Sheih et al. | 137/240 |
| 5,708,355 | A | | 1/1998 | Schrey | 323/282 |
| 5,716,038 | A | | 2/1998 | Scarffe | 251/30.03 |
| 5,747,684 | A | | 5/1998 | Pace et al. | 73/119 A |
| D396,090 | S | | 7/1998 | Marcichow et al. | D23/233 |
| 5,785,955 | A | | 7/1998 | Fischer | 424/49 |
| 5,787,915 | A | | 8/1998 | Byers et al. | 137/1 |
| 5,787,924 | A | | 8/1998 | Cewers et al. | 137/487.5 |
| 5,797,360 | A | | 8/1998 | Pischinger et al. | 123/90.11 |
| 5,804,962 | A | | 9/1998 | Kather et al. | 324/207.16 |
| 5,815,362 | A | | 9/1998 | Kahr et al. | 361/153 |
| 5,819,336 | A | | 10/1998 | Gilliam et al. | 4/623 |
| 5,881,993 | A | | 3/1999 | Wilson et al. | 251/40 |

5,887,848 A 3/1999 Wilson ..... 251/40
5,900,201 A 5/1999 Chatterjee et al. ..... 264/109
5,901,384 A 5/1999 Sim ..... 4/313
5,905,625 A 5/1999 Schebitz ..... 361/154
5,941,505 A 8/1999 Nagel ..... 251/335.2
5,950,983 A 9/1999 Jahrling ..... 251/129.04
5,964,192 A 10/1999 Ishii ..... 123/90.11
5,967,182 A 10/1999 Wilson ..... 137/544
5,979,500 A 11/1999 Jahrling et al. ..... 137/624.12
5,984,262 A 11/1999 Parsons et al. ..... 251/129.04
5,996,965 A 12/1999 Eichholz et al. ..... 251/30.05
6,000,674 A 12/1999 Cheng ..... 251/26
6,003,170 A 12/1999 Humpert et al. ..... 4/623
6,017,016 A * 1/2000 Jackson ..... 251/129.06
6,024,059 A 2/2000 Kamimaru et al. ..... 123/90.11
6,044,814 A 4/2000 Fuwa ..... 123/90.11
6,056,261 A 5/2000 Aparicio et al. ..... 251/129.03
6,073,904 A 6/2000 Diller et al. ..... 251/30.03
6,085,990 A * 7/2000 Augustin ..... 251/129.06
6,127,671 A 10/2000 Parsons et al. ..... 250/221
6,142,444 A * 11/2000 Kluge ..... 251/129.06
6,155,231 A 12/2000 Adachi et al. ..... 123/399
6,158,715 A 12/2000 Kirschbaum ..... 251/129.06
6,161,726 A 12/2000 Parsons et al. ..... 222/52
6,182,689 B1 2/2001 Lauer et al. ..... 137/550
6,212,697 B1 4/2001 Parsons et al. ..... 4/302
6,216,730 B1 4/2001 Hall ..... 137/550
6,227,219 B1 5/2001 Pino ..... 137/1
6,260,576 B1 7/2001 Allen ..... 137/550
6,273,394 B1 8/2001 Vincent et al. ..... 251/129.04
6,293,516 B1 9/2001 Parsons et al. ..... 251/129.04
6,299,127 B1 10/2001 Wilson ..... 251/38
6,305,662 B1 10/2001 Parsons et al. ..... 251/129.04
6,340,032 B1 1/2002 Zosimadis ..... 137/552
6,353,942 B1 3/2002 Pondelick et al. ..... 4/431
6,367,096 B1 4/2002 Quintana ..... 4/427
6,382,586 B1 5/2002 Wilson et al. ..... 251/40
6,450,478 B1 9/2002 Parsons et al. ..... 251/129.04
6,609,698 B1 8/2003 Parsons et al. ..... 251/129.17
6,619,614 B1 9/2003 Parsons et al. ..... 251/129.04
6,643,853 B1 11/2003 Wilson et al. ..... 4/249
6,685,158 B1 2/2004 Parsons ..... 251/30.01
6,811,093 B1 * 11/2004 Rado ..... 251/129.06

FOREIGN PATENT DOCUMENTS

GB 1532210 11/1978
WO WO 97/04262 2/1997

* cited by examiner

FIG. 2A-I

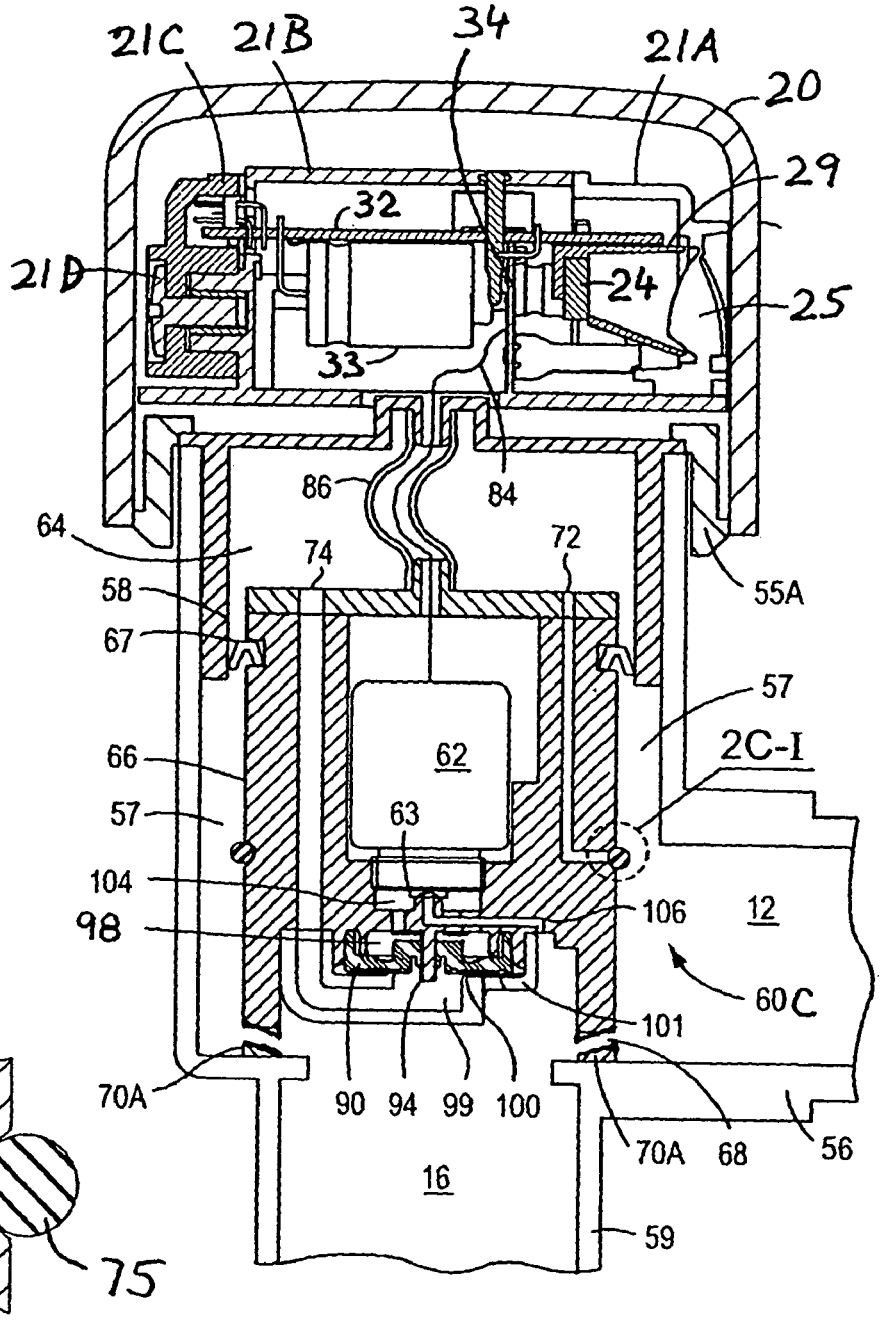
FIG. 2C
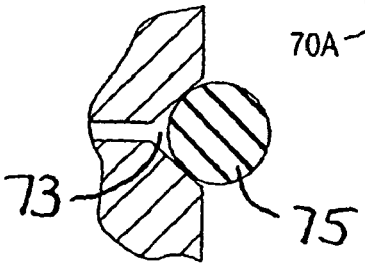
FIG. 2C-I
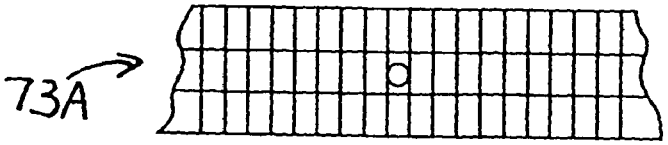
FIG. 2C-II

FIG. 2H-I

BATHROOM FLUSHERS WITH NOVEL SENSORS AND CONTROLLERS

This application is a continuation of PCT Application PCT/US02/41576, filed on Dec. 26, 2002, entitled "Bathroom Flushers with Novel Sensors and Controllers," which claims priority, under 35 U.S.C. §119, from U.S. Provisional Application Ser. No. 60/343,618, entitled "Riding Actuator and Control Method" filed on Dec. 26, 2001; U.S. Provisional Application Ser. No. 60/012,252, entitled "Controlling a Solenoid Based on Current Time Profile" filed on Mar. 5, 2002; and U.S. Provisional Application Ser. No. 60/391,282, entitled "High Flow-Rate Diaphragm Valve And Control Method" filed on Jun. 24, 2002. The above-mentioned PCT Application PCT/US02/41576 is a continuation-in-part of PCT Application PCT/US02/38758, entitled "Automatic Bathroom Flushers" filed on Dec. 4, 2002; all of the above applications are incorporated by reference.

BACKGROUND OF THE INVENTION

1. Field of the Invention

The present invention is directed to automatic bathroom flushers and methods for operating and controlling such flushers.

2. Background Information

Automatic flow-control systems have become increasingly prevalent, particularly in public rest-room facilities, both toilets and urinals. Automatic faucets and flushers contribute to hygiene, facility cleanliness, and water conservation. In such systems, object sensors detect the user and operate a flow-control valve in response to user detection. In the case of an automatic faucet, for instance, presence or motion of a user's hands in the faucet's vicinity normally results in flow from the faucet. In the case of an automatic flusher, detection of the fact that a user has approached the facility and then left is typically what triggers flushing action.

Although the concept of such object-sensor-based automatic flow control is not new, its use has been quite limited until recently. The usage is becoming more widespread due to the recent availability of battery-powered conversion kits. These kits make it possible for manual facilities to be converted into automatic facilities through simple part replacements that do not require employing electricians to wire the system to the supply grid. A consequence of employing such battery-powered systems is that the batteries eventually need to be replaced.

There is still a need for automatic flushers that are highly reliable and can operate for a long time without any service or just minimal service.

SUMMARY OF THE INVENTION

The described inventions are directed to automatic bathroom flushers and methods for operating and controlling such flushers.

According to one aspect, the present invention is a bathroom flusher. The bathroom flusher includes a body, a valve assembly, and an actuator. The body has an inlet and an outlet, and the valve assembly is located in the body and positioned to close water flow between the inlet and the outlet upon sealing action of a moving member at a valve seat thereby controlling flow from the inlet to the outlet. The actuator actuates operation of the moving member.

The moving member may be a high flow rate fram member, a standard diaphragm, or a piston. The bathroom flusher may further include an infra-red sensor assembly for detecting a urinal or toilet user. The bathroom flusher may further include different types of electromechanical, hydraulic, or only mechanical actuators. Preferably, the bathroom flusher may include an automatic flow-control system. The automatic flow-control system may employ different types of infrared-light-type object sensors.

Another important aspect of the present inventions is a novel algorithm for operating an automatic flusher. The automatic flusher employs a light-type object sensor having a light source and detector in the visible or IR range. The detector for provides an output on the basis of which a control circuit decides whether to flush a toilet. After each pulse of transmitted radiation from the source, the control circuit determines if the resultant percentage of reflected radiation differs significantly from the last, and determines whether the percentage change was positive or negative. From the determined subsequent data having a given direction and the sums of the values, the control circuit determines whether a user has approached the facility and then withdrawn from it. Based on this determination, the controller operates the flusher's valve. That is, the control circuit determines the flush criteria based on whether a period in which the reflection percentage decreased (in accordance with appropriate withdrawal criteria) has been preceded by a period in which the reflection percentage increased (in accordance with appropriate approach criteria). In this embodiment, the control circuit does not base its determination of whether the user has approached the toilet on whether the reflection percentage has exceeded a predetermined threshold, and it does not base a determination of whether the user has withdrawn from the toilet on whether the reflection percentage has fallen below a predetermined threshold.

According to yet another aspect, the present invention is a novel optical sensor having only a light detector in the visible or IR range for detecting motion or presence of an object. This type of a sensor has a wide use, such as providing an output on the basis of which a control circuit decides whether to flush a toilet using the criteria described below.

According to yet another aspect, the present inventions is a novel valve device and the corresponding method for controlling flow-rate of fluid between the input and output ports of the valve device. A novel valve device includes a fluid input port and a fluid output port, a valve body, and a fram assembly. The valve body defines a valve cavity and includes a valve closure surface. The fram assembly provides two pressure zones and is movable within the valve cavity with respect a guiding member. The fram assembly is constructed to move to an open position enabling fluid flow from the fluid input port to the fluid output port upon reduction of pressure in a first of the two pressure zones and is constructed to move to a closed position, upon increase of pressure in the first pressure zone, creating a seal at the valve closure surface.

According to preferred embodiments, the two pressure zones are formed by two chambers separated by the fram assembly, wherein the first pressure zone includes a pilot chamber. The guiding member may be a pin or internal walls of the valve body.

The fram member (assembly) may include a pliable member and a stiff member, wherein the pliable member is constructed to come in contact with a valve closure surface to form seal (e.g., at a sealing lip located at the valve closure surface) in the closed position. The valve device may include a bias member. The bias member is constructed and arranged to assist movement of the fram member from the open position to the closed position. The bias member may be a spring.

The valve is controlled, for example, by an electromechanical operator constructed and arranged to release pressure in the pilot chamber and thereby initiate movement of the fram assembly from the closed position to the open position. The operator may include a latching actuator (as described in U.S. Pat. No. 6,293,516, which is incorporated by reference), a non-latching actuator (as described in U.S. Pat. No. 6,305,662, which is incorporated by reference), or an isolated operator (as described in PCT Application PCT/US01/51098, which is incorporated by reference). The valve may also be controlled may also including a manual operator constructed and arranged to release pressure in the pilot chamber and thereby initiate movement of the fram member from the closed position to the open position.

The novel valve device including the fram assembly may be used to regulate water flow in an automatic or manual bathroom flusher.

According to yet another aspect, the present invention is a novel electromagnetic actuator and a method of operating or controlling such actuator. The electromagnetic actuator includes a solenoid wound around an armature housing constructed and arranged to receive an armature including a plunger partially enclosed by a membrane. The armature provides a fluid passage for displacement of armature fluid between a distal part and a proximal part of the armature thereby enabling energetically efficient movement of the armature between open and closed positions. The membrane is secured with respect to the armature housing and is arranged to seal armature fluid within an armature pocket having a fixed volume, wherein the displacement of the plunger (i.e., distal part or the armature) displaces the membrane with respect to a valve passage thereby opening or closing the passage. This enables low energy battery operation for a long time. Preferred embodiments of this aspect include one or more of the following features: The actuator may be a latching actuator (including a permanent magnet for holding the armature) of a non-latching actuator.

The distal part of the armature is cooperatively arranged with different types of diaphragm membranes designed to act against a valve seat when the armature is disposed in its extended armature position. The electromagnetic actuator is connected to a control circuit constructed to apply said coil drive to said coil in response to an output from an optional armature sensor.

The armature sensor can sense the armature reaching an end position (open or closed position). The control circuit can direct application of a coil drive signal to the coil in a first drive direction, and in responsive to an output from the sensor meeting a predetermined first current-termination criterion to start or stop applying coil drive to the coil in the first drive direction. The control circuit can direct or stop application of a coil drive signal to the coil responsive to an output from the sensor meeting a predetermined criterion.

According to yet another aspect, the present invention is a novel assembly of an electromagnetic actuator and a piloting button. The piloting button has an important novel function for achieving consistent long-term piloting of a main valve. The present invention is also a novel method for assembling a pilot-valve-operated automatic flow controller that achieves a consistent long-term performance.

Method of assembling a pilot-valve-operated automatic flow controller includes providing a main valve assembly and a pilot-valve assembly including a stationary actuator and a pilot body member that includes a pilot-valve inlet, a pilot-valve seat, and a pilot-valve outlet. The method includes securing the pilot-valve assembly to the main valve assembly in a way that fluid flowing from a pressure-relief outlet of the main valve must flow through the pilot-valve inlet, past the pilot-valve seat, and through the pilot-valve outlet, whereby the pilot-valve assembly is positioned to control relief of the pressure in the pressure chamber (i.e., pilot chamber) of the main valve assembly. The main valve assembly includes a main valve body with a main-valve inlet, a main-valve seat, a main-valve outlet, a pressure chamber (i.e., a pilot chamber), and a pressure-relief outlet through which the pressure in the pressure chamber (pilot chamber) can be relieved. A main valve member (e.g., a diaphragm, a piston, or a fram member) is movable between a closed position, in which it seals against the main-valve seat thereby preventing flow from the main inlet to the main outlet, and an open position, in which it permits such flow. During the operation, the main valve member is exposed to the pressure in the pressure chamber (i.e., the pilot chamber) so that the pressurized pilot chamber urges the main valve member to its closed position, and the unpressurized pilot chamber (when the pressure is relieved using the pilot valve assembly) permits the main valve member to assume its open position.

According to yet another aspect, the present invention is a novel electromagnetic actuator system. This electromagnetic actuator system includes an actuator, a controller, and an actuator sensor. The actuator includes a solenoid coil and an armature housing constructed and arranged to receive in a movable relationship an armature. The controller is coupled to a power driver constructed to provide a drive signal to the solenoid coil for displacing the armature and thereby open or close a valve passage for fluid flow. The actuator sensor is constructed and arranged to sense a position of the armature and provide a signal to the controller.

Preferred embodiments of this aspect include one or more of the following features: The sensor is constructed to detect voltage induced by movement of the armature. Alternatively, the sensor is constructed and arranged to detect changes to the drive signal due to the movement of the armature.

Alternatively, the sensor includes a resistor arranged to receive at least a portion of the drive signal, and a voltmeter constructed to measure voltage across the resistor. Alternatively, the sensor includes a resistor arranged to receive at least a portion of the drive signal, and a differentiator receiving current flowing through the resistor.

Alternatively, the sensor includes a coil sensor constructed and arranged to detect the voltage induced by movement of the armature. The coil sensor may be connected in a feedback arrangement to a signal conditioner providing conditioned signal to the controller. The signal conditioner may include a preamplifier and a low-pass filter.

Alternatively, the system includes two coil sensors each constructed and arranged to detect the voltage induced by movement of the armature. The two coil sensors may be connected in a feedback arrangement to a differential amplifier constructed to provide a differential signal to the controller.

The actuator sensor includes an optical sensor, a capacitance sensor, an inductance sensor, or a bridge for sensitively detecting a signal change due to movement of the armature.

The actuator may have the armature housing constructed and arranged for a linear displacement of the armature upon the solenoid receiving the drive signal. The actuator may be a latching actuator constructed to maintain the armature in the open passage state without any drive signal being delivered to the solenoid coil. The latching actuator may include a permanent magnet arranged to maintain the armature in the open passage state. The latching actuator may further include a bias spring positioned and arranged to bias the armature toward an extended position providing a close passage state without any drive signal being delivered to the solenoid coil.

The controller may be constructed to direct the power driver to provide the drive signal at various levels depending on the signal from the actuator sensor. The drive signal may be current. The system may include a voltage booster providing voltage to the power driver.

The controller may be constructed to direct the power driver to provide the drive signal in a first drive direction and thereby create force on the armature to achieve a first end position. The controller is also constructed to determine whether the armature has moved in a first direction based on signal from the actuator sensor; and if the armature has not moved within a predetermined first drive duration, the controller directs application of the drive signal to the coil in the first direction at an elevated first-direction drive level that is higher than an initial level of the drive signal.

The controller may be constructed to trigger the power driver to provide the drive signal in a first drive direction and thereby create force on the armature to achieve a first end position. The controller is also constructed to determine whether the armature has moved in a first direction based on signal from the actuator sensor; and if the armature has moved, the controller directs application of the drive signal to the coil in the first direction at a first-direction drive level that is being lower than an initial level of the drive signal.

The actuator system may include the controller constructed to determine a characteristic of the fluid at the passage based on the signal from the actuator sensor. The characteristic of the fluid may be pressure, temperature, density, or viscosity. The actuator system may include a separate a temperature sensor for determining temperature of the fluid.

The actuator system may include the controller constructed to determine a pressure of the fluid at the passage based on the signal from the actuator sensor. The actuator system may receive signals from an external motion sensor or a presence sensor coupled to the controller.

The above-mentioned aspects are described in detail in connection with the following drawings.

BRIEF DESCRIPTION OF THE DRAWINGS

FIG. 2C is a schematic cross-sectional view of yet another embodiment of a piston valve controlled by a riding actuator having an o-ring and an input channel shown in FIG. 2C-I and the overall inlet section shown in FIG. 2C-II.

DETAILED DESCRIPTION OF ILLUSTRATIVE EMBODIMENTS

Figure 1:
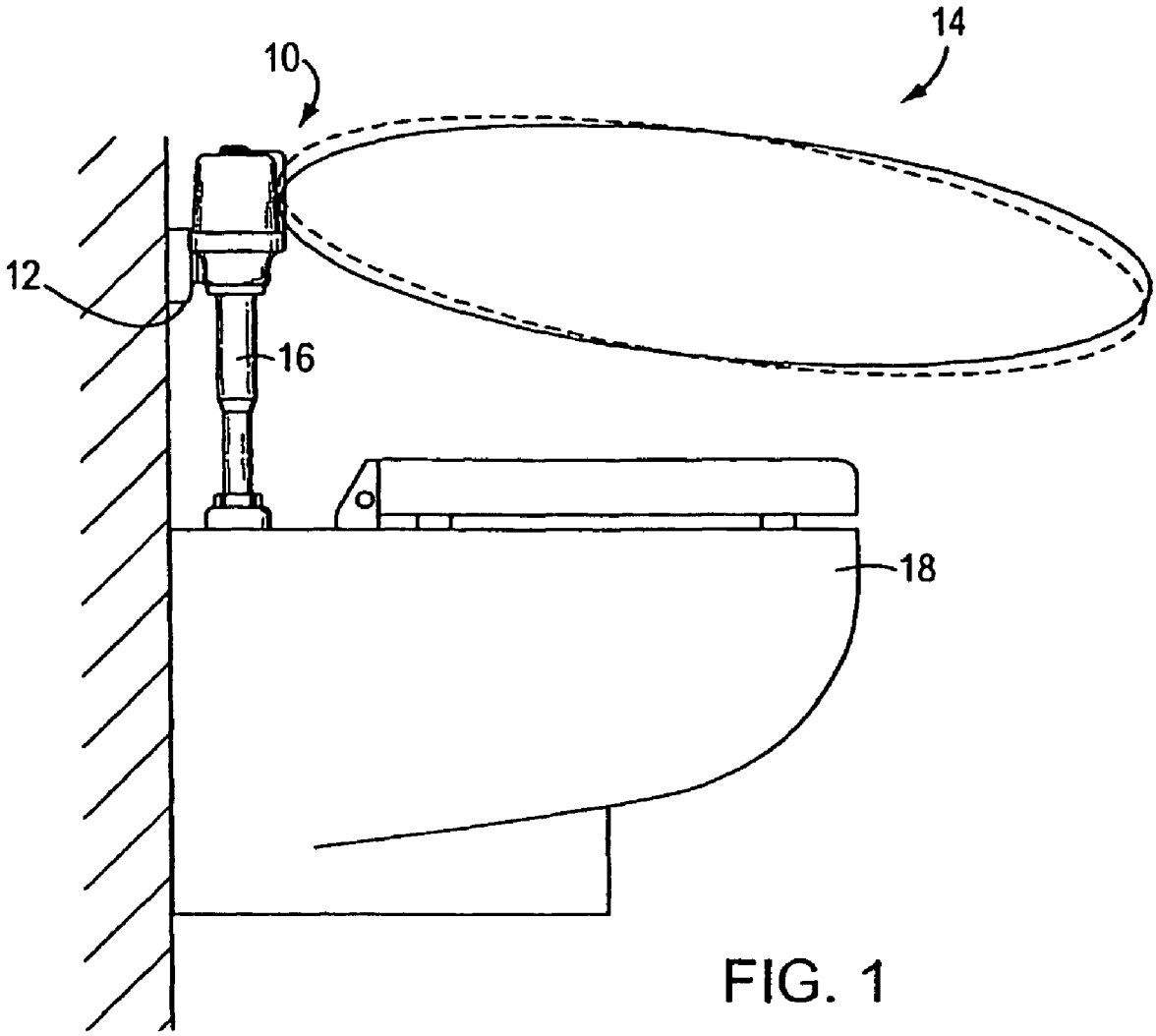
FIG. 1 is a side elevation of a toilet and an accompanying automatic flusher.
Figure 1A:
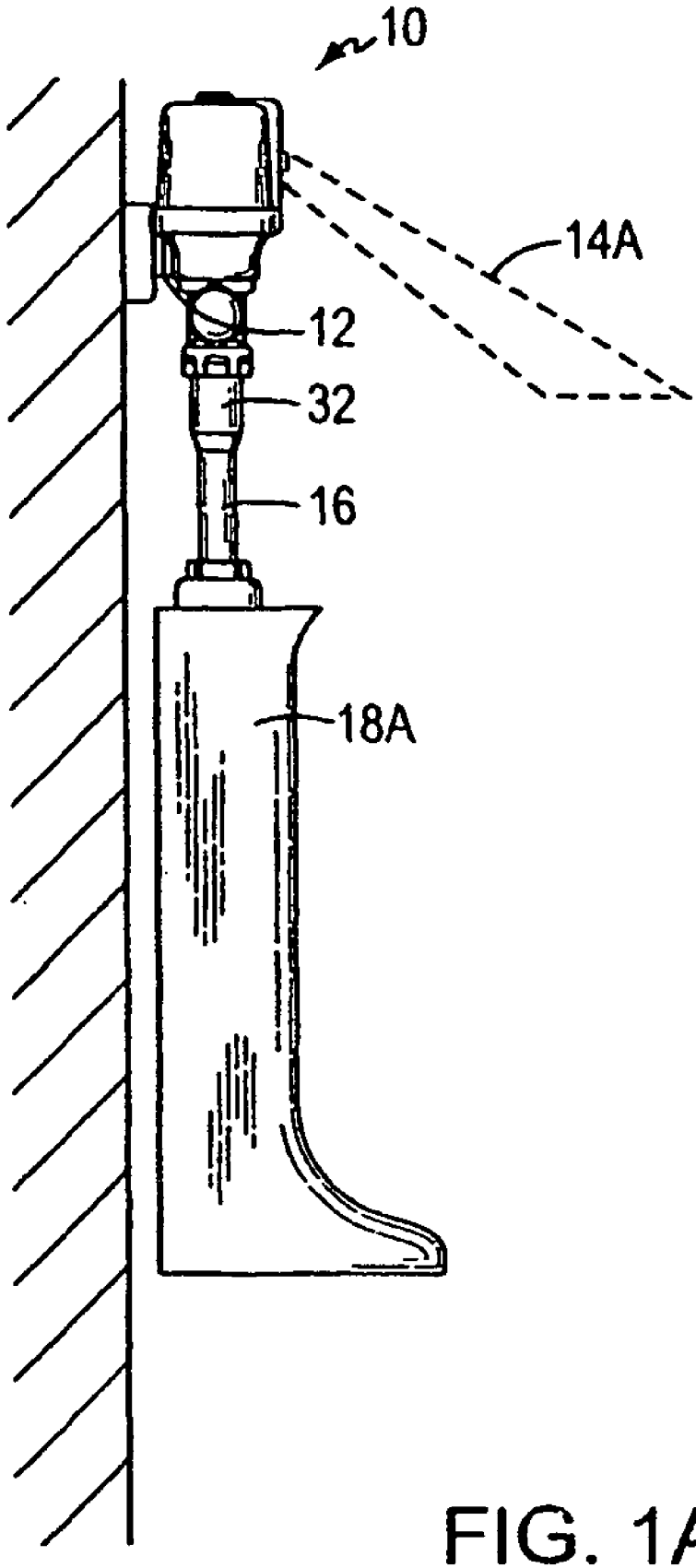
FIG. 1A is a side view of a urinal and an accompanying automatic flusher.

FIG. 1 illustrates an automatic bathroom flusher 10. Flusher 10 receives pressurized water from a supply line 12 and employs an object sensor to respond to actions of a target within a target region 14 by selectively opening a valve that permits water from the supply line 12 to flow through a flush conduit 16 to the bowl of a toilet 18. FIG. 1A illustrates bathroom flusher 10 used for automatically flushing a urinal 18A. Flusher 10 receives pressurized water from supply line 12 and employs the object sensor to respond to actions of a target within a target region 14A by selectively opening a valve that permits water from the supply line 12 to flow through the flush conduit 16 to the urinal 18A.

There are two main embodiments of the object sensor. The first embodiment of the object sensor is shown in FIGS. 2, 2A, 2C and 2D. This object sensor uses only an optical detector in the visible or infrared (IR) range. The detector provides output signals to the control circuitry shown in FIGS. 8 through 8C. Based on the detector output signal, a processor initiates a flushing action. This embodiment of the object sensor does not use a light source.

Figure 4:
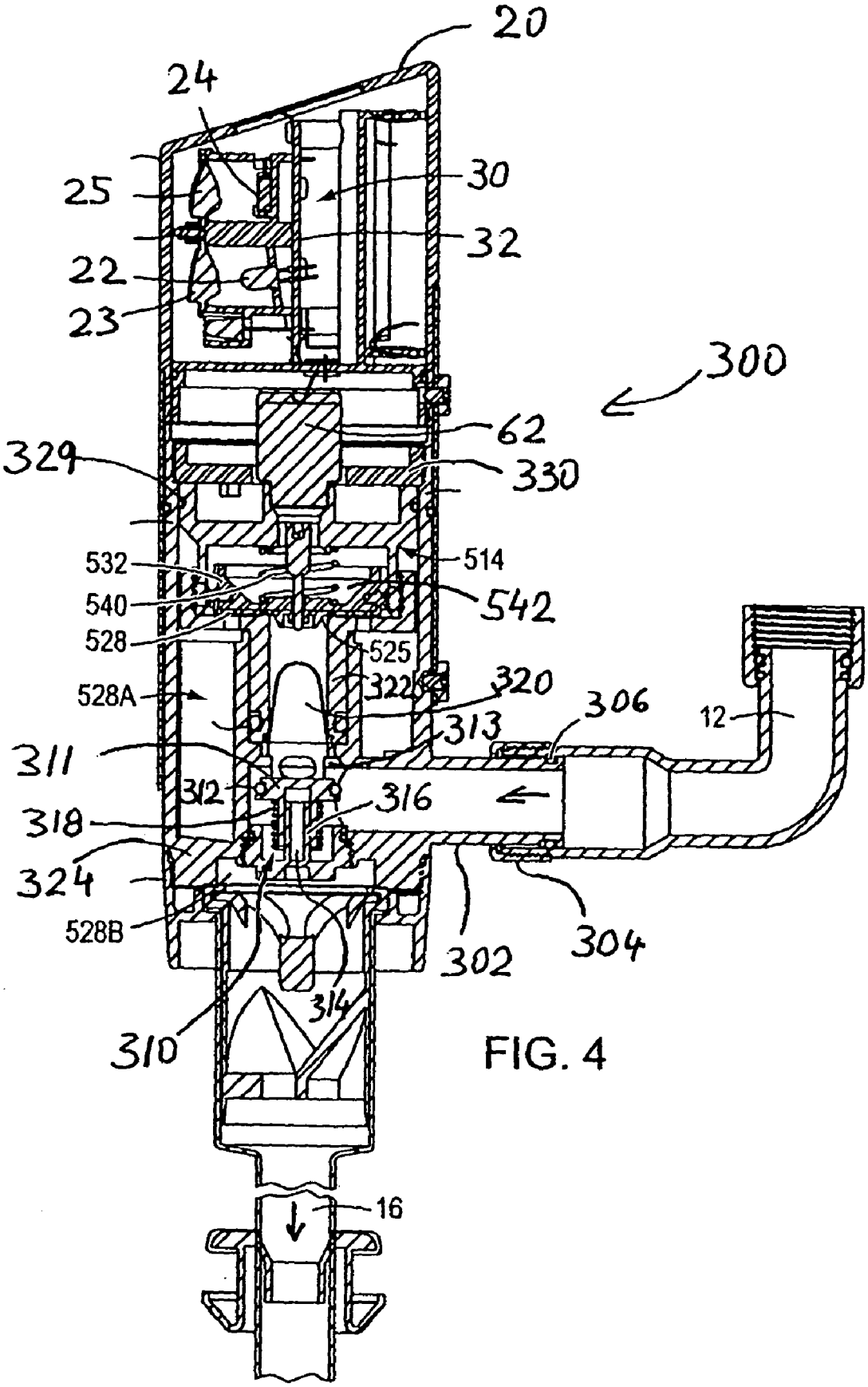
FIGS. 4 and 4A are cross-sectional views of yet another embodiment of the automatic flusher of FIG. 1 or FIG. 1A.
Figure 4A:
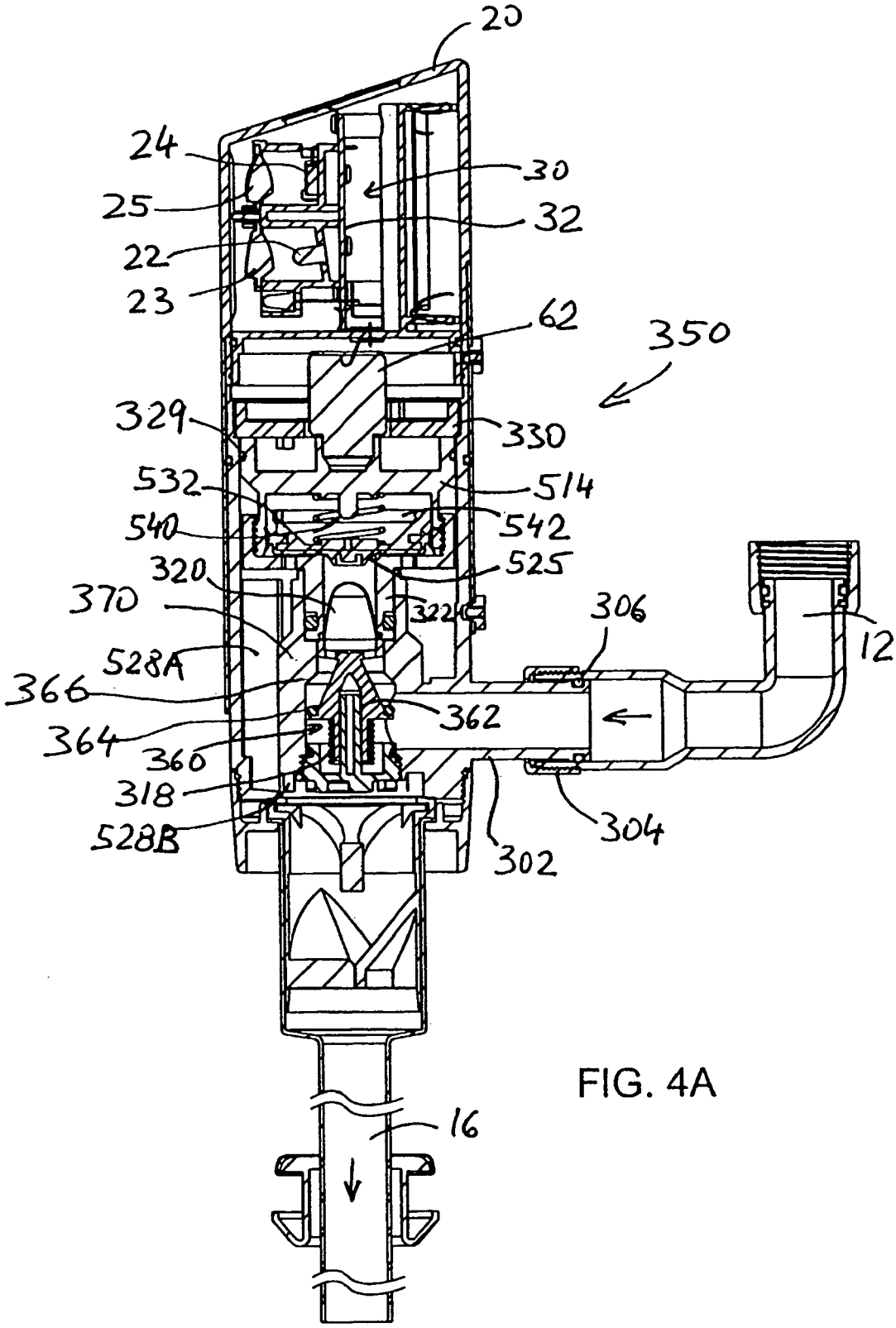
Figure 5:
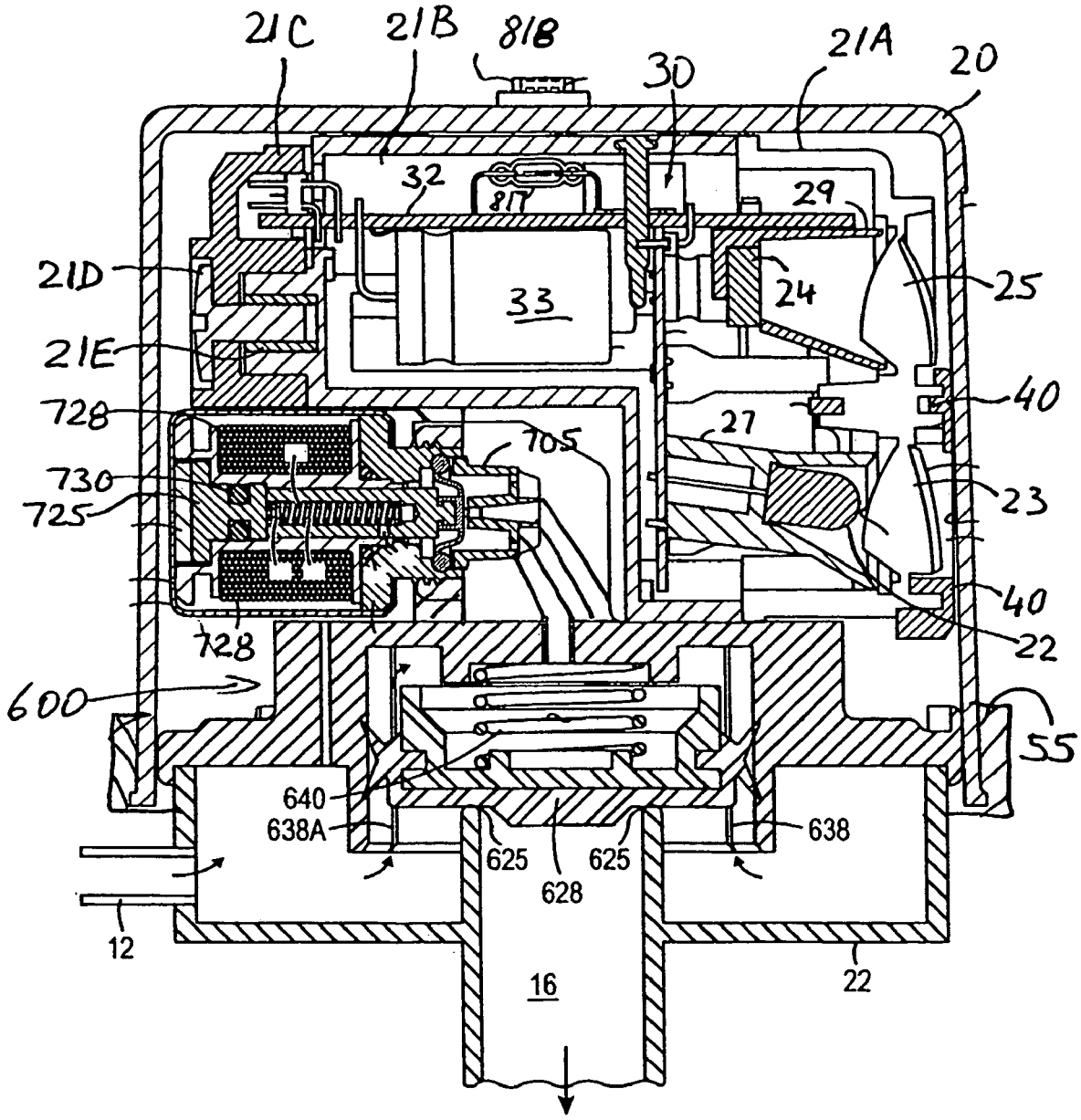
FIG. 5 is a cross-sectional view of yet another embodiment of the automatic flusher of FIG. 1 or FIG. 1A.

The second embodiment of the object sensor is shown in FIGS. 4, 4A, and 5. This embodiment of the object sensor uses both an optical source and an optical detector in the visible or infrared (IR) range. Based on a novel algorithm, a processor initiates light emission from the light source and the corresponding light detection by the detector. The detector provides output signals to the control circuitry shown in FIGS. 8 through 8C, based on which the processor initiates a flushing action.

Figure 8:
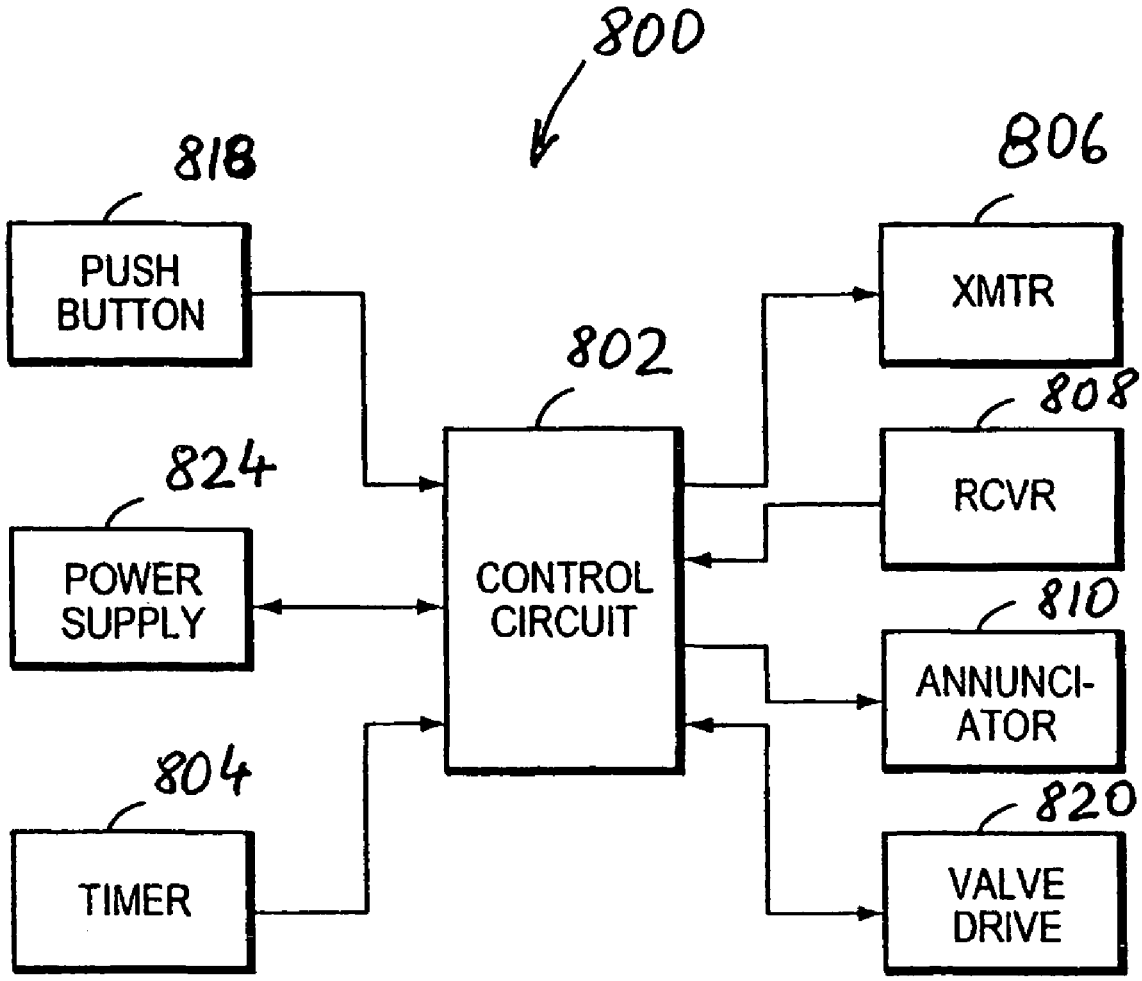
FIGS. 8 and 8A are overall block diagrams of a control circuitry used in the flushers shown in FIG. 1 and FIG. 1A.
Figure 8A:
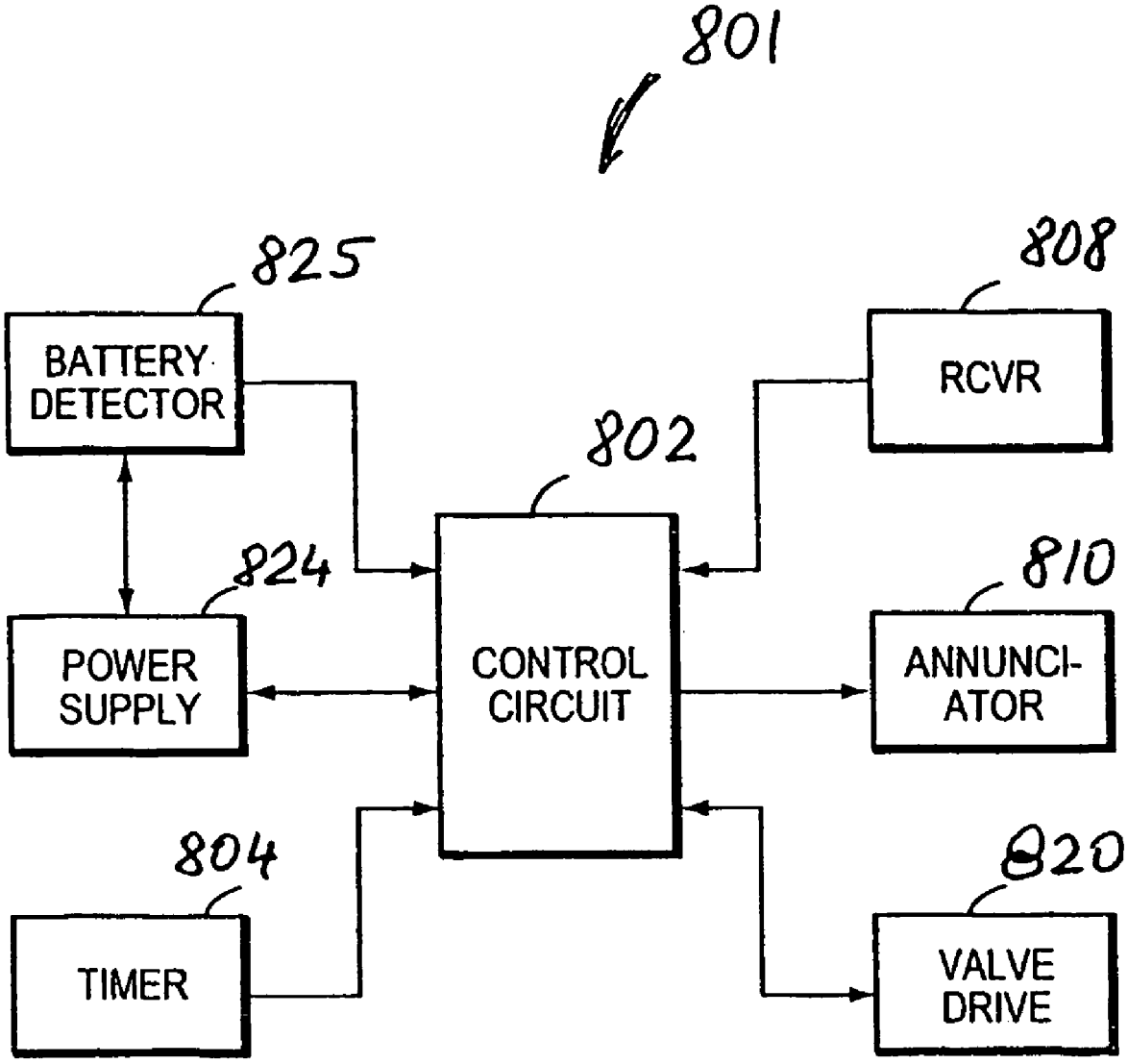
Figure 8B:
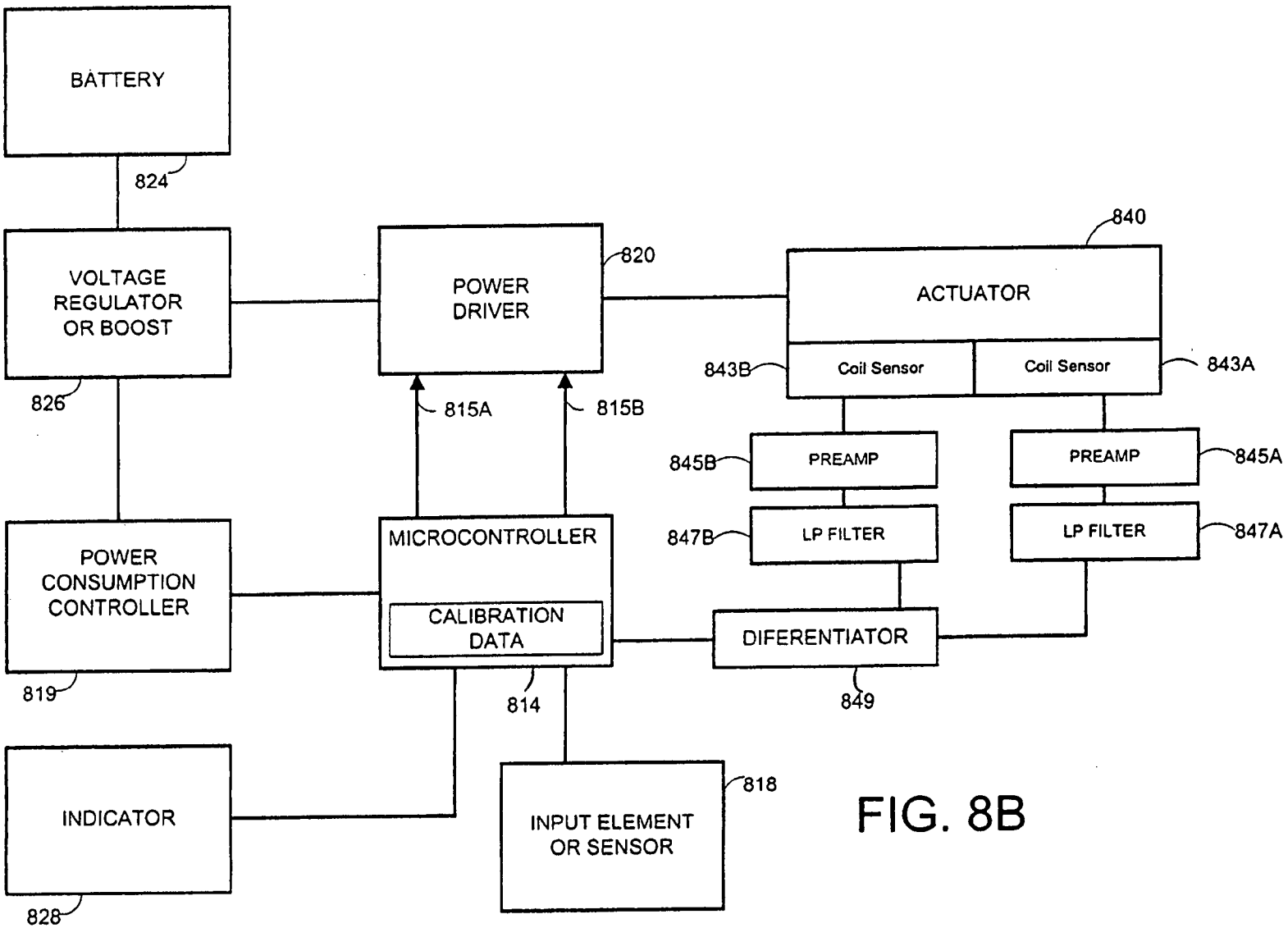
FIG. 8B is a detailed block diagram of another embodiment of a control system for controlling operation of the electromechanical actuator shown in FIGS. 7, 7A, 7B or 7C.
Figure 8C:
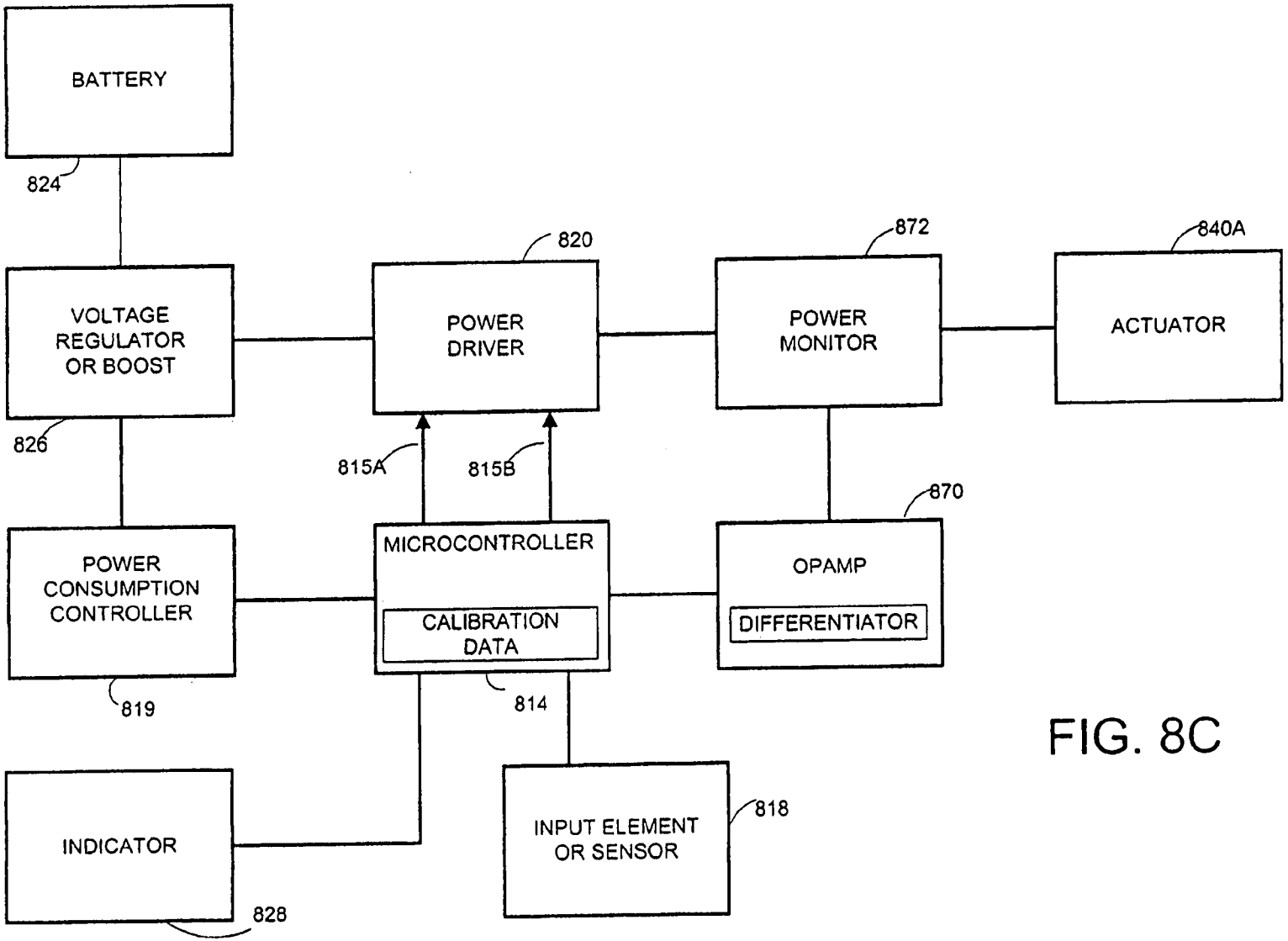
FIG. 8C is a block diagram of yet another embodiment of a control system for controlling operation of the electromechanical actuator shown in FIGS. 7, 7A, 7B or 7C.
Figure 8D:
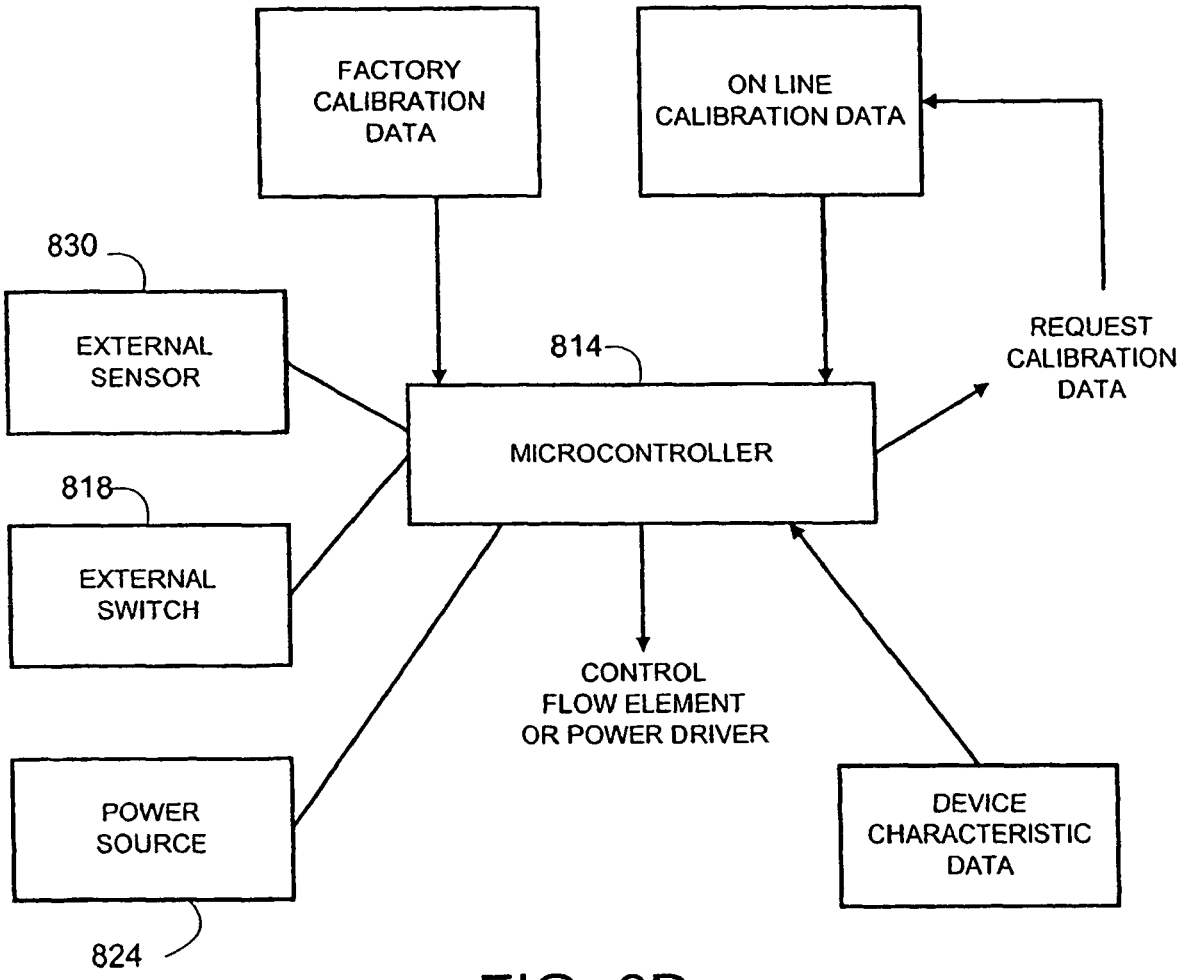
FIG. 8D is a block diagram of data flow to a microcontroller used in the fluid flow control system of FIGS. 8A or 8B.

Bathroom flusher 10 may use the flush valve embodiments shown in FIGS. 2 through 5 controlled by any of the controllers shown in FIGS. 8 through 8D, receiving signals from the object sensor of the first embodiment or the object sensor of the second embodiment.

Figure 2:
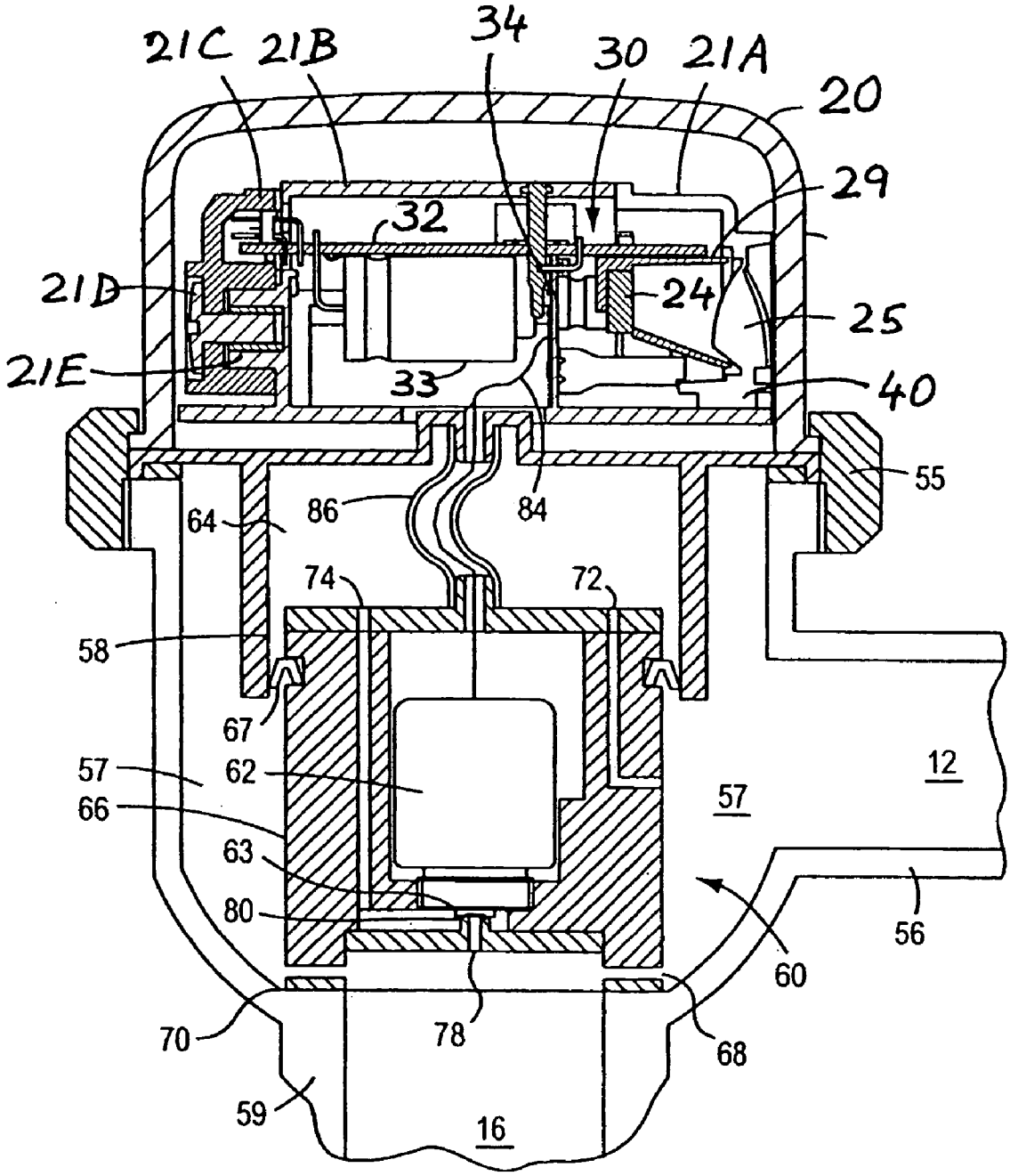
FIG. 2 is a schematic cross-sectional view of a piston valve controlled by a riding actuator for use in the automatic flusher of FIG. 1 or FIG. 1A.
Figure 2A:
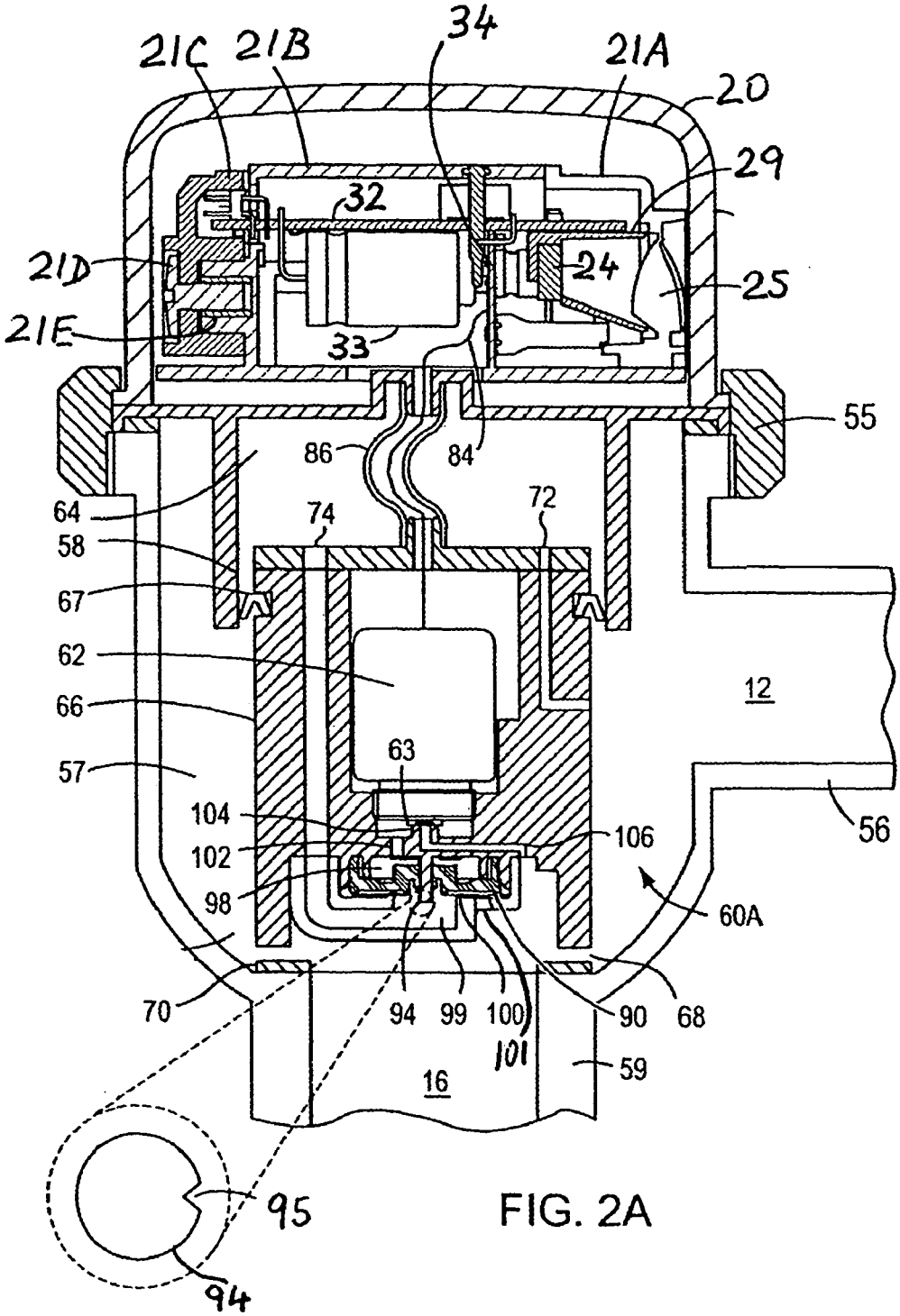
FIG. 2A is a schematic cross-sectional view of another embodiment of a piston valve controlled by the riding actuator having a pilot section controlled by a diaphragm having a control orifice shown in FIG. 2A-I.
Figure 2B:
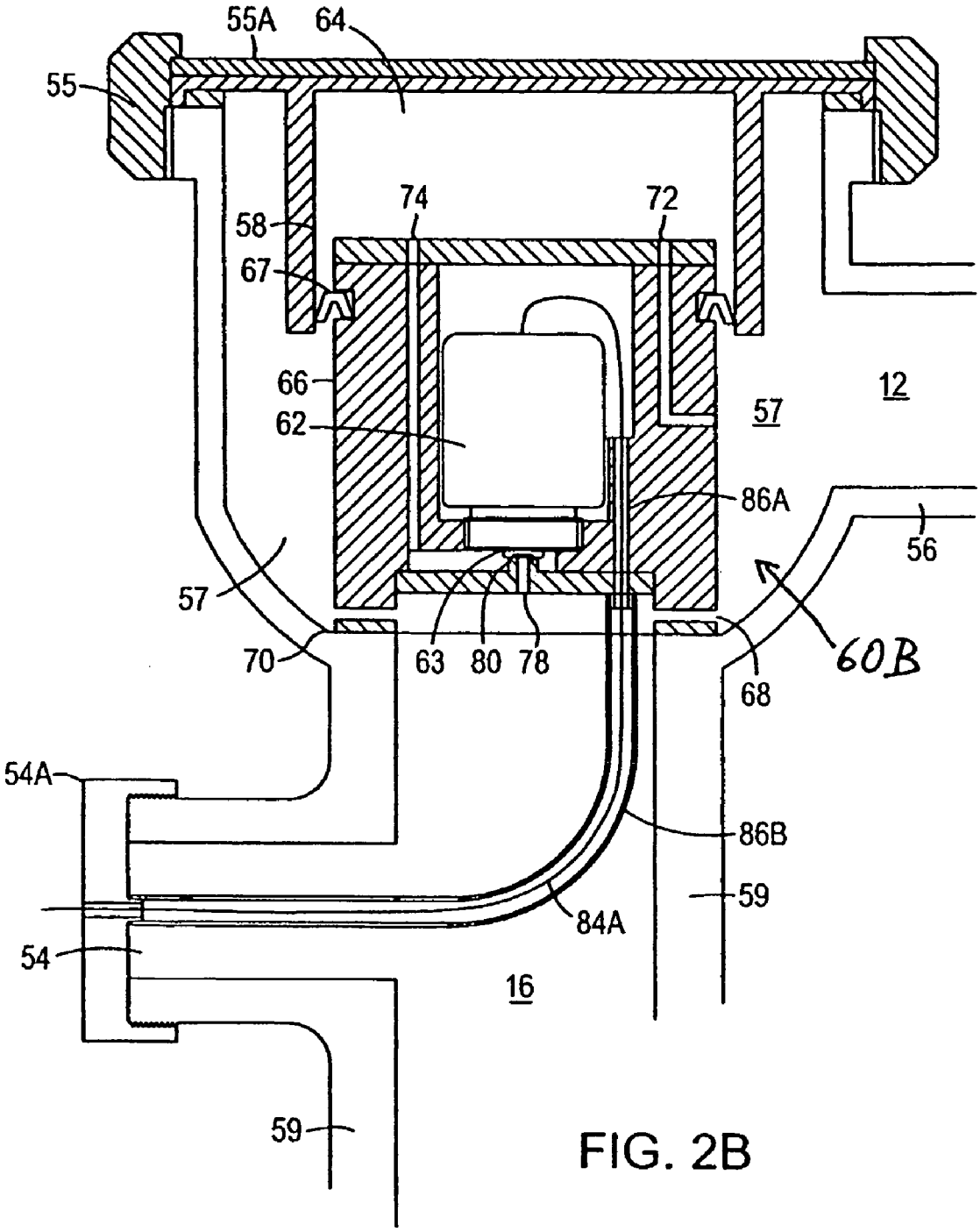
FIG. 2B is a schematic cross-sectional view of another embodiment of a piston valve controlled by a riding actuator.
Figure 2D:
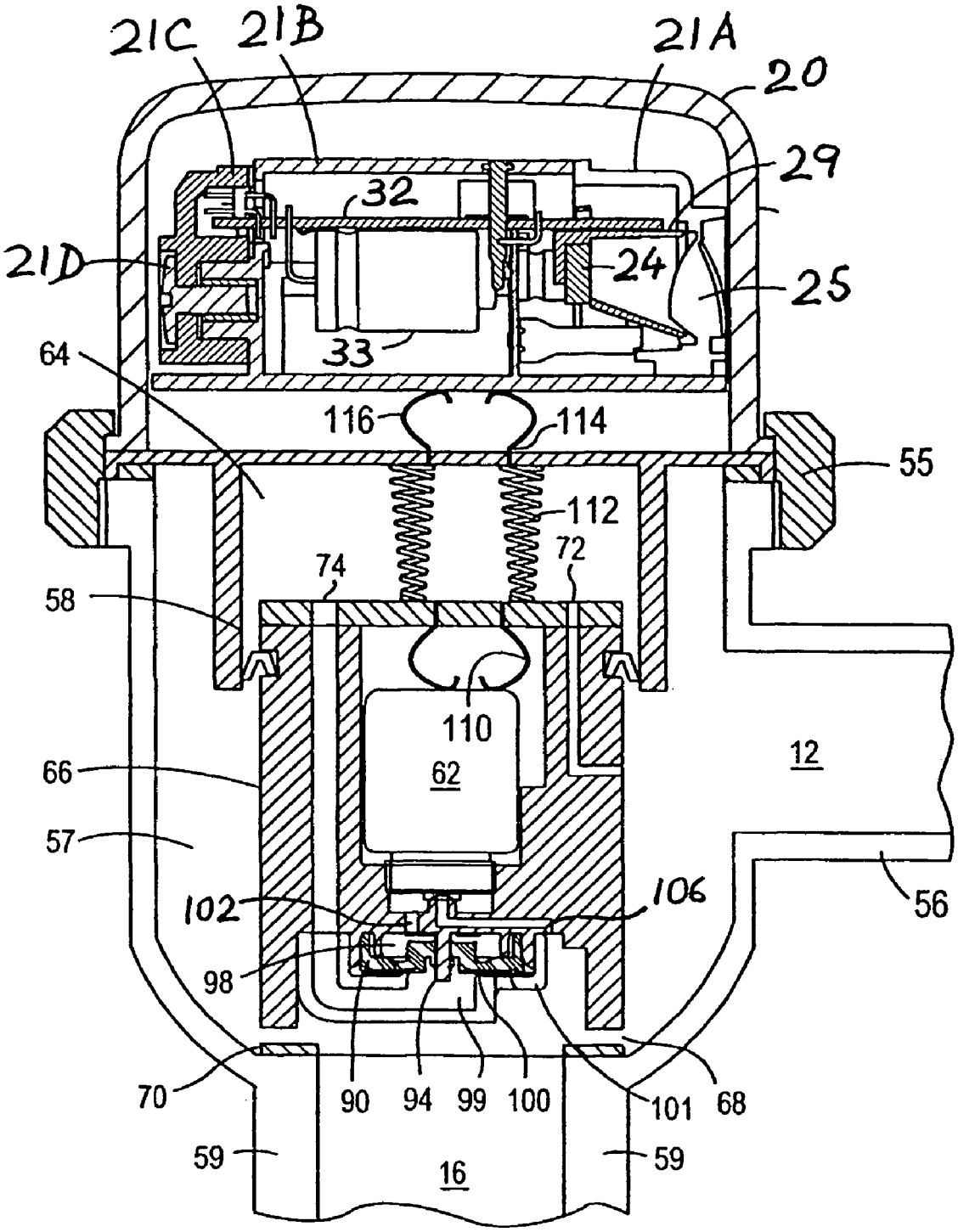
FIG. 2D is a schematic cross-sectional view of yet another embodiment of a piston valve controlled by a riding actuator having electrical connections provided by a spring.

FIGS. 2 through 2D illustrate various novel embodiments of a piston valve including a valve actuator moving with the piston, and FIGS. 2E through 2H illustrate various novel embodiments of a diaphragm valve including a valve actuator moving with the diaphragm between the opened and closed states. Both valve types may be used with the optical sensors described in this document or any other sensor known in the art. In each of these embodiments, the entire valve actuator moves together with the main closure element (e.g., a piston or a diaphragm) between an open state enabling fluid flow and a closed state preventing fluid flow between a fluid inlet and a fluid outlet. The valve actuator may be an electrical actuator (e.g., a solenoid or electromotor), a hydraulic actuator, a pneumatic actuator or the like associated with a pilot mechanism and constructed to control the movement of the main valve element between the open state and the closed state based on a position of a sealing member. Various hydraulic and pneumatic actuators are described in co-pending PCT Application PCT/US01/43273, filed on Nov. 20, 2001, which is incorporated by reference.

FIG. 2 is a schematic cross-sectional view of a first embodiment of flusher 10. This flusher uses an optical sensor 20, a controller, and a piston valve 60 actuated by a riding actuator 62. Riding actuator 62 receives a drive signal from a driver, associated with the control electronics described below, and displaces a plunger having a tip 63 arranged to seal a control orifice 78. Piston valve 60 controls fluid flow between fluid inlet 12 and fluid outlet 16. Piston valve 60 includes a pilot chamber 64 and a valve piston 66 moving between a closed position designed to seal flush passage 68 at a main seat 70 and an open position. Valve piston 66 includes a plurality of control passages for controlling pressure inside pilot chamber 64. Specifically, an input control passage 72 supplies water from an input chamber 57 to pilot cavity 64, and an output control passage 74 drains water from pilot cavity 64, through control orifice 78 located near a pilot seat 80. Valve piston 66 also includes a sliding seal 67, which prevents radial leaks in the clearance between piston 66 and a valve body surface 58.

During the operation, water enters the main valve assembly through inlet 12 and exits through main outlet 16 when valve piston 66 is lifted off main seat 70. This water flow is interrupted when piston 66 is pressed against main seat 70 by a force proportional to the line water pressure provided via input passage 72 to pilot chamber 64. The water pressure inside chamber 64 forces piston 66 against main seat 70 given that the downwardly directed surface area of piston 66 inside pilot chamber 64 is much larger than the opposing surface at passage 68. Thus, when control orifice 78 is closed, there is a force differential that provides a net downward force on valve piston 66. This closing force increases with and is proportional to the line pressure at water inlet 12.

To open the piston valve, riding actuator 62 receives a drive current from the power driver through electrical leads 84, which are housed in a flex conduit 86. Flex conduit 86 maintains and seals electrical leads 84 without allowing any water leak from cavity 64 to the control cavity where batteries, optical sensor and other electronics are located. While actuator 62 moves together with valve piston 66, with respect to the stationery control area or the valve body, the flexible flex conduit 86 protects leads 84. According to another embodiment, flex conduit 86 is replaced by a mechanism involving a rigid piston with a radial seal traversing in a cylinder. In this embodiment, the piston has a hole through its center for leads 84 to pass though. Alternatively, flex conduit 86 is replaced by two water-tight feed-through seals for leads 84 preventing any water leak from cavity 64 to the control cavity or the actuator cavity.

Still referring to FIG. 2, output control passage 74 drains water from pilot cavity 64. Importantly, the cross section of fluid input passage 72 is substantially smaller than that of output control passage 74 or flush passage 68 at valve seat 70. Therefore, the drain rate of pilot cavity 64 is much faster than its fill rate. This difference results in pilot cavity 64 draining, when valve actuator 62 is in the open state, that is, a plunger 67 does not seal drain output 78. When the pressure in pilot cavity 64 is lowered (via output control passage 74 and control orifice 78) valve piston 66 together with actuator 62 traverse upwards allowing water flush from fluid inlet 12 through main flush passage 68 to fluid outlet 16.

On the other hand, when plunger 67 of valve actuator 66 seals against a pilot seat 80, pilot chamber 64 does not loose water through output control passage 74 and control orifice 78. In the closed state (when plunger 63 seals against the pilot seat at control orifice), conduit 72 continues to supply water at line pressure from inlet 12, which results in a pressure build up inside pilot chamber 64. Sliding seal 67 prevents radial leaks in the clearance between piston 66 and a valve body surface 58. The pressure pilot chamber 64 eventually equals to the line pressure, which, in turn, forces piston 66 onto valve seat 70 stopping the main flow from fluid inlet 12 to fluid outlet 16.

FIG. 2A is a schematic cross-sectional view of another piston valve 60A controlled by a riding actuator 62 having a pilot section controlled by a pilot diaphragm 90. The valve includes main fluid inlet 12, main fluid outlet 16, and a valve piston 66 constructed and arranged to seal the valve at the main valve seat 70. Valve piston 66 is controlled by a pilot mechanism that includes pilot diaphragm 90 located on a pilot guide pin 94 and seated against a pilot seat. Actuator 62 controls fluid pressure behind pilot diaphragm 90 in control pilot chamber 98, which uses an amplification effect for controlling fluid flow between main fluid inlet 12 and main fluid outlet 16 at the valve seat 70.

Specifically, valve piston 66 includes a plurality of control passages for controlling pressure inside pilot chamber 64. As described above, input control passage 72 supplies water from an input chamber 57 to pilot cavity 64, and an output control passage 74 drains water from pilot cavity 64, through control orifice 101 located near a pilot seat sealed by pilot diaphragm 90. Actuator 62 controls pressure in control chamber (cavity) 98 behind pilot diaphragm 90 through a pilot passage 102 and a pilot orifice 106.

Referring still to FIG. 2A, as described above, in the closed position, valve piston 66 is seated against valve seat 70 to prevent water flow from inlet 12 to outlet 16. To open the flush valve, actuator 62 receives a drive current from the driver and retracts it's plunger thereby opening the passage near tip 63 enabling water flow from pilot passage 102 to pilot orifice 106. This water flow reduces pressure in control chamber (cavity) 98 behind pilot diaphragm 90. Pilot diaphragm 90 then flexes inwardly toward control chamber (cavity) 98 and away from a sealing surface 100 thereby providing an open passage from output control passage 74 to front chamber 99 and to control orifice 101 draining to main output 16. Output control passage 74 drains water from pilot cavity 64, which reduces the pressure in pilot cavity 64 and causes valve piston 66 together with actuator 62 move upwards allowing water flush from fluid inlet 12 through main flush passage 68 to fluid outlet 16.

To close the flush valve, actuator 62 receives a drive current from the driver and extends it's plunger thereby closing the passage near tip 63 preventing water flow from pilot passage 102 to pilot orifice 106. Water still flows from output control passage 74 to front chamber 99 and to control orifice 101. However, water also flows to control chamber (cavity) 98 via a passage formed by a pin groove 95, shown in FIG. 2A-I. Specifically, the passage is formed by the opening in diaphragm 90, used for sliding the diaphragm, and groove 95. As the pressure increases in control chamber 98, diaphragm 90 flexes toward sealing surface 100 reducing and later preventing water flow to control orifice 101. At this point, pilot chamber 64 does not loose water through output control passage 74 and control orifice 101. The water pressure inside chamber 64 forces piston 66 against main seat 70 due to the above-described force differential that provides a net downward force on valve piston 66. In the closed state, conduit 72 continues to supply water pressure from inlet 12, which is transferred by force to the main elastomeric seat 70. Sliding seal 67 prevents radial leaks in the clearance between piston 66 and a valve body surface 58.

Still referring to FIG. 2A, to open the piston valve, the controller sends a signal to a driver that provides current through electrical line 84 to riding actuator 62. The activated actuator 62 removes plunger tip 63 from the plunger seat. This enables water flow from chamber 98 through conduit 104 to conduit 106 resulting in a low pressure in diaphragm chamber 98. Thus, diaphragm 90 flexes inwardly toward chamber 98 lifting off pilot seat 100. This movement of pilot diaphragm 90, in turn, results in the draining of cavity 64 through conduit 74 and orifice 100. Therefore, there is a low pressure in pilot chamber 64 on the top of piston 62, but still a line pressure in input chamber 57. Therefore, there is a much higher pressure at the bottom of piston 66 (in communication with input chamber 57) than in pilot chamber 64, resulting in valve piston 66 lifting off seat 70. This opens the valve and enables water flow from main inlet 12 to main outlet 16.

The opening and closing speed of valve piston 66 is optimized by the size of the top surface inside pilot chamber 64, and the bottom surface in communication with input chamber 57 or at sliding seal 67 (i.e., any surface that opposes the top surface inside pilot chamber 64 facilitating downward pressure). Furthermore, the opening and closing speed of valve piston 66 is optimized by the size of input control passage 72 and output control passage 74. The opening and closing speed of pilot diaphragm is also optimized by the size of groove 95, which provides a larger flow rate than control passage 106 (for diaphragm 90 to close)

The embodiment of FIG. 2A includes a flex conduit 86 designed to allow the transfer of electrical lines 84 through pressurized chamber 64 into the control chamber that includes batteries and the electronics. Actuator 62 may also use other alternative embodiments for electrical signal transfer.

FIG. 2B illustrates another embodiment of the piston valve located within a flush valve body having water input 12, water output 16 and a manual handle port 54 (not being used for manual flush). This embodiment is similar to the embodiment of FIG. 2, but including riding actuator 62 having electrical wires 84A located within a conduit 86B connected to a cap 54A. Attached to cap 54A may be a manual control or an electronic control that commands riding actuator 62 located within valve piston 66.

Piston valve 60B includes pilot chamber 64 and valve piston 66 moving between a closed position designed to seal flush passage 68 at a main seat 70 and an open position. Valve piston 66 includes input control passage 72, which supplies water from an input chamber 57 to pilot cavity 64, and output control passage 74, which drains water from pilot cavity 64, through control orifice 78 located near pilot seat 80. Valve piston 66 also includes sliding seal 67, which prevents radial leaks in the clearance between piston 66 and valve body surface 58. During the operation, water enters the main valve assembly through main inlet 12 and exits through main outlet 16 when valve piston 66 is lifted off main seat 70. This water flow is interrupted when piston 66 is pressed against main elastomeric seat 70 by the force proportional to the line water pressure provided via input passage 72 to pilot chamber 64, as described above.

To open piston valve 60B, riding actuator 62 receives a drive current from the power driver through electrical leads 84A, and retracts its plunger away from pilot seat 80. This enables water flow from pilot chamber 64 via output control passage 74 and orifice 78 to output 16, and this water flow reduces pressure within pilot chamber 64. Thus, there is a net force upward, away from mail seat 70 and valve piston 66, together with actuator 62, moves to the open position. To move to the closed state, actuator 62 causes the plunger to seal pilot seat 80, thereby interrupting water flow from orifice 78, but conduit 72 continues to supply water at line pressure from inlet 12. This results in a pressure build up inside cavity 64, which pressure eventually equals to the line pressure that, in turn, forces piston 66 onto valve seat 70 stopping the main flow from fluid inlet 12 to fluid outlet 16.

While actuator 62 moves together with valve piston 66, with respect to the stationery valve body, flexible flex conduit 86B protects electrical leads 84A. Alternatively, flex conduit 86B may be replaced by two water-tight feed-through seals for electrical leads 84A preventing any water leak from output 16 to the actuator cavity or outside of cap 54A. This water-tight feed-through seal can be molded or assembled on either end. This conduit outlet concept is applicable to other configurations, and is applicable to pneumatic and hydraulic arrangements, where the pilot control is achieved by a non-electric actuator, as described in PCT Application PCT/US01/43273, which is incorporated by reference.

FIG. 2C is a schematic cross-sectional view of another embodiment of piston valve controlled by a riding actuator that is similar to the embodiment of FIG. 2A. Piston valve 60C again includes a main fluid inlet 6–10, the main fluid outlet, and a valve piston 66 constructed and arranged to seal main valve seat 70. The movement of valve piston 66 is controlled by a pilot mechanism that includes pilot diaphragm 90 located on pilot guide pin 94, as described in connection with the embodiment of FIG. 2A. Actuator 62 controls fluid pressure in chamber 102 behind pilot diaphragm 90 using the amplification effect for controlling fluid flow between main fluid inlet 12 and main fluid outlet 16.

Valve piston 66 includes an elastomeric sealing surface having a novel the shape at the main piston seat 70A designed at the pre-determined angle to the travel direction of valve piston 66. This novel angle of the co-operating surfaces enables a better sealing action and a removal of debris from the sealing surface.

The embodiment of FIG. 2C can use several possible ways of filtering or pre-filtering water and remove particulate matter prior to entering the pilot section. This may be done in addition or instead of using the isolated actuator shown in FIG. 7 or the isolated actuator described in co-pending PCT Application PCT/US01/51098, filed on Oct. 25, 2002, which is incorporated by reference. The filtering reduces the probability of clogging up any of the above-described passages. The present embodiment uses a filter arrangement similar to the filter currently employed in the GEM-2 flush valve produced by Sloan Valve Co. (Franklin Park, Ill. , USA) or described in U.S. Pat. No. 5,881,993 of T. Wilson, which is hereby incorporated by reference. The present embodiment can employ multiple control orifices, which are small in size and therefore have a high probability of dogging with foreign matter.

Referring also to FIG. 2C-I, the pilot mechanism includes a water inlet section having a groove 73 around the circumference of piston body 66, wherein leading to the two portions of grove 73 there are a series of smaller grooves 73A, shown in FIG. 2C-II. The filtering arrangement includes perpendicular and across groove 73A. Furthermore, groove 73 has an o-ring 75 placed in a way that given the cross sectional shape of groove 73 and o-ring 75 form a channel leading to the input to passage 72. Furthermore, in the middle of small perpendicular grooves 73A; there is a small pilot section entry point at o-ring 75. Water from main inlet 12 enters the main groove leading to passage 72 via the small perpendicular grooves 73A given that all other entry points are sealed by the intersection of the main groove side walls and the cross section of o-ring 75. The perpendicular grooves 73A have a significantly smaller cross section than the pilot entry point 73 to passage 72. This arrangement provides filtering action of any foreign matter. A similar filtering arrangement, employing multiple small inlet grooves to screen water for particles prior to its entry into the pilot section, can be employed with the diaphragm operated valve embodiment described in connection with FIG. 2E.

FIG. 2D is a schematic cross-sectional view of yet another embodiment of a piston valve controlled by riding actuator 62 having electrical connections fed by spring contacts 112. Spring contacts 112 are designed to provide electrical connection or biasing (spring) action, or both for valve piston 66. Valve piston 66 is controlled by the above described pilot mechanism that includes pilot diaphragm 90 located on a pilot guide pin 94 and seated against a pilot seat. Actuator 62 controls fluid pressure behind pilot diaphragm 90 in control pilot chamber 98, which uses an amplification effect for controlling fluid flow between main fluid inlet 12 and main fluid outlet 16 at the valve seat 70.

As described above, valve piston 66 includes a plurality of control passages for controlling pressure inside pilot chamber 64 using input control passage 72 and output control passage 74, which drains water from pilot cavity 64, through control orifice 101. Actuator 62 controls pressure in control chamber (cavity) 98 behind pilot diaphragm 90 through a pilot passage 102 and a pilot orifice 106. To close the flush valve, actuator 62 receives a drive current from the driver via contacts 112. Actuator 62 extends its plunger thereby closing the passage from pilot passage 102 to pilot orifice 106. Water still flows from output control passage 74 to front chamber 99 and through control orifice 101. However, water also flows to control chamber 98 via a passage formed by the pin groove 95i shown in FIG. 2A-I. As the pressure increases in control chamber 98, diaphragm 90 flexes toward sealing surface 100 reducing and later preventing water flow to control orifice 101. At this point, pilot chamber 64 does not loose water through output control passage 74 and control orifice 101. The water pressure inside chamber 64 forces piston 66 against main seat 70. The closing action is assisted by springs 112. In the closed state, conduit 72 continues to supply water pressure from inlet 12, which is transferred by force to the main elastomeric seat 70.

Spring contacts 112 are metal springs (or plastic springs with a conductive element) that form electrical connections yet allowing sufficient compliance for the necessary motion of valve piston 66. According to one embodiment, springs 112 are compressed (i.e., biased to extend) to assist the closing action. According to another embodiment, springs 1 12 are biased to contract to assist the lifting of valve piston 66 off valve seat 70.

Figure 2E:
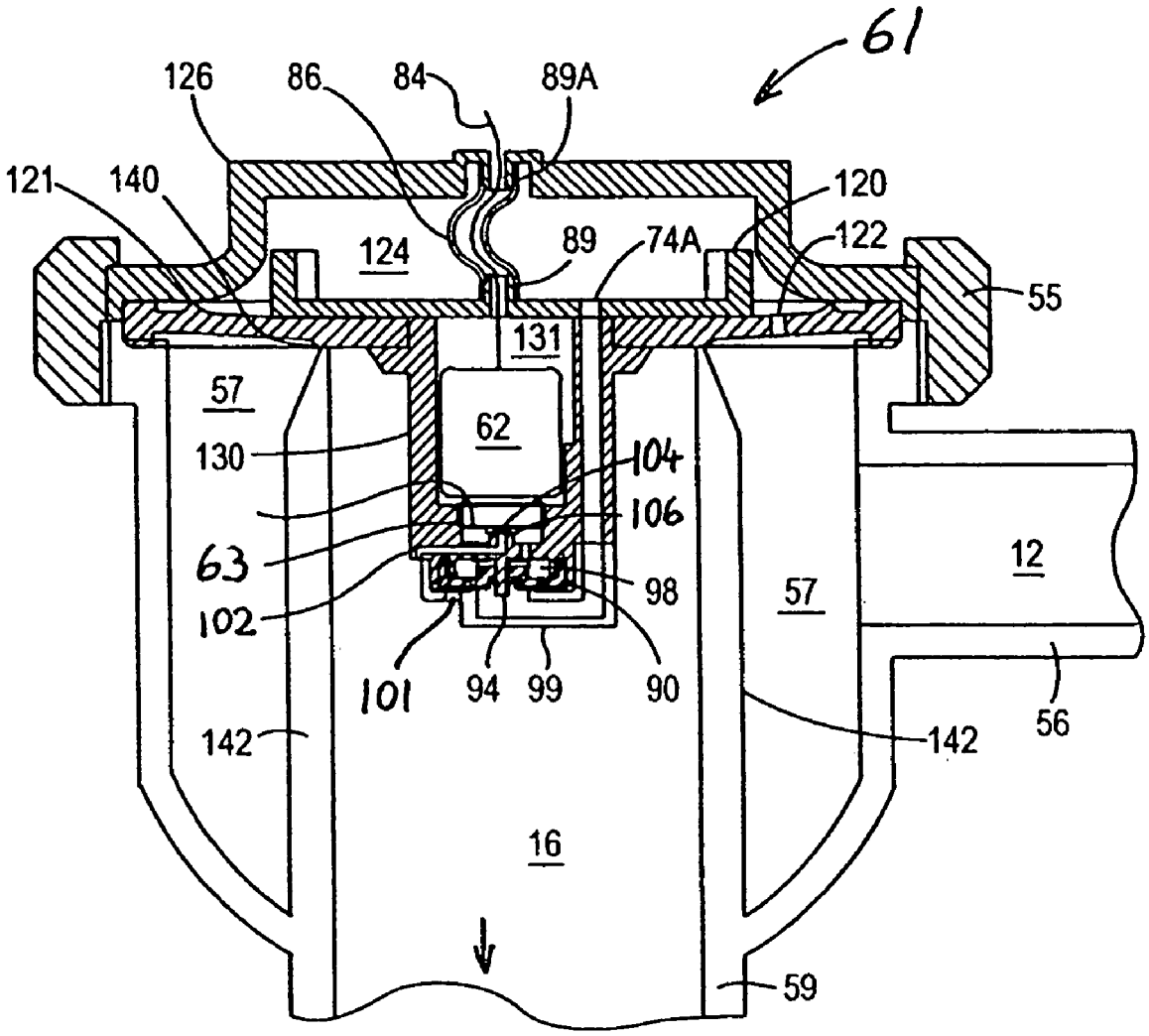
FIG. 2E is a schematic cross-sectional view of a diaphragm valve controlled by a riding actuator with a pilot section having a second, smaller diaphragm arranged for optimal control.

FIG. 2E is a schematic cross-sectional view of a diaphragm valve 61 controlled by riding actuator 62 connected to and moving with a main diaphragm 120. Riding actuator 62 controls a pilot section having a pilot diaphragm 90, which in turn controls pressure at main diaphragm 120. This two stage piloting arrangement having main valve diaphragm 120 and pilot diaphragm 90 provides an amplification effect that can easily control water flow from main water input 12 to water output 16 over a large pressure range.

Diaphragm flush valve 61 includes a valve body 56 with main inlet 12, and valve body 59 with water outlet 16. Diaphragm flush valve 61 also includes main diaphragm 120 attached on its periphery between valve body 59 and a cover 126 using a threaded ring 55. The valve body also includes an upper body part with a dome or cap attached to the lower body 56 as shown in FIG. 2. The flush valve includes a pilot chamber 124 is formed by cover 126 and diaphragm 120. Diaphragm 120 includes a control orifice 122, which enables water flow from main input chamber 57 to pilot chamber 124 and thus enables pressure equalization between main chamber 57 and pilot chamber 124 separated by diaphragm 120. When the pressure is equalized, there is a net force on diaphragm 120 from pilot chamber 124 downward toward main valve seat 140 since the diaphragm area inside pilot chamber 124 is larger than the opposing diaphragm area inside main input chamber 57. The downward oriented net force keeps the valve closed by sealing the main passage at a main seat 140 and prevents water flow from main inlet 12 to main outlet 16.

Main inlet 12 receives water at a line pressure and provides a small portion through a small metering, control orifice 122 to a top piloting chamber (cavity) 124. Control orifice 122 can include a large area screen surface with very small openings, or can include any of several other filtering arrangements (such as the filtering scheme currently employed in Sloan Valve Company's recently introduced Royal diaphragm assembly) or can include a cleaning member, for example, a reaming pin coupled to a spring as described in U.S. Pat. No. 5,456,279, which is incorporated by reference.

In the closed state, top piloting chamber 124 develops a static pressure equal to the static line pressure of the water entering main inlet 12. To open the flush valve, the pilot valve provides a pressure-relief mechanism that lowers the water pressure in pilot chamber 124. A controller activates actuator 62 (or in general any electro mechanical actuator), which moves plunger tip 63 to the retracted position, wherein it does not seal passage 102 from passage 106. Therefore, water flows from pilot chamber 98 located behind pilot diaphragm 90 to output orifice 106. This water flow reduces pressure in control chamber (cavity) 98, which causes pilot diaphragm 90 to flex inwardly toward control chamber (cavity) 98 and away from a sealing surface 100 thereby providing an open passage from output control passage 74A to front chamber 99 and to control orifice 101. Output control passage 74A drains water from pilot cavity 124, which reduces the pressure in pilot cavity 124 and causes main diaphragm 120 to flex upwards allowing water flush from fluid inlet 12 through the main flush passage at main seat 140 to fluid outlet 16.

To close the flush valve, actuator 62 receives a drive current from the driver and extends it's plunger thereby closing the passage near tip 63 preventing water flow from pilot passage 102 to pilot orifice 106. Water still flows from output control passage 74A to front chamber 99 and to control orifice 101. However, water also flows to control chamber 98 via a passage formed by pin groove 95, shown in FIG. 2A-I. As the pressure increases in control chamber 98, diaphragm 90 flexes toward sealing surface 100 (shown in detail in FIG. 2A reducing and later preventing water flow to control orifice 101. At this point, pilot chamber 124 does not loose water through output control passage 74 and control orifice 101. The water pressure inside chamber 124 creates a net force that presses main diaphragm 120 against main seat 140. In the closed state, orifice 122 continues to supply water pressure from inlet 12 to pilot chamber 124. Outer radial seals (including a seal 121) prevent radial leaks at the outer periphery of main diaphragm 120. The entire actuator/pilot assembly is sealed inside a cylinder or other water tight enclosure 130, which moves together with main diaphragm 120.

Figure 2F:
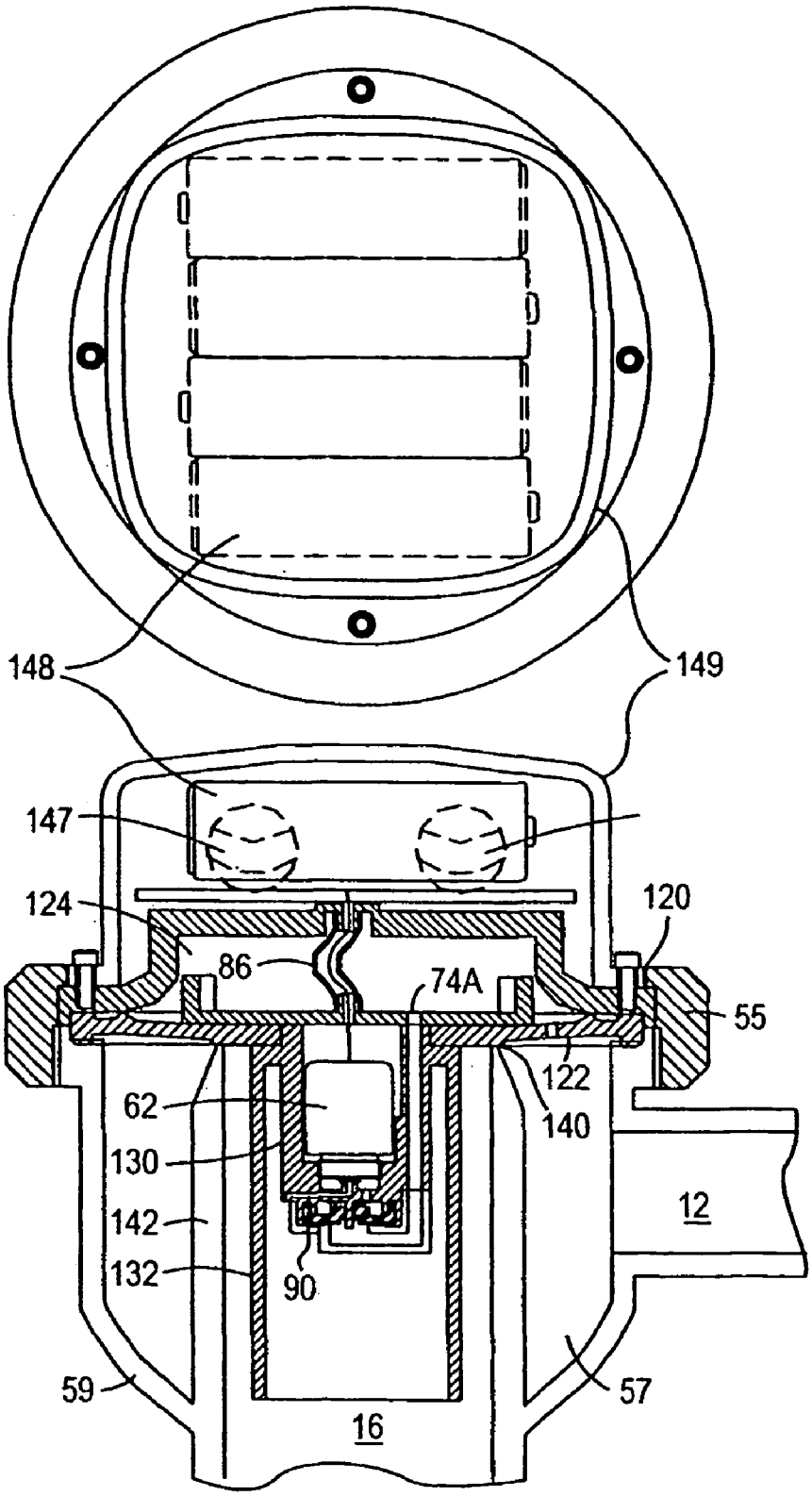
FIG. 2F illustrates another embodiment of a diaphragm valve controlled by a riding actuator.

FIG. 2F shows another embodiment of the diaphragm valve controlled riding actuator 62 connected to and moving with main diaphragm 120. Riding actuator 62 controls a pilot section having pilot diaphragm 90, which in turn controls pressure at main diaphragm 120, as described in connection with FIG. 2E.

The diaphragm flush valve includes the valve body with main water inlet 12 and water outlet 16. The diaphragm flush valve also includes main diaphragm 120 attached on its periphery between the valve body 59 and the cover using threaded ring 55. The valve body also includes an upper body part with a dome or cap 149 attached to the lower body. Dome or cap 149 includes the control electronics and batteries 147 and 148, as shown schematically in FIG. 2F. The flush valve includes pilot chamber 124 is formed by cover 126 and diaphragm 120. Diaphragm 120 includes control orifice 122, which enables water flow from main input chamber 57 to pilot chamber 124 and thus enables pressure equalization between main chamber 57 and pilot chamber 124 separated by diaphragm 120. When the pressure is equalized, there is a net force on diaphragm 120 from pilot chamber 124 downward toward main valve seat 140 since the diaphragm area inside pilot chamber 124 is larger than the opposing diaphragm area in main input chamber 57. The downward oriented net force keeps the valve closed by sealing the main passage at main seat 140 and prevents water flow from main inlet 12 to main outlet 16.

To open the flush valve, the pilot valve provides a pressure-relief mechanism that lowers the water pressure in pilot chamber 124. A controller activates actuator 62, which moves plunger tip 63 to the retracted position, wherein it does not seal passage 102 from passage 106. Therefore, water flows from pilot chamber 98 located behind pilot diaphragm 90 to output orifice 106. In general, actuator 63 may be replaced by a hydraulic or pneumatic actuator that reduces water pressure in control chamber (cavity) 98.

The reduced pressure in control chamber 98 causes pilot diaphragm 90 to flex inwardly toward control chamber 98 and away from a sealing surface 100 (see FIGS. 2A and 2E) thereby providing an open passage from output control passage 74A to front chamber 99 and to control orifice 101. Output control passage 74A drains water from pilot cavity 124, which reduces the pressure in pilot cavity 124 and causes main diaphragm 120 to flex upwards, allowing water flush from fluid inlet 12 to fluid outlet 16. To close the flush valve, actuator 62 extends it's plunger thereby closing the passage near plunger tip 63 thus preventing water flow from pilot passage 102 to pilot orifice 106, as described in connection with FIGS. 2A and 2E.

Figure 2G:
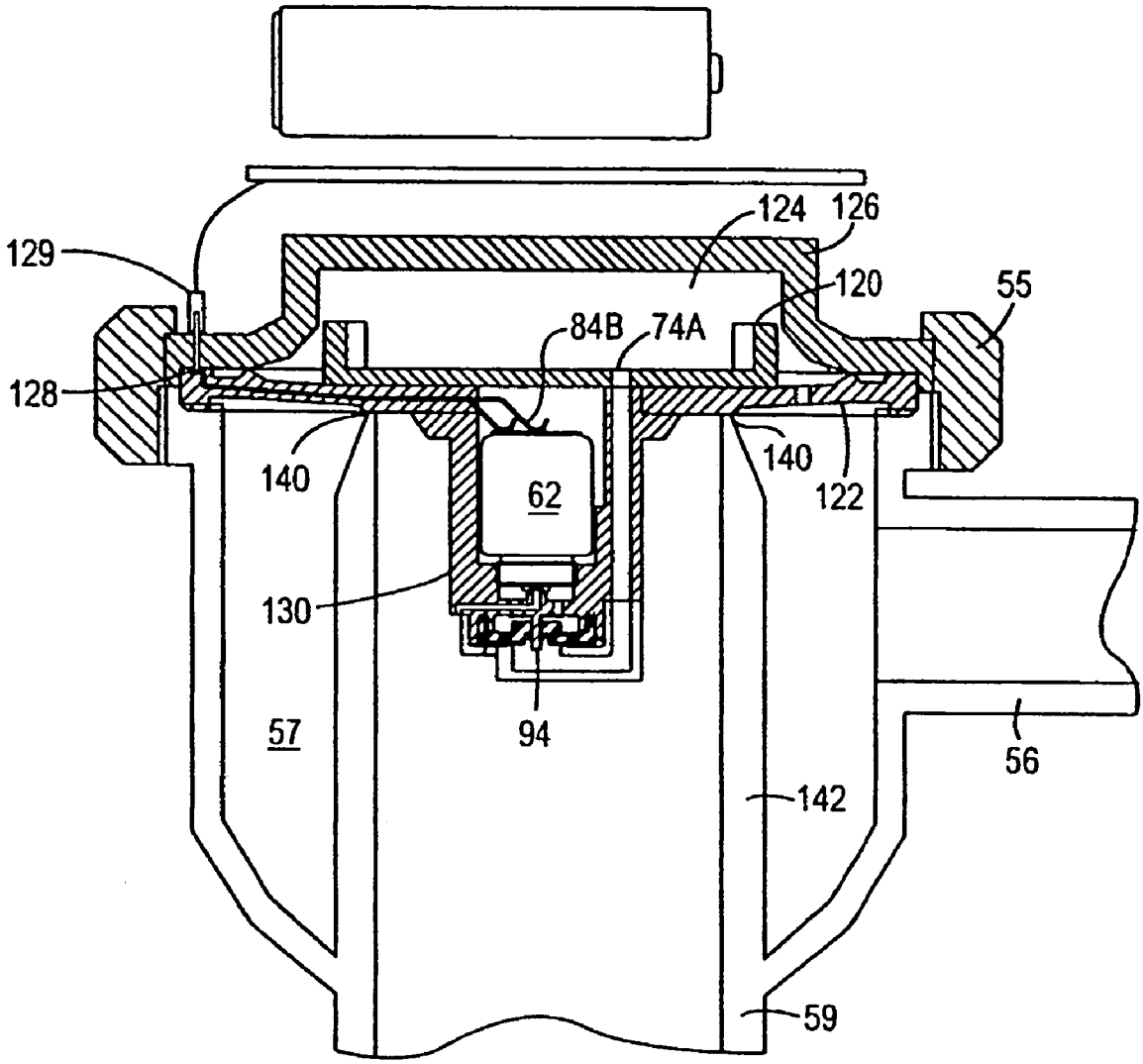
FIG. 2G illustrates schematically a cross-section of another embodiment of a diaphragm valve similar to FIG. 2E, but having control wires embedded in the flexible diaphragm.
Figure 2H:
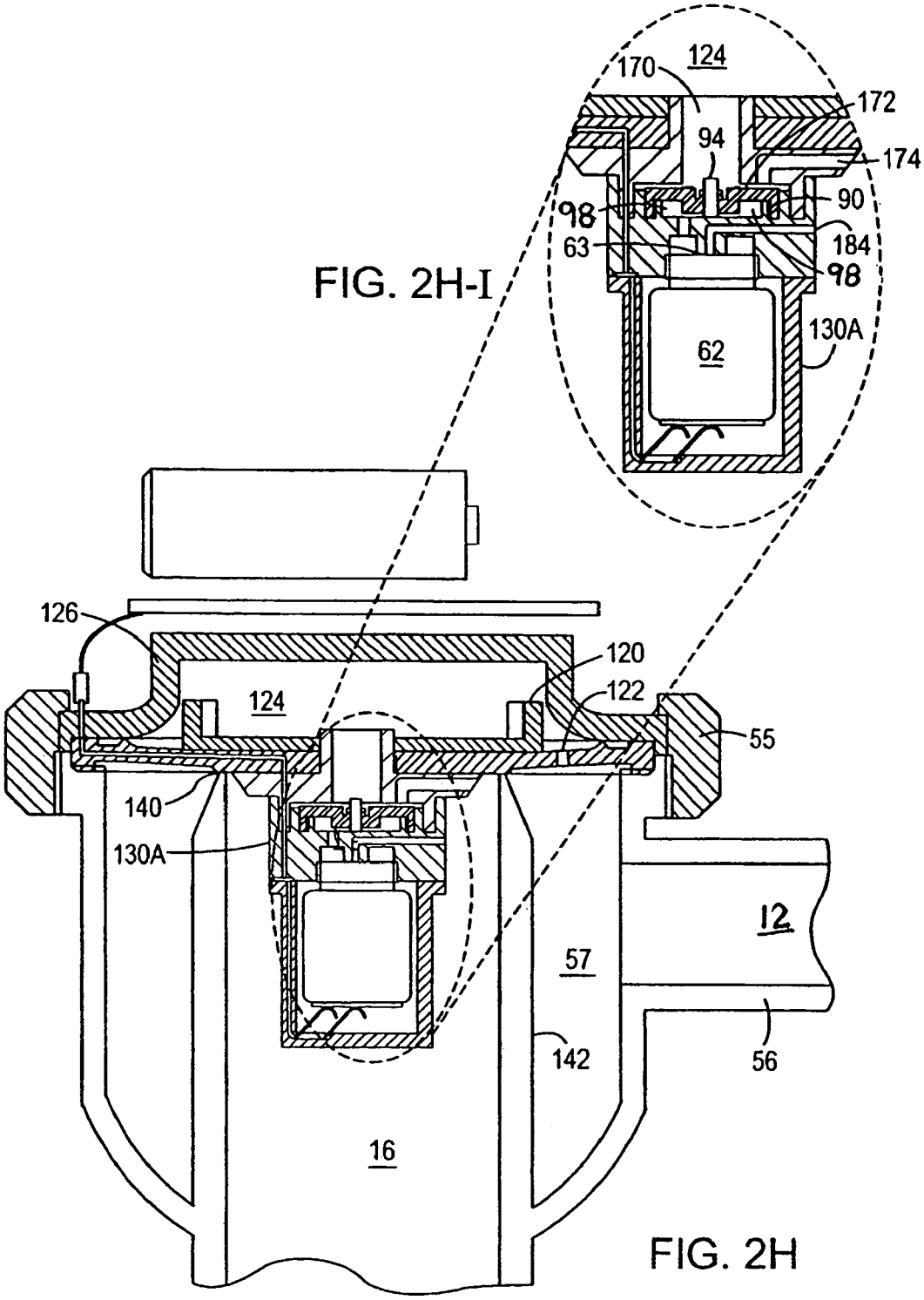
FIG. 2H is a schematic cross-sectional view of yet another embodiment of a diaphragm valve controlled by a pilot section having a second, smaller diaphragm arranged for optimal control.

FIGS. 2G and 2H show schematically cross-sectional views of other embodiments of a diaphragm valve similar to FIG. 2E having control wires embedded in main diaphragm 120. Referring to FIG. 2G, the control wires are transferred from actuator 62 to the flusher top area (including a sensor, electronics and batteries) inside diaphragm 120 and using a novel periphery conduits 128 and 129.

FIGS. 2H and 2H-I show another embodiment of the diaphragm valve controlled riding actuator 62 located inside a sealed enclosure 130A. Riding actuator 62 controls a pilot section having pilot diaphragm 90, which in turn controls pressure at main diaphragm 120, as described in connection with FIG. 2E. The diaphragm flush valve includes main diaphragm 120 attached on its periphery between the valve body 59 and the cover using threaded ring 55. The valve body also includes an upper body part with a dome or cap (not shown), which includes the control electronics and batteries.

The flush valve includes pilot chamber 124 is formed by cover 126 and diaphragm 120. Diaphragm 120 includes control orifice 122, which enables water flow from main input chamber 57 to pilot chamber 124 and thus enables pressure equalization between main chamber 57 and pilot chamber 124 separated by diaphragm 120. When the pressure is equalized, there is a net force on diaphragm 120 from pilot chamber 124 downward toward main valve seat 140. The downward oriented net force keeps the valve closed by sealing the main passage at main seat 140 and prevents water flow from main inlet 12 to main outlet 16.

To open the flush valve, the pilot valve provides a pressure-relief. mechanism that lowers the water pressure in pilot chamber 124. A controller activates actuator 62, which moves plunger tip 63 to the retracted position, wherein it does not seal the passage from pilot chamber 98 to output passage 184. Therefore, water flows from pilot chamber 98 located behind pilot diaphragm 90 to output orificel 84.

The reduced pressure in control chamber 98 causes pilot diaphragm 90 to flex inwardly toward control chamber 98 and away from a sealing surface 172 thereby providing an open passage from output control passage 170 to control orifice 174. Output control passage 170 drains water from pilot cavity 124, which reduces the pressure in pilot cavity 124 and causes main diaphragm 120 to flex upwards, allowing water flush from fluid inlet 12 to fluid outlet 16. To close the flush valve, actuator 62 extends it's plunger thereby closing the passage near plunger tip 63 thus preventing water flow from pilot passage 102 to pilot orifice 106, as described in connection with FIGS. 2A and 2E.

In general, the described valves (shown in FIGS. 2–2H) are constructed to fit the valve housing manufactured by Sloan Valve Company. Thus, the above-described valves may be sold as a retrofit assembly for manually operated flush valves. They may be electronically/electrically activated by electro mechanical actuators (i.e., devices that convert electrical energy to mechanical motion or force such as electro magnet, electric motors of various types, piezoelectric actuators or memory metal devices exhibiting their temperature change due to an electrical current application and as a result there mechanical dimensions change). They can also be actuated by hydraulic, pneumatic or mechanical actuators. In order to provide examples of the application of the technology, we have elected to employ examples of products used in the plumbing field, and in particular sensory activated Flushometers, made by Sloan Valve Company (of IL, USA). The inventive concept of the described embodiments may also be applied to products currently produced by Technical Concepts (of IL, USA), Zum Industries (of NC, USA), and Helvex (of Mexico City, Mexico).

FIGS. 2 and 4 illustrate two main types of the object sensors located within a housing 20. Referring to FIGS. 2, 2A, 2C and 2D, the first embodiment of the object sensor uses only an optical detector 24 constructed to detect light in the visible or infrared (IR) range. Optical detector 24 provides output signals to control circuitry 30 located on a main circuit board 32 and an auxiliary circuit board 34. Referring to FIGS. 4, 4A, and 5, the second embodiment of the object sensor uses both an optical source 22 and optical detector 24, both constructed to operate in the visible or infrared (IR) range. Based on a novel algorithm, a processor located on main circuit board 32 initiates light emission from light source 22 and the corresponding light detection by detector 24.

Flusher housing 20 encloses the optical and electronic elements in three parts, a front piece 21A, a center piece 21B, and a rear piece 21C. Several screws (not shown) secure front piece 21A to center piece 21B, to which rear piece 21C is in turn secured by screws such as a screw 21D. That screw threadedly engages a bushing 21E ultrasonically welded into a recess that the center housing piece 21B formed for that purpose. Main circuit board 32 components such as a capacitor 33 and a microprocessor shown in FIGS. 8B through 8D. An auxiliary circuit board 34 is in turn mounted on the main circuit board 32. Mounted on the auxiliary board 34 is light-emitting diode 22, which a transmitter hood 27 also mounted on that board partially encloses.

The front circuit-housing piece 21A forms a transmitter-lens portion 23, which has front and rear polished surfaces. The transmitter-lens portion focuses infrared light from light-emitting diode 22 through an infrared-transparent window 28 formed in the flusher housing 20. FIG. 1's pattern 14 represents the resultant radiation-power distribution. A receiver lens 25 formed by part 21A so focuses received light onto a photodiode 24 mounted on the main circuit board 32 that FIG. 1's pattern 14 of sensitivity to light reflected from targets results.

Like the transmitter light-emitting diode 22 the photodiode 24 is provided with a hood, in this case hood 29. The hoods 21A and 29 are opaque and tend to reduce noise and crosstalk. The circuit housing also limits optical noise; its center and rear parts 21B and 21C are made of opaque material such as Lexan 141 polycarbonate, while its front piece 21A, being made of transparent material such as Lexan OQ2720 polycarbonate so as to enable it to form effective lenses 23 and 25. This material has a roughened and/or coated exterior in its non-lens regions that reduces transmission through it. An opaque blinder 40 mounted on front piece 21A leaves a central aperture for infrared-light transmission from light-emitting diode 22 but otherwise blocks stray transmission that could contribute to crosstalk.

Transmitter and receiver lenses may be formed integrally with part of the circuit housing, which affords manufacturing advantages over arrangements in which the lenses are provided separately from housing 20. However, it may be referable in some embodiments to make the lenses separate greater flexibility in material selection for both the lens and the circuit housing.

Figure 3:
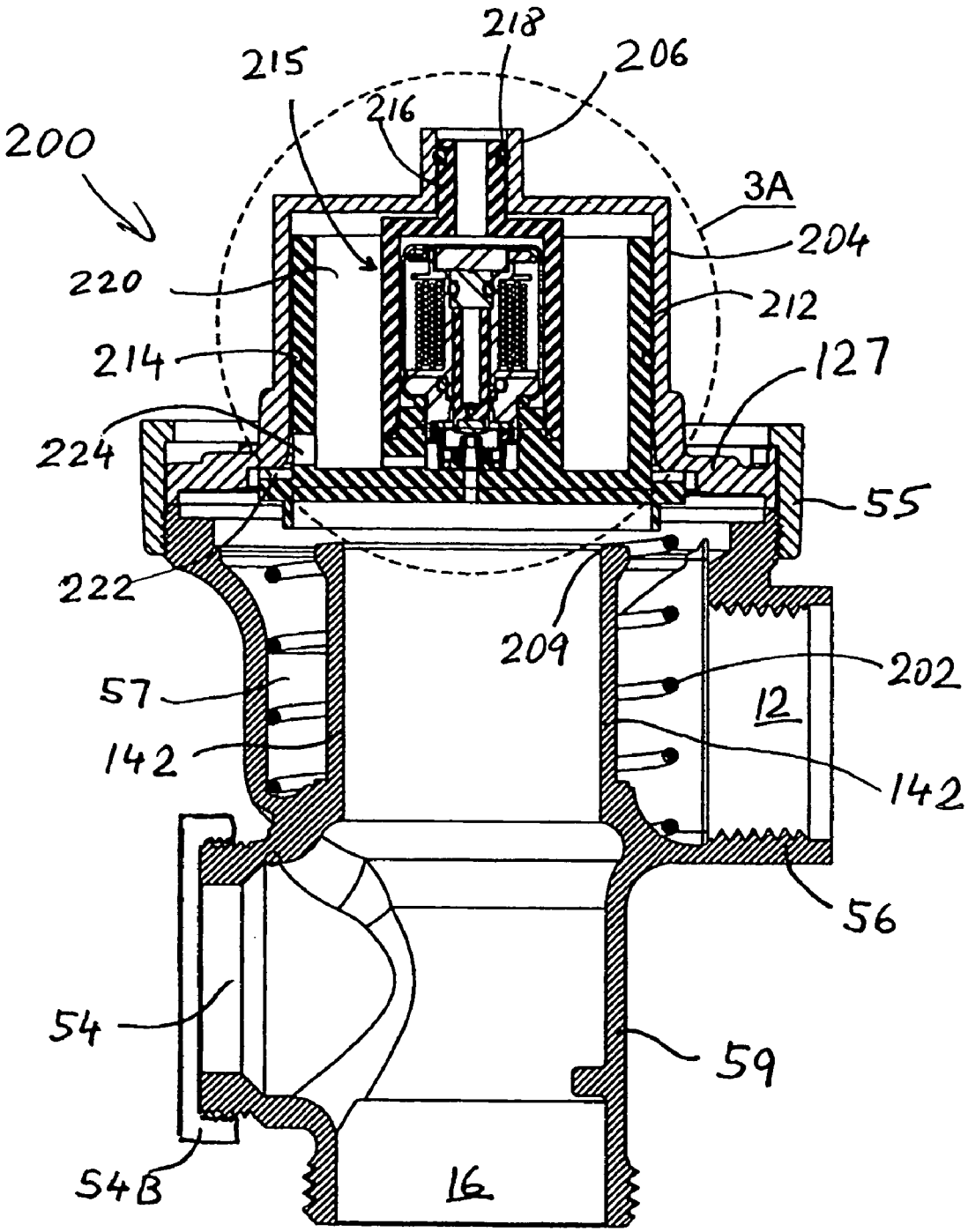
FIGS. 3 and 3A are cross-sectional views of yet another embodiment of the automatic flusher of FIG. 1 or FIG. 1A.
Figure 3A:
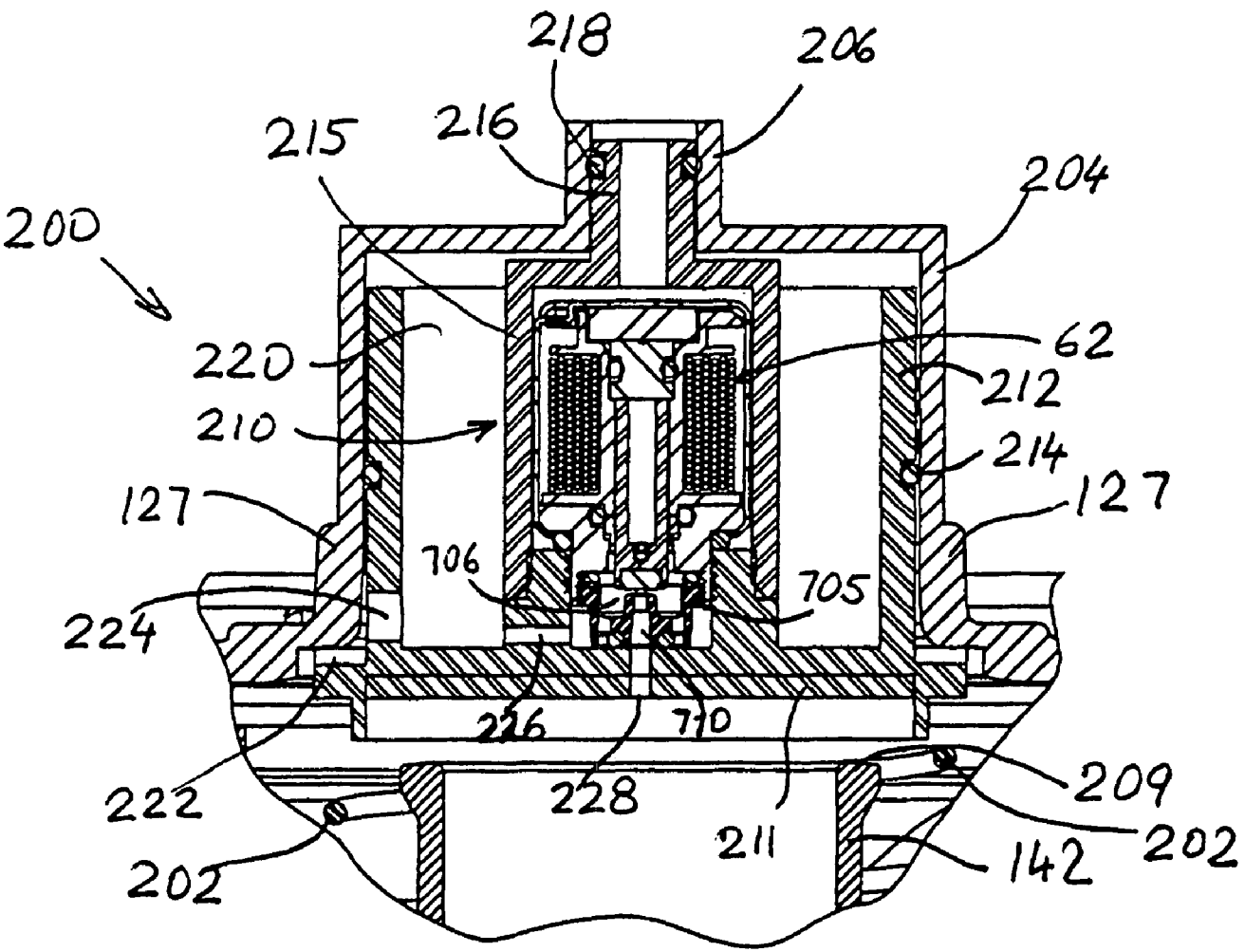

FIGS. 3 and 3A illustrate in detail another embodiment of the automatic flusher. Bathroom Flush valve 200 is designed as a retrofit assembly for installation in the housing of a standard manually operated bathroom flusher, for example, made by Sloan Valve Company. The retrofit assembly is co-operatively designed with the main valve body that includes main input 12 in communication with input cavity 57 created by body members 56 and 142. The valve body also includes a handle port 54 used for manual flush but in the present embodiment sealed by a cap 54B. Body member 59 provides the main water output 16.

The retrofit assembly includes valve 200 comprising a spring 202 in contact with a movable piston 210. Piston 210 includes a sealing member 211, piston walls 212, and an actuator enclosure 215. Actuator enclosure 215 houses solenoid actuator 62, and includes a guiding member 216. Piston 210 moves up and down within the cavity formed by housing member 127 including sidewalls 204 and 206. An O-ring 214 seals piston 210 with respect to wall member 204, and an O-ring 218 seals guiding member 206 with respect to the guiding member 216 of actuator enclosure 215. Actuator enclosure 215 and piston walls 212 form a pilot chamber 220 in communication with input chamber 57 via flow passages 222 and 224. Actuator 62 is constructed and arranged to relieve water pressure inside pilot chamber 220 via control passages 226 and 228, which are in communication with main output 16.

Figure 7:
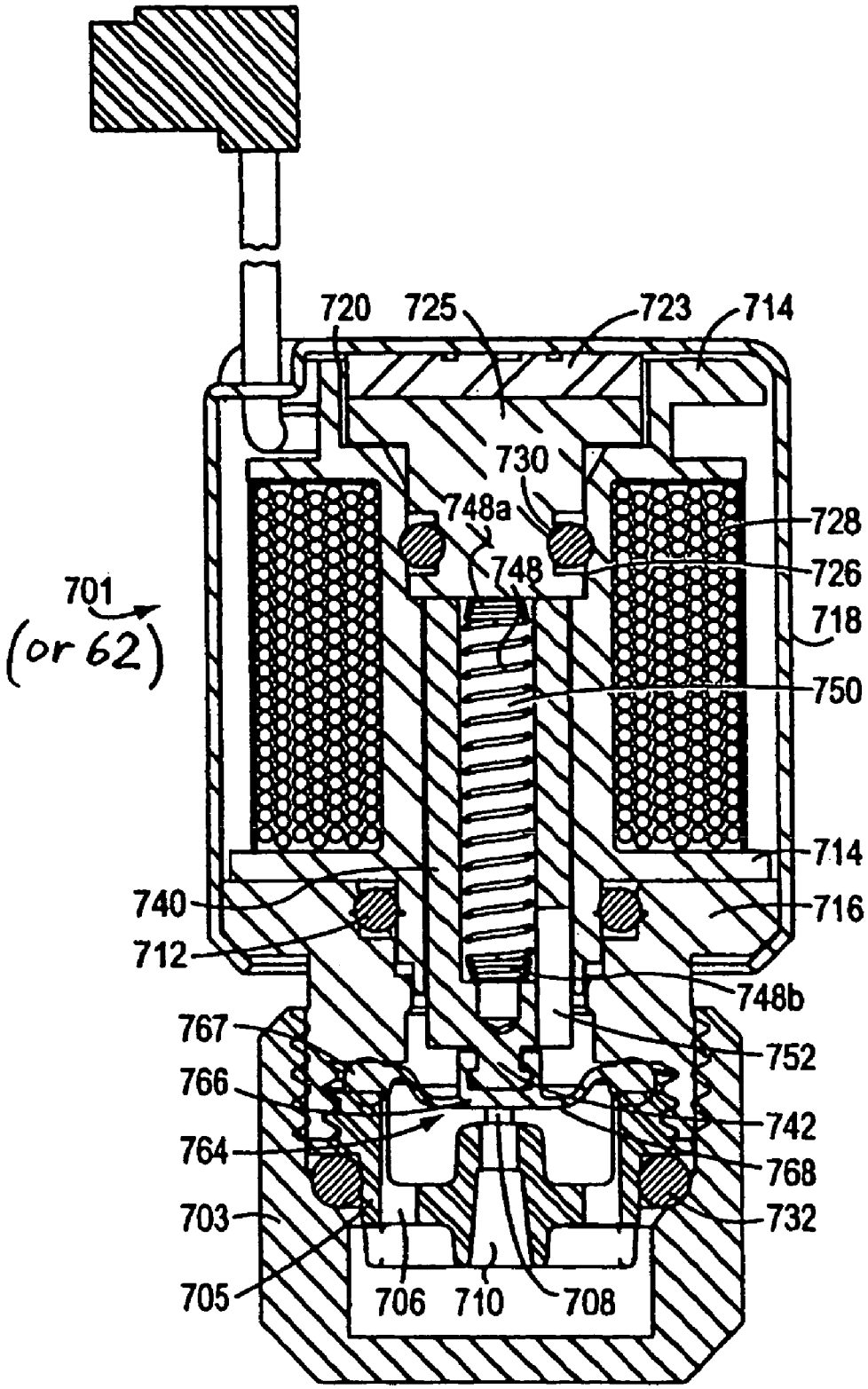
FIG. 7 is a cross-sectional view of a first embodiment of an electromechanical actuator for controlling any one of the above valves.
Figure 7A:
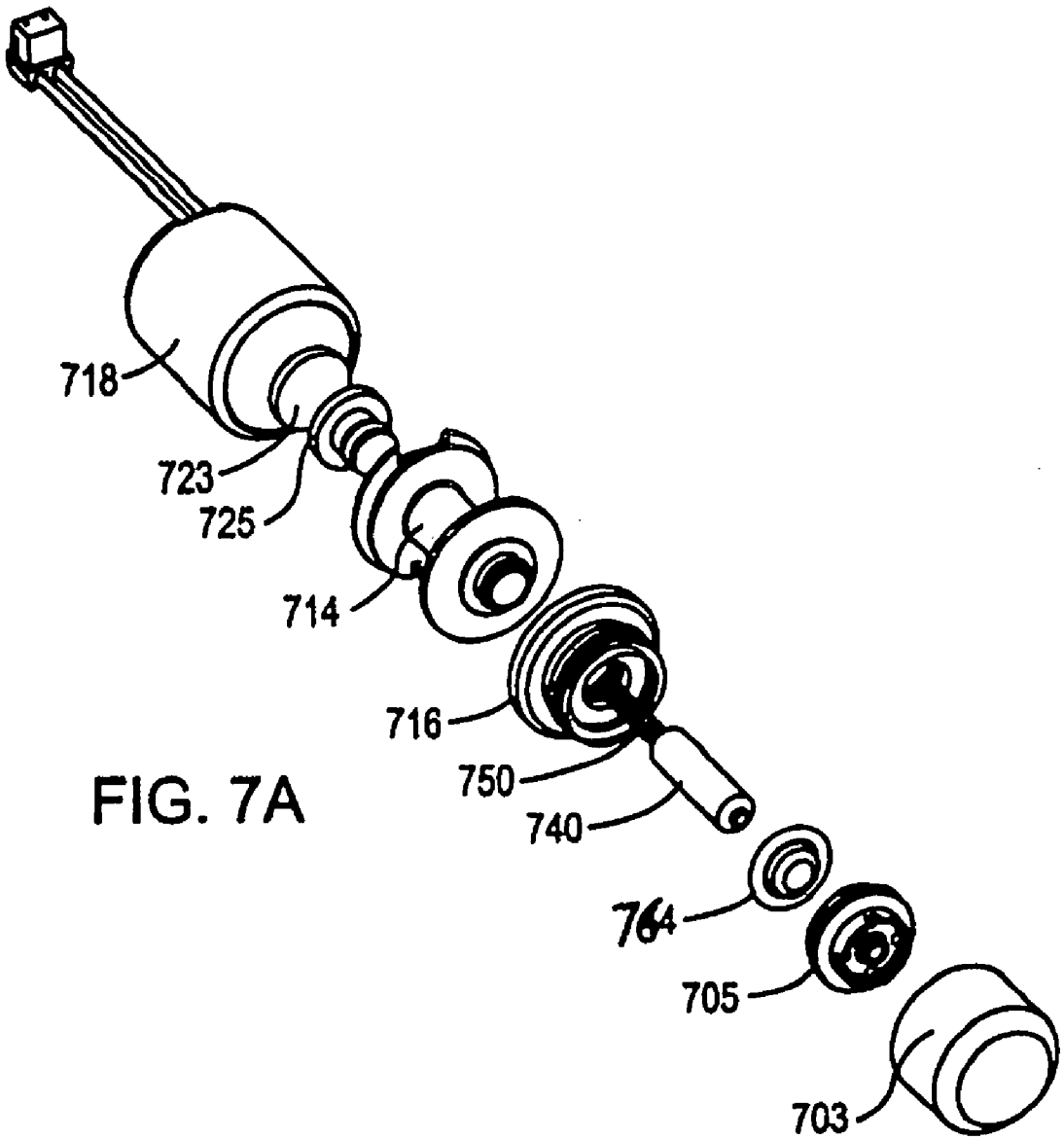
FIG. 7A is a perspective exploded view of the electromechanical actuator shown in FIG. 7.

Solenoid actuator 62 includes a piloting button 705 described in detail in connection with FIGS. 7, 7B, and 7C. Referring also to FIG. 7, piloting button 705 indudes fluid inlet 706 in communication with passage 226, and includes a fluid outlet 710 in communication with passage 228. In the closed state, pilot chamber 220 is at the input line water pressure since the control passage 226 is sealed by the tip of actuator 63. The input line pressure provides a net downward force against the upward force of spring 202. The downward force created by the water pressure in pilot chamber 220 forces sealing surface 211 in contact with the main seat of valve body member 142. The flow rate provided by control surfaces 222 and 224 is larger than the flow rate provided by the control orifices 226 and 228.

To move piston 210 into the open state, solenoid actuator 67 retracts the piston tip to open passage 708 (shown in FIG. 7) and thereby provide communication from control passage 226 to control passage 228. Water flows form pilot chamber 220 via passages 226 and 226 to main output 16. This reduces the water pressure inside pilot chamber 220, which in turn reduces the downward force onto piston 210. Spring 202 lifts piston 210 from the main seat enabling water flow from main input 12 to main input 16.

Figure 3B:
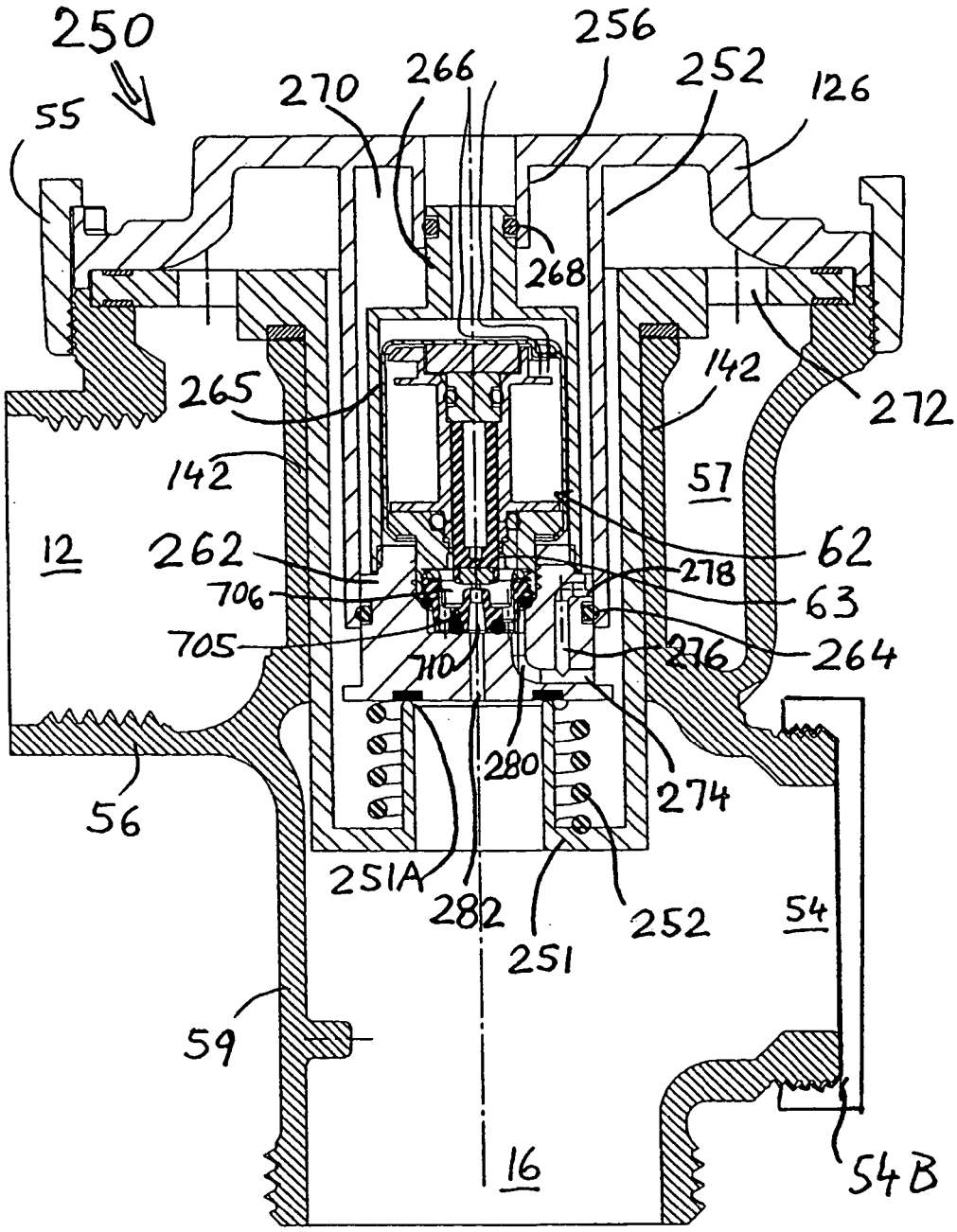
FIG. 3B is a cross-sectional view of yet another embodiment of the automatic flusher of FIG. 1 or FIG. 1A.

FIG. 3B illustrates another embodiment of a bathroom flush valve. Bathroom flush valve 250 is also designed as a retrofit assembly for installation in the housing of a standard manually operated bathroom flusher, for example, made by Sloan Valve Company. The retrofit assembly includes valve 250 comprising a spring 252 in contact with a movable piston 260 and valve inserts 251 and 252 attached to enclosure 126 and body 142 respectively. Piston 260 includes a sealing member 261, piston walls 262 and an actuator enclosure 265. Actuator enclosure 265 houses solenoid actuator 62 and includes a guiding member 266. Piston 260 moves up and down within the cavity formed by insert member 252. An O-ring 264 seals the piston walls 262 with respect to insert member 252 and an O-ring 268 seals a guiding member 256 with respect to the guiding member 266 of actuator enclosure 265. Actuator enclosure 265, piston walls 262 and guiding member 252 form a pilot chamber 270 in communication with input chamber 57 via flow passages 272, 274, 276, and 278. Actuator 62 is constructed and arranged to relieve water pressure from pilot chamber 270 via passages 280 and 282 in communication with main output 16.

As described above, solenoid actuator 62 includes a piloting button 705 described in detail in connection with FIGS. 7, 7B, and 7C. Referring also to FIG. 7, piloting button 705 includes fluid inlet 706 in communication with a passage 280, and includes fluid outlet 710 in communication with a passage 282. In the closed state, pilot chamber 270 is at the input line water pressure since the control passage 280 is sealed by the tip of actuator 63. As described above, the input line pressure provides a net downward force against the upward force of spring 252. The downward force created by the water pressure in pilot chamber 270 forces sealing surface 261 in contact with the main seat 251A. The flow rate provided by control passages 274, 276 and 278 is larger than the flow rate provided by the control orifices 280 and 282.

To move piston 210 into the open state, solenoid actuator 67 retracts the piston tip to open passage 708 (shown in FIG. 7) and thereby provide communication from control passage 280 to control passage 282. Water flows form pilot chamber 270 via passages 280 and 282 to main output 16. This reduces the water pressure inside pilot chamber 270, which in turn reduces the downward force onto piston 260. Spring 252 lifts piston 260 from the main seat 251A enabling water flow from main input 12 to main input 16.

Flush valves 200 and 250 can be designed to provide a constant water flow rate over a range of line pressures. For smaller line pressures, piston 210 (or 260) moves a little higher due to the smaller pressure in pilot chamber 220 (or pilot chamber 270) providing a force acting against the force of spring 202 (or spring 252). Thus, there is a larger flow passage at the main valve seat 209 (or seat 251A). The opening and closing of valve 200 (or valve 250) is adjusted by the force constant of spring 202 (or spring 252) and by the size of the individual control passages 222, 224, 226, 228 and the passages within piloting button 705.

FIGS. 4 and 4A illustrate in detail a third embodiment of automatic flusher 10. Referring to FIG. 4, automatic flusher 300 is a high performance, electronically controlled or manually controlled tankless flush system. The system includes a flush valve 300, an object sensor 30 and the corresponding electronics shown in FIG. 8. Water enters thru input union 12, preferably made of a suitable plastic resin. Union 12 is attached via thread to input fitting 12A that interacts with the building water supply system. Furthermore, union 12 is designed to rotate on its own axis when no water is present so as to facilitate alignment with the inlet supply line.

Referring still to FIG. 4, union 12 is attached to an inlet pipe 302 by a fastener 304 and a radial seal 306, which enables union 12 to move in or out along inlet pipe 302. This movement aligns the inlet to the supply line. However, with fastener 304 secured, there is a water pressure applied by the junction of union 12 to inlet 304. This forms a unit that is rigid sealed through seal 306. The water supply travels through union 12 to inlet 302 and thru the inlet valve assembly 310 an inlet screen filter 320, which resides in a passage formed by member 322 and is in communication with a main valve seat 525. The operation of the entire main valve is described in connection with FIGS. 6, 6A and 6B.

Figure 6:
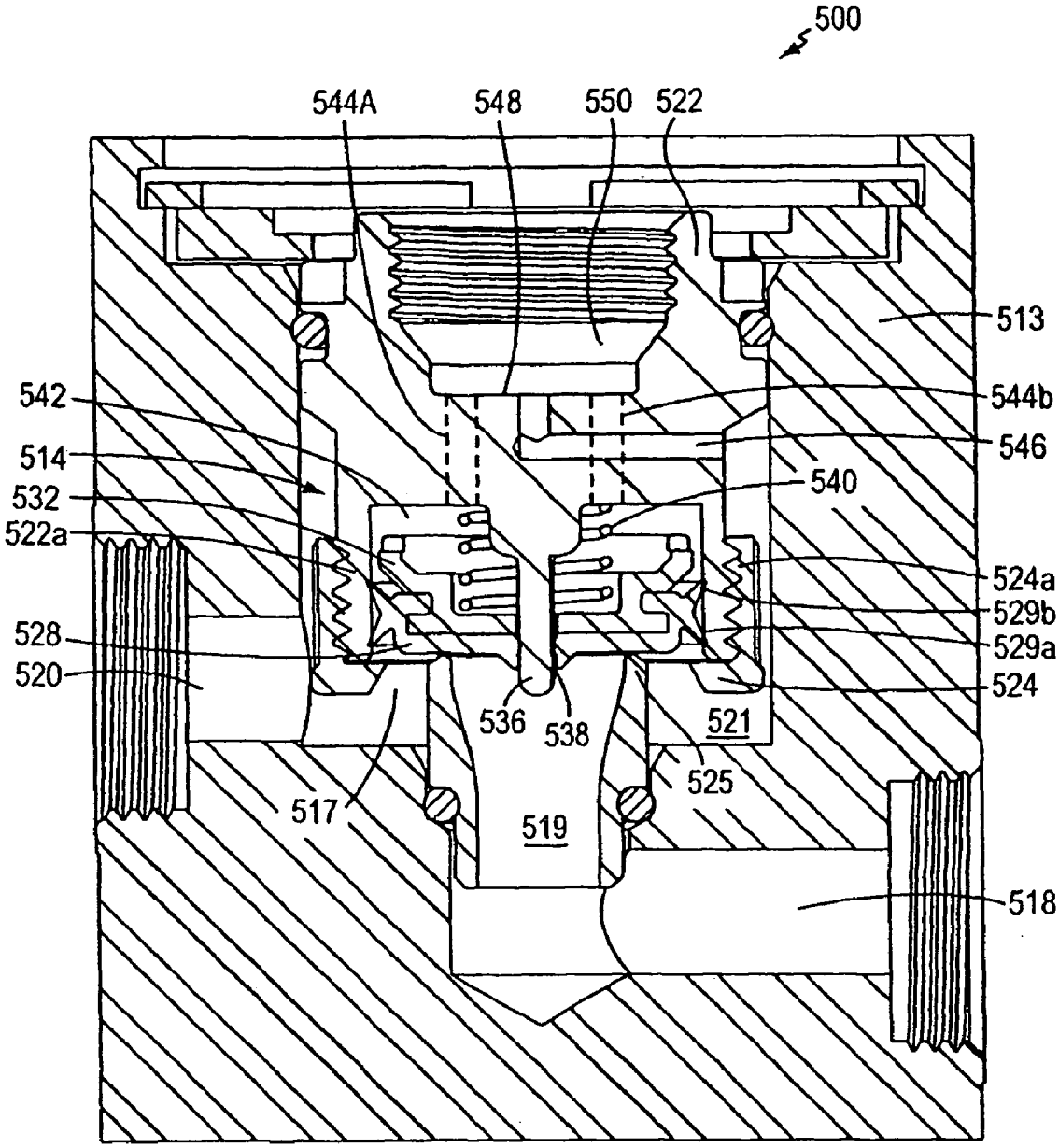
FIG. 6 is an enlarged sectional view of a valve for controlling fluid flow in the devices shown in FIGS. 4 and 4A.
Figure 6A:
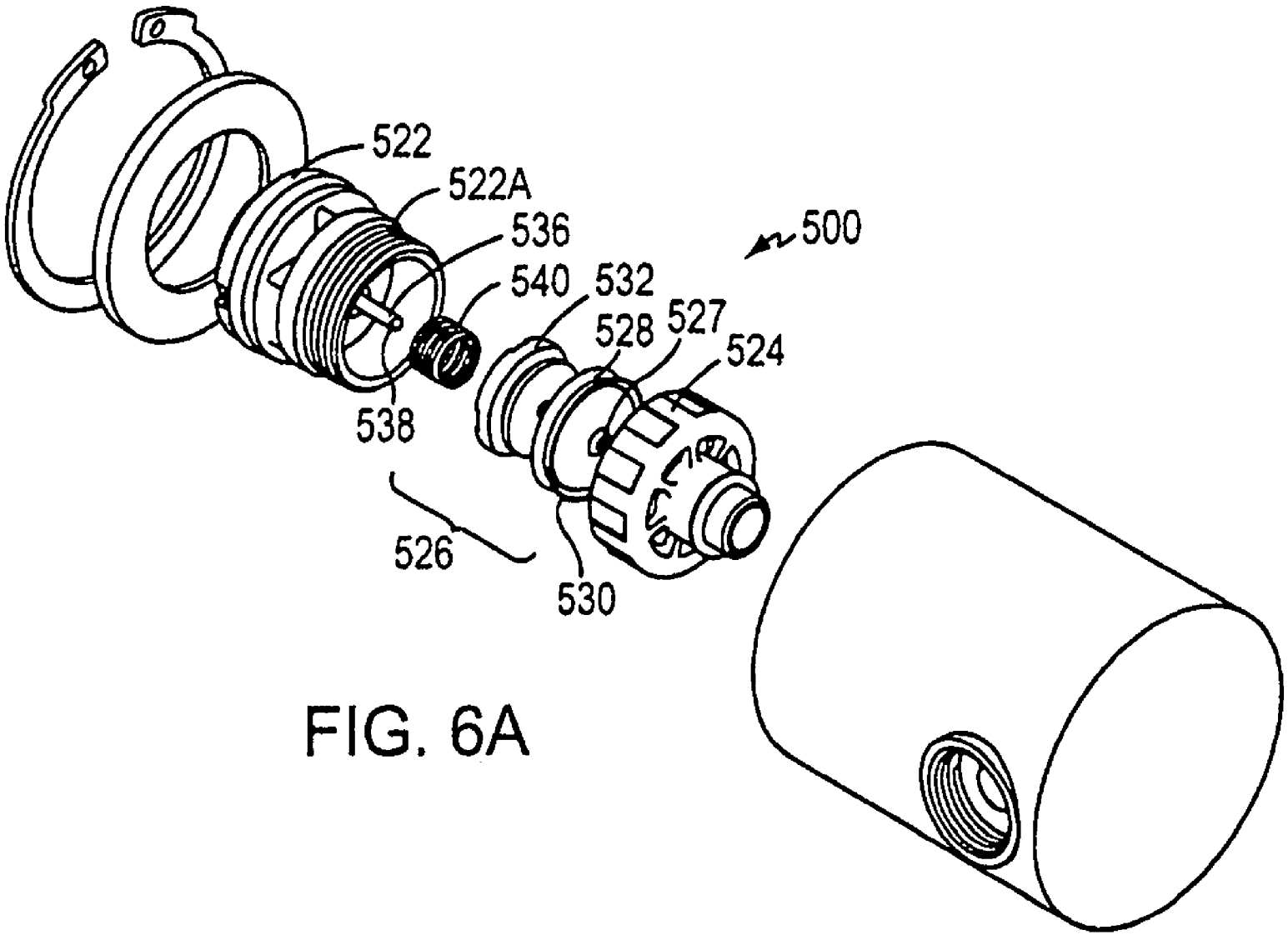
FIG. 6A is a perspective exploded view of the valve shown in FIG. 6.
Figure 6B:
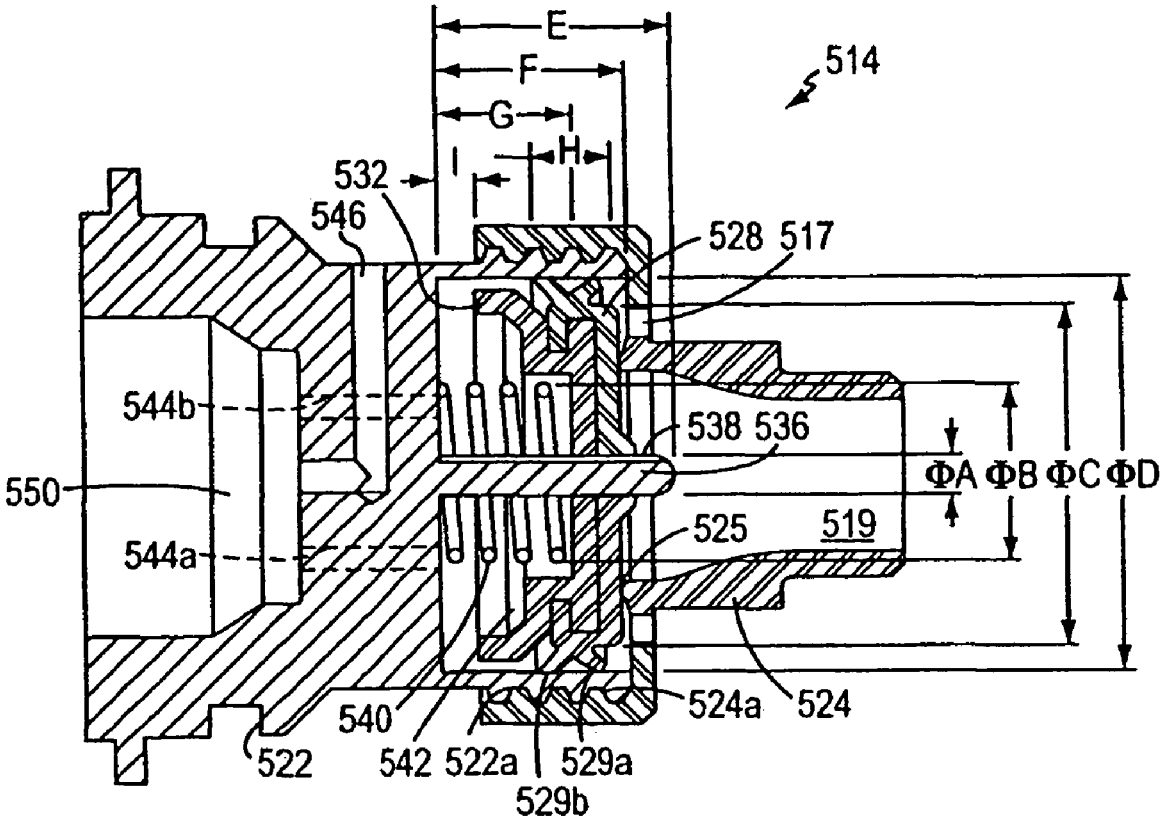
FIG. 6B is an enlarged sectional view of another embodiment of the valve shown in FIG. 6.

As described connection with FIGS. 6, 6A and 6B, an electromagnetic actuator 62 controls operation of the main valve 500. In the opened state, water flows thru passage 528 and thru passages 528A and 528B into main outlet 16. In the closed state, the fram element 528 seals the valve main seat 525 thereby closing flow through passage 528.

Automatic flusher 300 includes an adjustable input valve 310 controlled by rotation of a valve element 325 threaded together with valve elements 514 and 540. Valve elements 514 and 540 are sealed from body 325 via o-ring seals 327 and 329. Furthermore, valve elements 514 and 540 are held down by threaded element 330, when element 330 is threaded all the way. This force is transferred to element 324. The resulting force presses down element 322 on valve element 311 therefore creating a flow path from inlet passage of body 322. When valve element 330 is unthreaded all the way, valve assembly 514 and 540 moves up due to the force of spring 318 located in adjustable input valve 310. The spring force combined with inlet fluid pressure from pipe 302 forces element 311 against seat 313 resulting in a sealing action using O-ring 312. O-Ring 312 (or another sealing element) blocks the flow of water to inner passage of 322, which in turn enables servicing of all internal valve element including elements behind shut-off valve 310 without the need to shut off the water supply at the inlet 12. This is a major advantage of this embodiment.

According to another function of adjustable valve 310, the threaded retainer is fastened part way resulting in valve body elements 514 and 322 to push down valve seat 311 only partly. There is a partial opening that provides a flow restriction reducing the flow of input water thru valve 310. This novel function is designed to meet application specific requirements. In order to provide for the installer the flow restriction, the inner surface of valve body 54 includes application specific marks such as 1.6 W. C 1.0 GPF urinals etc. for calibrating the input water flow.

FIG. 4A illustrates a novel flusher 350, which operates similarly as flusher 300, but uses a novel input valve 360 (instead of input valve 310). Input valve 360 includes a conical valve member 362 co-operatively arranged with a conical surface 366 of a valve member 370. As described in connection with. FIG. 4, spring 318 forces valve member 362 upwards. By tightening or unscrewing threaded element 330, valve member 362 moves up or down, thereby reducing or increasing the corresponding flow opening. An o-ring 360 provides seals valve member 362 with respect to valve member 370.

Automatic flusher 300 includes a sensor-based electronic flush system located in housing 20. Furthermore, the sensor-based electronic flush system may be replaced by an all mechanical activation button or lever. Alternatively, the flush valve may be controlled by a hydraulically timed mechanical actuator that acts upon a hydraulic delay arrangement, as described in PCT Application PCT/US01/43273. The hydraulic system can be adjusted to a delay period corresponding to the needed flush volume for a given fixture such a 1.6 GPF W. C etc. The hydraulic delay mechanism can open the outlet orifice of the pilot section instead of electromagnetic actuator 62 (shown in FIG. 4) for duration equal to the installer preset value.

Alternatively, control circuitry 30 can be modified so that the sensory elements housed in housing 20 are replaced with a timing control circuit. Upon activation of the flusher by an electro-mechanical switch (or a capacitance switch), the control circuitry initiates a flush cycle by activating electromagnetic actuator 62 for duration equal to the preset level. This level can be set at the factory or by the installer in the field. This arrangement can be combined with the static pressure measurement scheme described below for compensating the pressure influence upon the desired volume per each flush as described in connection with FIGS. 8B, 8C and 9.

The embodiments of FIGS. 4 and 4A have several advantages. The hydraulic or the electromechanical control system can be serviced without the need to shut off the water supply to the unit. Furthermore, the valve mechanism enables controlling the quantity of water passed thru flusher 300. The main flush valve includes the design shown in detail in connection with FIGS. 5. 5A, and 5B. This flush valve arrangement provides for a high flow rate (for its valve size) when compared to conventional diaphragm type flush valves.

The embodiments of FIGS. 4 and 4A provide fluid control valves in combination with a low power bi-stable electro magnetic actuator (described in connection with FIGS. 7–7C) that combined with the described control circuitry can precisely control the delivered water volume per each flush. As described below, the system for measuring fluid static pressure and in turn altering the main valve open time can dynamically control the delivered volume of flush water. That is, this system can deliver a selected water volume regardless of the pressure variation in the water supply line. The system can also enable actuation of the main flush valve using a direct mechanical lever or a mechanical level actuating upon a hydraulic delay arrangement that in turn acts upon the main valve pilot arrangement. The individual functions are described in detail below.

FIG. 5 illustrates another embodiment of automatic flusher 10. Bathroom Flusher 400 uses the second embodiment of the optical sensor and a novel high flow-rate valve 600 utilizing a fram assembly described in detail in connection with FIG. 6C below. High flow-rate valve 600 receives water input from supply line 12, which is in communication with a pliable member 628 supported by a support member 632 of a fram member. Grooves 638 and 638A provide water passages to a pilot chamber 642. Based on a signal from the controller, the actuator relieves pressure in pilot chamber 642 and thus initiate opening of valve 600. Then water flows from input line 12 by a valve seat 625 to output chamber 16. A detailed description of operation is provided below.

The flusher an actuator assembly described in U.S. Pat. Nos. 6,293,516 or 6,305,662 both of which are incorporated by reference. Alternatively, the flusher uses isolated actuator assembly shown in FIGS. 7–7C or described in detail in PCT Application PCT/US01/51098, filed on Oct. 25, 2001, which is incorporated by reference as if fully reproduced herein. The isolated actuator assembly is also in this application called the sealed version of the solenoid operator.

FIG. 6 illustrates a preferred embodiment of a valve 500 used in the above embodiments. Valve device 500 includes a valve body 513 providing a cavity for a valve assembly 514, an input port 518, and an output port 520. Valve assembly 514 includes a proximal body 522, a distal body 524, and a fram member 526 (FIG. 6A). Fram member 526 includes a pliable member 528 and a support member 532. Pliable member 528 may be a diaphragm-like member with a sliding seal 530. Support member 532 may be plunger-like member or a piston like member, but having a different structural and functional properties that a conventional plunger or piston. Valve assembly 514 also includes a guiding member such as a guide pin 536 or sliding surfaces, and includes a spring 540.

Proximal body 522 includes threaded surface 522A cooperatively sized with threaded surface 524A of distal body 524. Fram member 526 (and thus pliable member 528 and a plunger-like member 532) includes an opening 527 constructed and arranged to accommodate guiding pin 536. Fram member 526 defines a pilot chamber 542 arranged in fluid communication with actuator cavity 550 via control passages 544A and 544B. Actuator cavity 550 is in fluid communication with output port 520 via a control passage 546. Guide pin 536 includes a V-shaped or U-shaped groove 538 shaped and arranged together with fram opening 527 (FIG. 5A) to provide a pressure communication passage between input chamber 519 and pilot chamber 550.

Referring still to FIG. 6, distal body 524 includes an annular lip seal 525 arranged, together with pliable member 528, to provide a seal between input port chamber 529 and output port chamber 521. Distal body 524 also includes one or several flow channels 517 providing communication (in open state) between input chamber 519 and output chamber 521. Pliable member 528 also includes sealing members 529A and 529B arranged to provide a sliding seal, with respect to valve body 522, between pilot chamber 42 and output chamber 521. There are various possible embodiments of seals 529A and 529B (FIG. 6). This seal may be one-sided as seal 530 (shown in FIG. 5A) or two-sided seal

529*a* and 529*b* shown in FIG. 6. Furthermore, there are various additional embodiments of the sliding seal including O-ring etc.

The present invention envisions valve device 10 having various sizes. For example, the "full" size embodiment, shown in FIG. 2, has the pin diameter A=0.070", the spring diameter B=0.360", the pliable member diameter C=0.730", the overall fram and seal's diameter D=0.812", the pin length E=0.450", the body height F=0.380", the pilot chamber height G=0.280", the fram member size H=0.160", and the fram excursion I=0.100". The overall height of the valve is about 1.39" and diameter is about 1.178".

The "half size" embodiment (of the valve shown in FIG. 2) has the following dimensions provided with the same reference letters (each also including a subscript 1) shown in FIG. 2. In the "half size" valve $A_1$=0.070", $B_1$=0.30, $C_1$=0.560", $D_1$=0.650", $E_1$=0.38", $F_1$=0.310", $G_1$=0.215", $H_1$=0.125", and $I_1$=0.60". The overall length of the ½ embodiment is about 1.350" and the diameter is about 0.855". Similarly, the valve devices of FIG. 5B or 5C may have various larger or smaller sizes.

Referring to FIGS. 6 and 6B, valve 500 receives fluid at input port 518, which exerts pressure onto diaphragm-like members 528 providing a seal together with a lip member 525 in a closed state. Groove passage 538 provides pressure communication with pilot chamber 542, which is in communication with actuator cavity 550 via communication passages 544A and 544B. An actuator provides a seal at surface 548 thereby sealing passages 544A and 544B and thus pilot chamber 542. When the plunger of actuator 142 or 143 moves away from surface 548, fluid flows via passages 544A and 544B to control passage 546 and to output port 520. This causes pressure reduction in pilot chamber 542. Therefore, diaphragm-like member 528 and piston-like member 532 move linearly within cavity 542, thereby providing a relatively large fluid opening at lip seal 525. A large volume of fluid can flow from input port 518 to output port 520.

When the plunger of actuator 142 or 143 seals control passages 544A and 544B, pressure builds up in pilot chamber 542 due to the fluid flow from input port 518 through groove 538. The increased pressure in pilot chamber 542 together with the force of spring 540 displace linearly, in a sliding motion over guide pin 536, fram member 526 toward sealing lip 529. When there is sufficient pressure in pilot chamber 542, diaphragm-like pliable member 528 seals input port chamber 519 at lip seal 525. Preferably soft member 528 is designed to clean groove 538 of guide pin 536 during the sliding motion.

The embodiment of FIG. 6 shows valve 500 having input chamber 519 (and guide pin 536) symmetrically arranged with respect to passages 544A, 544B and 546 (and the location of the plunger of actuator 701. However, valve device 500 may have input chamber 519 (and guide pin 536) non-symmetrically arranged with respect to passages 544A, 544B (not shown) and passage 546. That is, this valve has input chamber 519 (and guide pin 536) non-symmetrically arranged with respect to the location of the plunger of actuator 142 or 143. The symmetrical and non-symmetrical embodiments are equivalent.

Figure 6C:
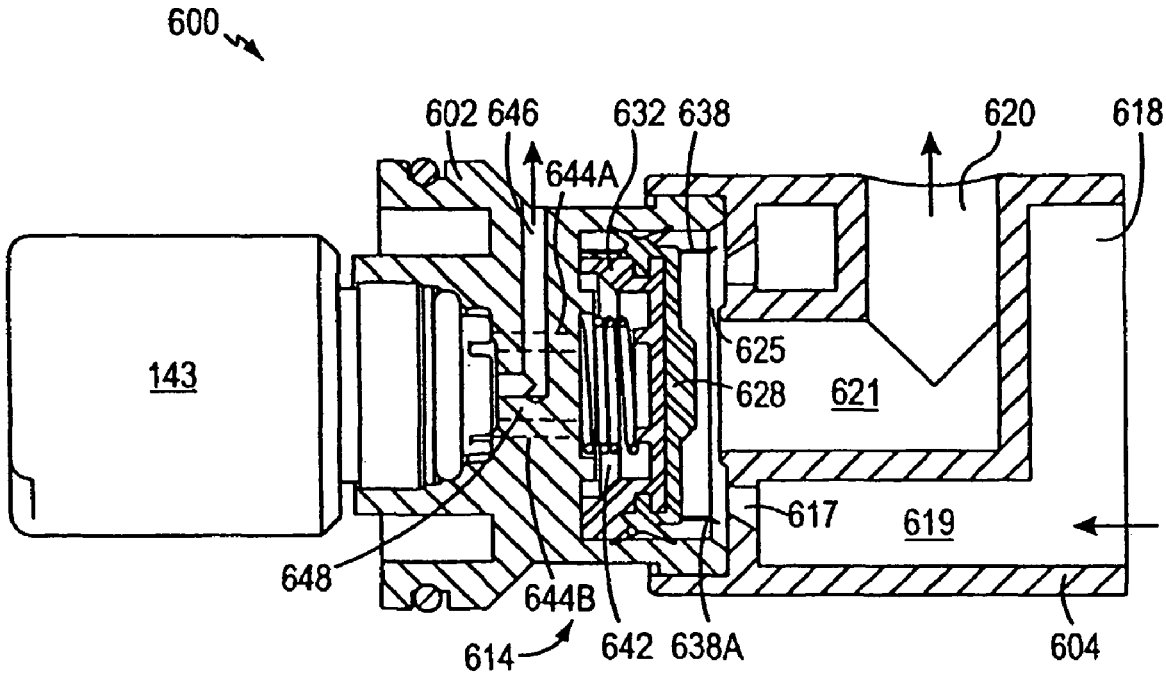
FIG. 6C is an enlarged sectional view of a valve for controlling fluid flow in the devices shown in FIG. 5.

Referring to FIG. 6C, valve device 600 includes a valve body 613 providing a cavity for a valve assembly 614, an input port 618, and an output port 620. Valve assembly 614 includes a proximal body 602, a distal body 604, and a fram member or assembly. The fram member includes a pliable member 628 and a support member 632. Pliable member 628 may be a diaphragm-like member with a sliding seal 630. Support member 632 may be plunger-like member or a piston like member, but having a different structural and functional properties that a conventional plunger or piston. Valve body 602 provides a guide surface 636 located on the inside wall that includes one or several grooves 638 and 638A. These are novel grooves constructed to provide fluid passages from input chamber located peripherally (unlike the central input chamber shown in FIGS. 6 and 6B).

The fram member defines a pilot chamber 642 arranged in fluid communication with actuator cavity 650 via control passages 644A and 644B. Actuator cavity 650 is in fluid communication with output chamber 621 via a control passage 646. Groove 638 (or grooves 638 and 638A) provides a communication passage between input chamber 619 and pilot chamber 642. Distal body 604 includes an annular lip seal 625 co-operatively arranged with pliable member 628 to provide a seal between input port chamber 619 and output port chamber 621. Distal body 604 also includes a flow channel 617 providing communication (in the open state) between input chamber 619 and output chamber 621 for a large amount of fluid flow. Pliable member 628 also includes sealing members 629A and 629B (or one sided sealing member depending on the pressure conditions) arranged to provide a sliding seal with respect to valve body 622, between pilot chamber 642 and input chamber 619. (Of course, groove 638 enables a controlled flow of fluid from input chamber 619 to pilot chamber 642, as described above.)

Figure 7B:
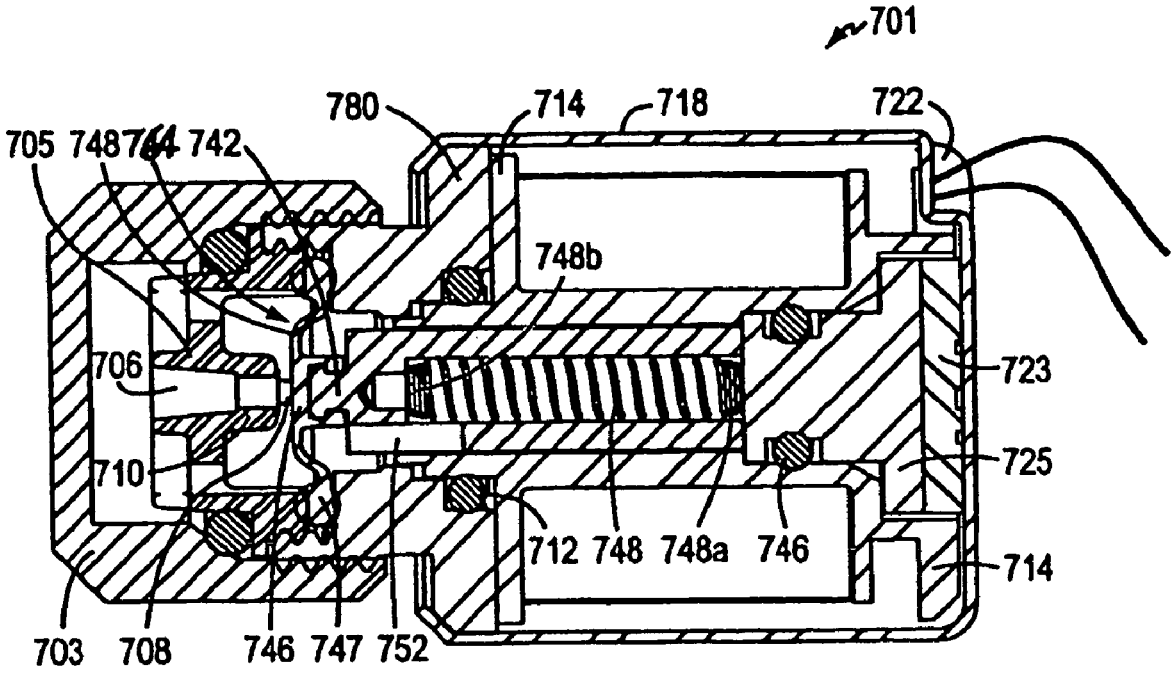
FIG. 7B is a cross-sectional view of a second embodiment of an electromechanical actuator for controlling any one of the above valves.
Figure 7C:
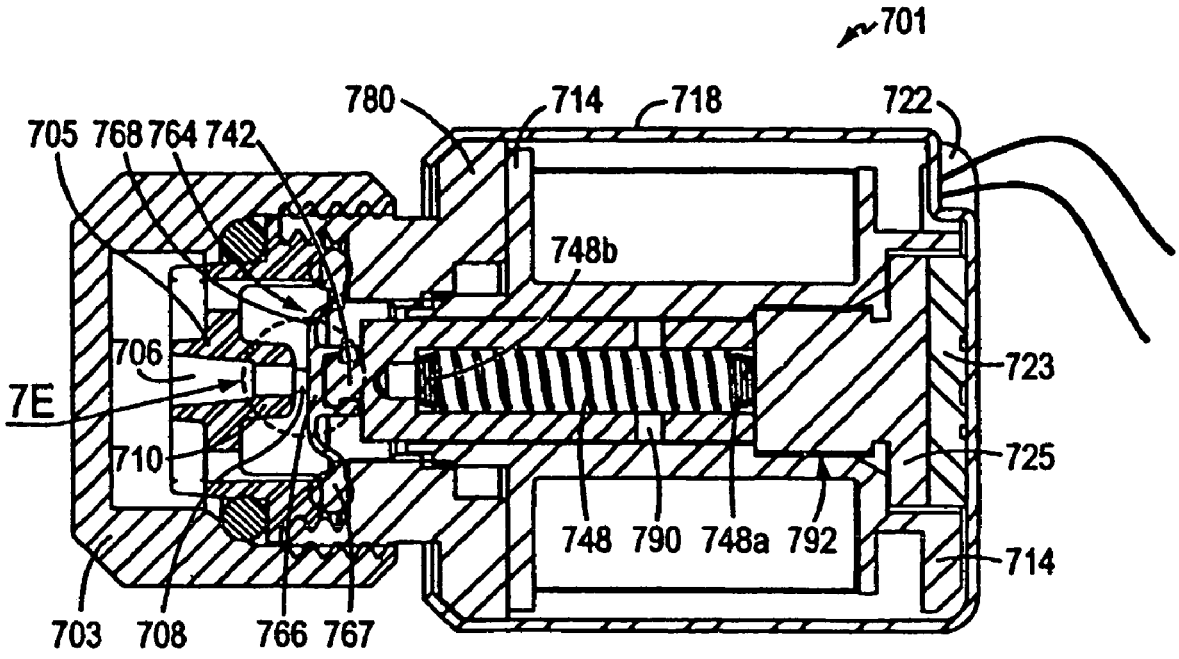
FIG. 7C is a cross-sectional view of a third embodiment of an electromechanical actuator for controlling any one of the above valves.

The automatic flushers shown in FIGS. 2 through 5 may utilize various embodiments of the isolated actuator, shown in FIGS. 7, 7B and 7C. Isolated actuator 701 includes an actuator base 716, a ferromagnetic pole piece 725, a ferromagnetic armature 740 slideably mounted in an armature pocket formed inside a bobbin 714. Ferromagnetic armature 740 includes a distal end 742 (i.e., plunger 742) and an armature cavity 750 having a coil spring 748. Coil spring 748 includes reduced ends 748*a* and 748*b* for machine handling. Ferromagnetic armature 740 may include one or several grooves or passages 752 providing communication from the distal end of armature 740 (outside of actuator base 716) to armature cavity 750 and to the proximal end of armature 740, at the pole piece 725, for easy movement of fluid during the displacement of the armature.

Isolated actuator body 701 also includes a solenoid windings 728 wound about solenoid bobbin 714 and magnet 723 located in a magnet recess 720. Isolated actuator body 701 also includes a resiliently deformable O-ring 712 that forms a seal between solenoid bobbin 714 and actuator base 716, and includes a resiliently deformable O-ring 730 that forms a seal between solenoid bobbin 714 and pole piece 725, all of which are held together by a solenoid housing 718. Solenoid housing 718 (i.e., can 718) is crimped at actuator base 16 to hold magnet 723 and pole piece 725 against bobbin 714 and thereby secure windings 728 and actuator base 716 together.

Isolated actuator 700 also includes a resilient membrane 744 that may have various embodiments shown and described in connection with FIGS. 7D and 7E. As shown in FIG. 7, resilient membrane 764 is mounted between actuator base 716 and a piloting button 705 to enclose armature fluid located a fluid-tight armature chamber in communication with an armature port 752. Resilient membrane 764 includes a distal end 766, 0-ring like portion 767 and a flexible portion 768. Distal end 766 comes in contact with the sealing surface in the region 708. Resilient membrane 764 is exposed to the pressure of regulated fluid provided via conduit 706 in piloting button 705 and may therefore be subject to considerable external force. Furthermore, resilient membrane 764 is constructed to have a relatively low permeability and high durability for thousands of openings and closings over many years of operation.

Referring to still to FIG. 7, isolated actuator 701 is provided, for storage and shipping purposes, with a cap 703 sealed with respect to the distal part of actuator base 716 and with respect to piloting button 705 using a resiliently deformable O-ring 732. Storage and shipping cap 703 includes usually water that counter-balances fluid contained by resilient membrane 764; this significantly limits or eliminates diffusion of fluid through resilient membrane 764.

Referring still to FIG. 7, actuator base 716 includes a wide base portion substantially located inside can 718 and a narrowed base extension threaded on its outer surface to receive cap 703. The inner surface of the base extension threadedly engages complementary threads provided on the outer surface of piloting button 705. Membrane 764 includes a thickened peripheral rim 767 located between the base extension 32's lower face and piloting button 705. This creates a fluid-tight seal so that the membrane protects the armature from exposure to external fluid flowing in the main valve.

For example, the armature liquid may be water mixed with a corrosion inhibitor, e.g., a 20% mixture of polypropylene glycol and potassium phosphate. Alternatively, the armature fluid may include silicon-based fluid, polypropylene polyethylene glycol or another fluid having a large molecule. The armature liquid may in general be any substantially non-compressible liquid having low viscosity and preferably non-corrosive properties with respect to the armature. Alternatively, the armature liquid may be Fomblin or other liquid having low vapor pressure (but preferably high molecular size to prevent diffusion).

If there is anticorrosive protection, the armature material can be a low-carbon steel, iron or any soft magnetic material; corrosion resistance is not as big a factor as it would otherwise be. Other embodiments may employ armature materials such as the 420 or 430 series stainless steels. It is only necessary that the armature consist essentially of a ferromagnetic material, i.e., a material that the solenoid and magnet can attract. Even so, it may include parts, such as, say, a flexible or other tip, that is not ferromagnetic.

Resilient membrane 764 encloses armature fluid located a fluid-tight armature chamber in communication with an armature port 752 or 790 formed by the armature body. Furthermore, resilient membrane 764 is exposed to the pressure of regulated fluid in main valve and may therefore be subject to considerable external force. However, armature 740 and spring 750 do not have to overcome this force, because the conduit's pressure is transmitted through membrane 764 to the incompressible armature fluid within the armature chamber. The force that results from the pressure within the chamber therefore approximately balances the force that the conduit pressure exerts.

Referring still to FIGS. 7, 7A, 7B and 7C, armature 740 is free to move with respect to fluid pressures within the chamber between the retracted and extended positions. Armature port 752 or 790 enables the force-balancing fluid displaced from the armature chamber's lower well through the spring cavity 750 to the part of the armature chamber from which the armature's upper end (i.e. distal end) has been withdrawn upon actuation. Although armature fluid can also flow around the armature's sides, arrangements in which rapid armature motion is required should have a relatively low-flow-resistance path such as the one that port 752 or 790 helps form. Similar considerations favor use of an armature-chamber liquid that has relatively low viscosity. Therefore, the isolated operator (i.e., actuator 700) requires for operation only low amounts of electrical energy and is thus uniquely suitable for battery operation.

In the latching embodiment shown in FIG. 7, armature 740 is held in the retracted position by magnet 723 in the absence of a solenoid current. To drive the armature to the extended position therefore requires armature current of such a direction and magnitude that the resultant magnetic force counteracts that of the magnet by enough to allow the spring force to prevail. When it does so, the spring force moves armature 740 to its extended position, in which it causes the membrane's exterior surface to seal against the valve seat (e.g., the seat of piloting button 705). In this position, the armature is spaced enough from the magnet that the spring force can keep the armature extended without the solenoid's help.

To return the armature to the illustrated, retracted position and thereby permit fluid flow, current is driven through the solenoid in the direction that causes the resultant magnetic field to reinforce that of the magnet. As was explained above, the force that the magnet 723 exerts on the armature in the retracted position is great enough to keep it there against the spring force. However, in the non-latching embodiment that doesn't include magnet 723, armature 740 remain in the retracted position only so long as the solenoid conducts enough current for the resultant magnetic force to exceed the spring force of spring 748.

Advantageously, diaphragm membrane 764 protects armature 740 and creates a cavity that is filled with a sufficiently non-corrosive liquid, which in turn enables actuator designers to make more favorable choices between materials with high corrosion resistance and high magnetic permeability. Furthermore, membrane 764 provides a barrier to metal ions and other debris that would tend to migrate into the cavity.

Diaphragm membrane 764 includes a sealing surface 766, which is related to the seat opening area, both of which can be increased or decreased. The sealing surface 766 and the seat surface of piloting button 705 can be optimized for a pressure range at which the valve actuator is designed to operate. Reducing the sealing surface 766 (and the corresponding tip of armature 740) reduces the plunger area involved in squeezing the membrane, and this in turn reduces the spring force required for a given upstream fluid-conduit pressure. On the other hand, making the plunger tip area too small tends to damage diaphragm membrane 764 during valve closing over time. Preferable range of tip-contact area to seat-opening area is between 1.4 and 12.3. The present actuator is suitable for variety of pressures of the controlled fluid including pressures about 150 psi. Without any substantial modification, the valve actuator may be used in the range of about 30 psi to 80 psi, or even water pressures of about 125 psi.

Referring still to FIGS. 7, 7A, 7B and 7C, piloting button 705 has an important novel function for achieving consistent long-term piloting of the diaphragm valve shown in FIG. 2B, or the fram valve shown in FIG. 3B. Solenoid actuator 701 together with piloting button 705 are installed together as one assembly into the electronic faucet; this minimizes the pilot-valve-stroke variability at the pilot seat in region 708 (FIGS. 7, 7B and 7C) with respect to the closing surface (shown in detail in FIG. 7E), which variability would otherwise afflict the piloting operation. This installation is faster and simpler than prior art installations.

The assembly of operator 701 and piloting button 705 is usually put together in a factory and is permanently connected thereby holding diaphragm membrane 764 and the pressure loaded armature fluid (at pressures comparable to the pressure of the controlled fluid). Piloting button 705 is coupled to the narrow end of actuator base 716 using complementary threads or a sliding mechanism, both of which assure reproducible fixed distance between distal end 766 of diaphragm 764 and the sealing surface of piloting button 705. The coupling of operator 701 and piloting button 705 can be made permanent (or rigid) using glue, a set screw or pin. Alternatively, one member my include an extending region that is used to crimp the two members together after screwing or sliding on piloting button 705.

It is possible to install solenoid actuator 701 without piloting button 705, but this process is somewhat more cumbersome. Without piloting button 705, the installation process requires first positioning the pilot-valve body with respect to the main valve and then securing to the actuator assembly onto the main valve as to hold the pilot-valve body in place. If proper care is not taken, there is some variability in the position of the pilot body due to various piece-part tolerances and possible deformation. This variability creates variability in the pilot-valve member's stroke. In a low-power pilot valve, even relatively small variations can affect timing or possibly sealing force adversely and even prevent the pilot valve from opening or closing at all. Thus, it is important to reduce this variability during installation, field maintenance, or replacement. On the other hand, when assembling solenoid actuator 701 with piloting button 705, this variability is eliminated or substantially reduced during the manufacturing process, and thus there is no need to take particular care during field maintenance or replacement.

Figure 7D:
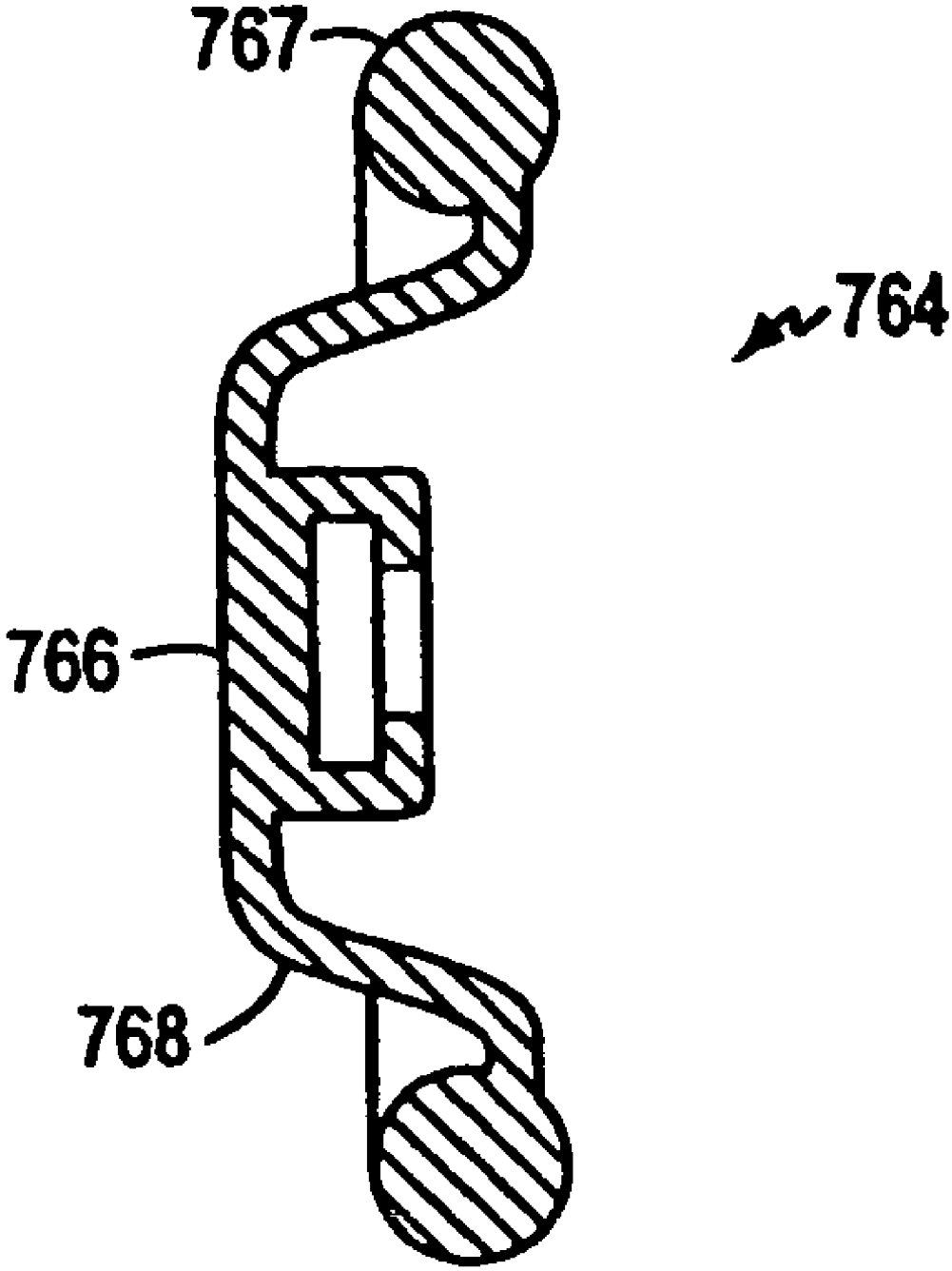
FIG. 7D is a cross-sectional view of another embodiment of a membrane used in the actuator shown in FIGS. 7 through 7C.
Figure 7E:
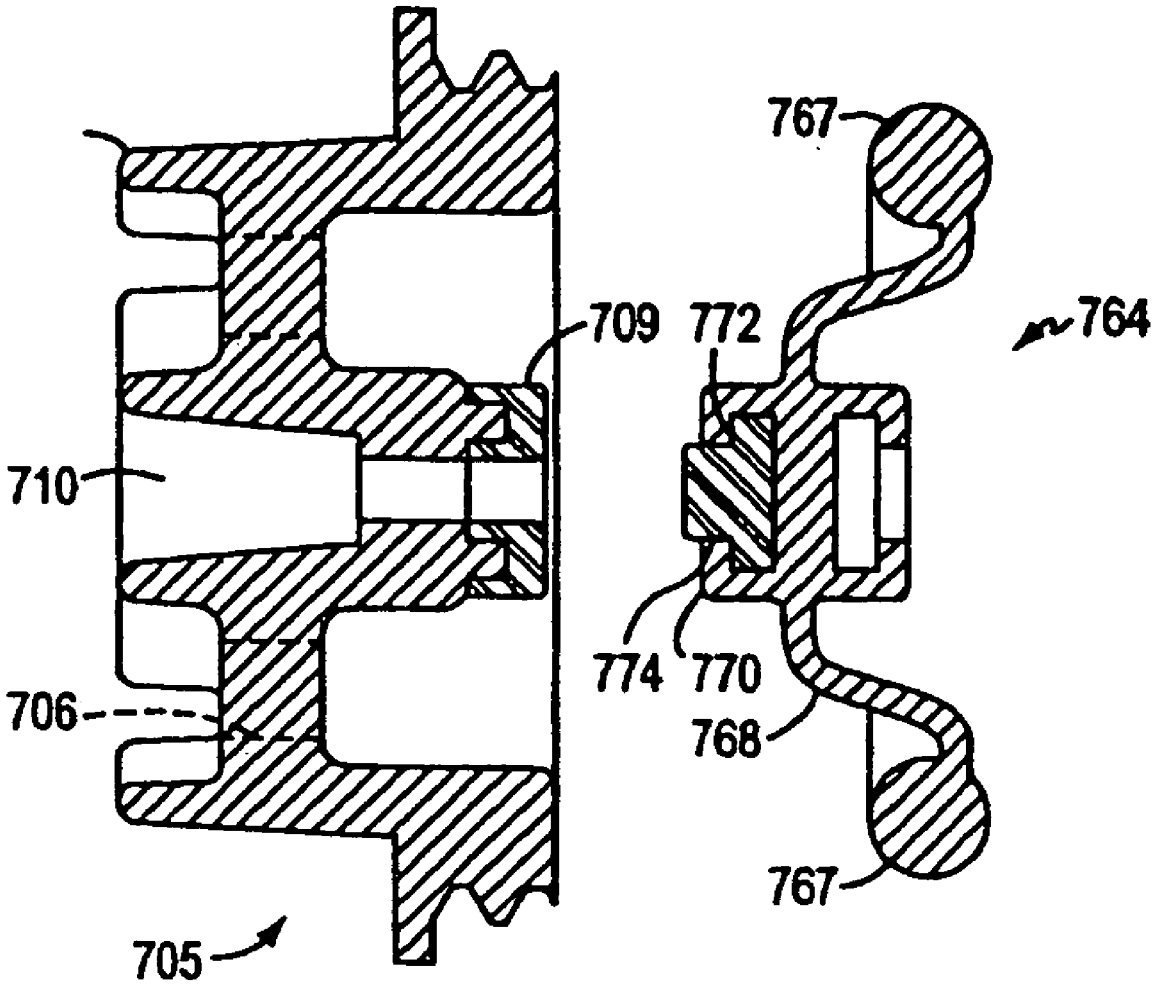
FIG. 7E is a cross-sectional view of another embodiment of the membrane and a piloting button used in the actuator shown in FIGS. 7 through 7C.

Referring to FIGS. 7D and 7E, as described above, diaphragm membrane 764 includes an outer ring 767, flex region 768 and tip or seat region 766. The distal tip of the plunger is enclosed inside a pocket flange behind the sealing region 766. Preferably, diaphragm membrane 764 is made of EPDM due to its low durometer and compression set by NSF part 61 and relatively low diffusion rates. The low diffusion rate is important to prevent the encapsulated armature fluid from leaking out during transportation or installation process. Alternatively, diaphragm member 764 can be made out of a flouro-elastomer, e.g., VITON, or a soft, low compression rubber, such as CRI-LINE® flouro-elastomer made by CRI-TECH SP-508. Alternatively, diaphragm member 764 can be made out of a Teflon-type elastomer, or just includes a Teflon coating. Alternatively, diaphragm member 764 can be made out NBR (natural rubber) having a hardness of 40–50 durometer as a means of reducing the influence of molding process variation yielding flow marks that can form micro leaks of the contained fluid into the surrounding environment. Alternatively, diaphragm member 764 includes a metallic coating that slows the diffusion thru the diaphragm member when the other is dry and exposed to air during storage or shipping of the assembled actuator.

Preferably, diaphragm member 764 has high elasticity and low compression (which is relatively difficult to achieve). Diaphragm member 764 may have some parts made of a low durometer material (i.e., parts 767 and 768) and other parts of high durometer material (front surface 766). The low compression of diaphragm member 764 is important to minimize changes in the armature stroke over a long period of operation. Thus, contact part 766 is made of high durometer material. The high elasticity is needed for easy flexing diaphragm member 764 in regions 768. Furthermore, diaphragm part 768 is relatively thin so that the diaphragm can deflect, and the plunger can move with very little force. This is important for long-term battery operation.

Referring to FIG. 7E, another embodiment of diaphragm membrane 764 can be made to include a forward slug cavity 772 (in addition to the rear plunger cavity shaped to accommodate the plunger tip). The forward slug cavity 772 is filled with a plastic or metal slug 774. The forward surface 770 including the surface of slug 774 is cooperatively arranged with the sealing surface of piloting button 705. Specifically, the sealing surface of piloting button 705 may include a pilot seat 709 made of a different material with properties designed with respect to slug 774. For example, high durometer pilot seat 709 can be made of a high durometer material. Therefore, during the sealing action, resilient and relatively hard slug 772 comes in contact with a relatively soft pilot seat 709. This novel arrangement of diaphragm membrane 764 and piloting button 705 provides for a long term, highly reproducible sealing action.

Diaphragm member 764 can be made by a two stage molding process where by the outer portion is molded of a softer material and the inner portion that is in contact with the pilot seat is molded of a harder elastomer or thermoplastic material using an over molding process. The forward facing insert 774 can be made of a hard injection molded plastic, such as acceptable co-polymer or a formed metal disc of a non-corrosive non-magnetic material such as 300 series stainless steel. In this arrangement, pilot seat 709 is further modified such that it contains geometry to retain pilot seat geometry made of a relatively high durometer elastomer such as EPDM 60 durometer. By employing this design that transfers the sealing surface compliant member onto the valve seat of piloting button 705 (rather than diaphragm member 764), several key benefits are derived. Specifically, diaphragm member 764 a very compliant material. There are substantial improvements in the process related concerns of maintaining proper pilot seat geometry having no flow marks (that is a common phenomena requiring careful process controls and continual quality control vigilance). This design enables the use of an elastomeric member with a hardness that is optimized for the application. The bobbin's body may be constructed to have a low permeability to the armature fluid. For example, bobbin 714 may includes metallic regions in contact with the armature fluid, and plastic regions that are not in contact with the armature fluid.

FIG. 8 is a simplified block diagram of control circuitry for controlling the object sensor shown in FIGS. 4, 4A and 5. A microcontroller-based control circuit 800 operates a drive 820, which controls the valve operator 62. Transmitter circuitry 806, including light-emitting diode 22, is also operated by the control circuit 800, and receiver circuitry 808 includes the photodiode 24. Although the circuitry of FIG. 8 or 8A can be implemented to run on house power, it is more typical for it to be battery-powered.

The microcontroller-based circuitry is ordinarily in a "sleep" mode, in which it draws only enough power to keep certain volatile memory refreshed and operate a timer 804. Timer 804 generates an output pulse every 250 msec., and the control circuit responds to each pulse by performing a short operating routine before returning to the sleep mode. The controller remains in its sleep mode until timer 804 generates a pulse. When the pulse occurs, the processor begins executing stored programming at a predetermined entry point. It proceeds to perform certain operations and setting the states of its various ports including detecting the state of a push button 818 (also shown in FIG. 5).

Push button 818 is mounted on the flusher housing 20 for ready accessibility by a user. Push button 818 includes a magnet whose proximity to the main circuit board 32 increases when the button is depressed. The circuit board includes a reed switch 817 that generates an signal delivered to control circuit 802. Push button 818 enables a user to operate the flusher manually.

Furthermore, packaging for the flusher can be so designed that, when it is closed, the package depresses the push button 818 and keeps it depressed so long as the packaging remains closed. Then, the controller does not apply power to the several circuits used for transmitting infrared radiation or driving current through the flush-valve operator. Alternatively, detector 24 may be used to detect "darkn" conditions (i.e., no ambient light present), which can be used to maintain control circuit 802 in the low power mode or the sleep mode to conserve power. In this mode; the microprocessor circuitry is not clocked, but some power is still applied to that circuitry in order to maintain certain minimal register state, including predetermined fixed values in several selected register bits. When batteries are first installed in the flusher unit, though, not all of those register bits will have the predetermined values. These values may be downloaded or self calibrated during the power-up mode.

The power-up mode deals with the fact that the proportion of sensor radiation reflected back to the sensor receiver in the absence of a user differs in different environments. The power-up mode's purpose is to enable an installer to tell the system what that proportion is in the environment is which the flusher has been installed. This enables the system thereafter to ignore background reflections. During the power-up mode, the object sensor operates without opening the valve in response to target detection. Instead, it operates a visible LED whenever it detects a target, and the installer adjusts, say, a potentiometer to set the transmitter's power to a level just below that at which, in the absence of a valid target, the visible LED's illumination nonetheless indicates that a target has been detected. This tells the system what level will be considered the maximum radiation level permissible for this installation.

Another subsystem that requires continuous power application in the illustrated embodiment is a low-battery detector 825. As was mentioned above, the control circuitry may receive an unregulated output from the power supply. If the power is low, then a visible-light-emitting diode or some other annunciator 810 is used to give a user an indication of the low-battery state (or in general any other state).

Referring again to FIG. 8, microcontroller-based control circuit 800 may control the object sensor shown in FIGS. 4, 4A and 5 using the following two algorithms:

I. The microcontroller is programmed to have the optical receiving circuit/element active, but the IR emitter is not activated, and the received light intensity is measured repeatedly or at a pre-set time period. Upon detection determination of that, the light intensity, which is lower than a pre-set threshold and equates to a dark surrounding (i.e. no sunlight nor artificial light sources, such as light bulbs). The system assumes that the facility is dark and therefore not in use, which in turn is acted upon in the following manner: The IR emitter is not powered, the optical receive system is powered up at its original frequency, or at a lower frequency, and the process is maintained until such a point in time that the system recognizes ambient light. When the system recognizes that the ambient light has risen above the pre-set level, the microcontroller reverts to its active mode, where IR emitter 22 is active and the sensing rate is set to the active model standards.

When the bathroom facility is dark, it is assumed that it is not in use and therefore not activating the IR emitter and reducing the sensing rate results in a reduction of the overall consumed electrical energy. This energy saving is significant in devices in the described battery powered circuit 800. Furthermore, the product can be shipped to the customer with the batteries installed, since if the unit enclosed by a cover or includes a label over the optical receiver or its encasement. This arrangement prevents the entry of visible light, and causes the unit reverting to its low energy consumption state, which in turn will minimize the consumed electrical energy to a level, which is presumed to have a minimal impact on battery life.

II. The hardware and firmware is similar to the embodiment described above, but the criteria of dark or light surrounding can be further refined. In this embodiment, the system is configured to measure in discrete, predetermined steps the received optical input and furthermore the standard modality or active opinion is such that the active IR element is upward the majority of time, whereby the unit is powered up senses the surrounding and determines in discrete steps whether the ambient light has changed if said change occurs in a step function as compared to a long, gradual process, which is attributed to changes in the ambient light conditions, i.e. sunset. The system assumes that when an object such as a person enters the optical field and in turn the emitter is powered up in order to verify the presence and provide a finer resolution as to the person's presence and thus the resultant decision process. This process further provides means of reducing the overall energy consumed. Importantly, in this modality the change in the perceived ambient light level change can increase or decrease when a person is detected due to such factors as the nature of his clothing and skin color as it relates to use in faucet with a forward facing field of view.

FIG. 8A is a simplified block diagram of control circuitry for controlling the object sensor shown in FIGS. 2, 2A, 2C and 2D. Control circuit 802 periodically acquires data from receiver circuitry 802 including optical data from PIN diode 24, which operates in the range of about 400 nm to 1000 nm, Based on the optical data from PIN diode 24, the controller determines whether an object, located in front of receiver lens 25, is stationary, moving toward the flusher, or moving away from the flusher (as described below). In this embodiment, the control circuitry does not use a light emitting diode 22 (or any other light source, used in the other embodiment of the optical sensor).

FIG. 8B schematically illustrates a fluid flow control system for a latching actuator 840 (i.e. solenoid actuator 62 or 701 described above). The flow control system includes again microcontroller 814, power switch 818, solenoid driver 820. As shown in FIG. 7, latching actuator 701 includes at least one drive coil 728 wound on a bobbin and an armature that preferably is made of a permanent magnet. Microcontroller 814 provides control signals 815A and 815B to current driver 820, which drives solenoid 728 for moving armature 740. Solenoid driver 820 receives DC power from battery 824 and voltage regulator 826 regulates the battery power to provide a substantially constant voltage to current driver 820. Coil sensors 843A and 843B pickup induced voltage signal due to movement of armature 740 and provide this signal to a conditioning feedback loop that includes preamplifiers 845A, 845B and flow-pass filters 847A, 847B. That is, coil sensors 843A and 843B are used to monitor the armature position.

Microcontroller 814 is again designed for efficient power operation. Between actuations, microcontroller 814 goes automatically into a low frequency sleep mode and all other electronic elements (e.g., input element or sensor 818, power driver 820, voltage regulator or voltage boost 826, signal conditioner 822) are powered down. Upon receiving an input signal from, for example, a motion sensor, microcontroller 814 turns on a power consumption controller 819. Power consumption controller 819 powers up signal conditioner 822.

Also referring to FIG. 7, to close the fluid passage 708, microcontroller 814 provides a "close" control signal 815A to solenoid driver 820, which applies a drive voltage to the coil terminals. Provided by microcontroller 814, the "close" control signal 815A initiates in solenoid driver 820 a drive voltage having a polarity that the resultant magnetic flux opposes the magnetic field provided by permanent magnet 723. This breaks the magnet 723's hold on armature 740 and allows the return spring 748 to displace valve member 740 toward valve seat 708. In the closed position, spring 748 keeps diaphragm member 764 pressed against the valve seat of piloting button 705. In the closed position, there is an increased distance between the distal end of armature 740 and pole piece 725. Therefore, magnet 723 provides a smaller magnetic force on the armature 740 than the force provided by return spring 748.

To open the fluid passage, microcontroller 814 provides an "open" control signal 815B (i.e., latch signal) to solenoid driver 820. The "open" control signal 815B initiates in solenoid driver 820 a drive voltage having a polarity that the resultant magnetic flux opposes the force provided by bias spring 748. The resultant magnetic flux reinforces the flux provided by permanent magnet 723 and overcomes the force of spring 748. Permanent magnet 723 provides a force that is great enough to hold armature 740 in the open position, against the force of return spring 748, without any required magnetic force generated by coil 728.

Microcontroller 814 discontinues current flow, by proper control signal 815A or 815B applied to solenoid driver 820, after armature 740 has reached the desired open or closed state. Pickup coils 843A and 843B (or any sensor, in general) monitor the movement (or position) of armature 740 and determine whether armature 740 has reached its endpoint. Based on the coil sensor data from pickup coils 843A and 843B (or the sensor), microcontroller 814 stops applying the coil drive, increases the coil drive, or reduces the coil drive.

To open the fluid passage, microcontroller 814 sends OPEN signal 815B to power driver 820, which provides a drive current to coil 842 in the direction that will retract armature 740. At the same time, coils 843A and 843B provide induced signal to the conditioning feedback loop, which includes a preamplifier and a low-pass filter. If the output of a differentiator 849 indicates less than a selected threshold calibrated for armature 740 reaching a selected position (e.g., half distance between the extended and retracted position, or fully retracted position, or another position), microcontroller 814 maintains OPEN signal 815B asserted. If no movement of armature 740 is detected, microcontroller 814 can apply a different level of OPEN signal 815B to increase the drive current (up to several time the normal drive current) provided by power driver 820. This way, the system can move armature 740, which is stuck due to mineral deposits or other problems.

Microcontroller 814 can detect armature displacement (or even monitor armature movement) using induced signals in coils 843A and 843B provided to the conditioning feedback loop. As the output from differentiator 849 changes in response to the displacement of armature 740, microcontroller 814 can apply a different level of OPEN signal 815B, or can turn off OPEN signal 815B, which in turn directs power driver 820 to apply a different level of drive current. The result usually is that the drive current has been reduced, or the duration of the drive current has been much shorter than the time required to open the fluid passage under worst-case conditions (that has to be used without using an armature sensor). Therefore, the system of FIG. 8 saves considerable energy and thus extends life of battery 824.

Advantageously, the arrangement of coil sensors 843A and 843B can detect latching and unlatching movement of armature 740 with great precision. (However, a single coil sensor, or multiple coil sensors, or capacitive sensors may also be used to detect movement of armature 740.) Microcontroller 814 can direct a selected profile of the drive current applied by power driver 820. Various profiles may be stored in microcontroller 814 and may be actuated based on the fluid type, fluid pressure, fluid temperature, the time actuator 840 has been in operation since installation or last maintenance, a battery level, input from an external sensor (e.g., a movement sensor or a presence sensor), or other factors.

Optionally, microcontroller 814 may include a communication interface for data transfer, for example, a serial port, a parallel port, a USB port, of a wireless communication interface (e.g., an RF interface). The communication interface is used for downloading data to microcontroller 814 (e.g., drive curve profiles, calibration data) or for reprogramming microcontroller 814 to control a different type of actuation or calculation.

Referring to FIG. 7, electromagnetic actuator 701 is connected in a reverse flow arrangement when the water input is provided via passage 706 of piloting button 705. Alternatively, electromagnetic actuator 701 is connected in a forward flow arrangement when the water input is provided via passage 710 of piloting button 705 and exits via passage 706. In the forward flow arrangement, the plunger "faces directly" the pressure of the controlled fluid delivered by passage 710. That is, the corresponding fluid force acts against spring 748. In both forward and reverse flow arrangements, the latch or unlatch times depend on the fluid pressure, but the actual latch time dependence is different. In the reverse flow arrangement, the latch time (i.e., time it takes to retract plunger 740) increases with the fluid pressure substantially linearly, as shown in FIG. 9C. On the other hand, in the forward flow arrangement, the latch time decreases with the fluid pressure. Based on this latch time dependence, microcontroller 814 can calculate the actual water pressure and thus control the water amount delivery.

FIG. 8C schematically illustrates a fluid flow control system for another embodiment of the latching actuator. The flow control system includes again microcontroller 814, power consumption controller 819, solenoid driver 820 receiving power from a battery 824 or voltage booster 826, and an indicator 828. Microcontroller 814 operates in both sleep mode and operation mode, as described above. Microcontroller 814 receives an input signal from an input element 818 (or any sensor) and provides control signals 815A and 815B to current driver 820, which drives the solenoid of a latching valve actuator 840A (701). Solenoid driver 820 receives DC power from battery 824 and voltage regulator 826 regulates the battery power. A power monitor 872 monitors power signal delivered to the drive coil of actuator 840A (701) and provides a power monitoring signal to microcontroller 814 in a feedback arrangement having operational amplifier 870. Microcontroller 814 and power consumption controller 19 are designed for efficient power operation, as described above.

Also referring to FIG. 8C, to close the fluid passage, microcontroller 14 provides a "close" control signal 815A to solenoid driver 820, which applies a drive voltage to the actuator terminals and thus drives current through coil 728. Power monitor 872 may be a resistor connected for applied drive current to flow through (or a portion of the drive current) Power monitor 872 may alternatively be a coil or another element. The output from power monitor 872 is provided to the differentiator of signal conditioner 870. The differentiator is used to determine a latch point along the curve 760, as shown in FIG. 9A or 9B.

Similarly as described in connection with FIG. 8B, to open the fluid passage, microcontroller 814 sends CLOSE signal 815A or OPEN signal 815B to valve driver 820, which provides a drive current to coil 728 in the direction that will extent or retract armature 740 (and close or open passage 708). At the same time, power monitor 872 provides a signal to opamp 870. Microcontroller 814 determines if armature 740 reached the desired state using the power monitor signal. For example, if the output of opamp 870 initially indicates no latch state for armature 740, microcontroller 814 maintains OPEN signal 815B, or applies a higher level of OPEN signal, as described above, to apply a higher drive current. On the other hand, if armature 740 reached the desired state (e.g., latch state), microcontroller 814 applies a lower level of OPEN signal 815B, or turns off OPEN signal 815B. This usually reduces the duration of drive current or the level of the drive current as compared to the time or current level required to open the fluid passage under worst-case conditions. Therefore, the system of FIG. 8C saves considerable energy and thus extends life of battery 824.

Figure 9:
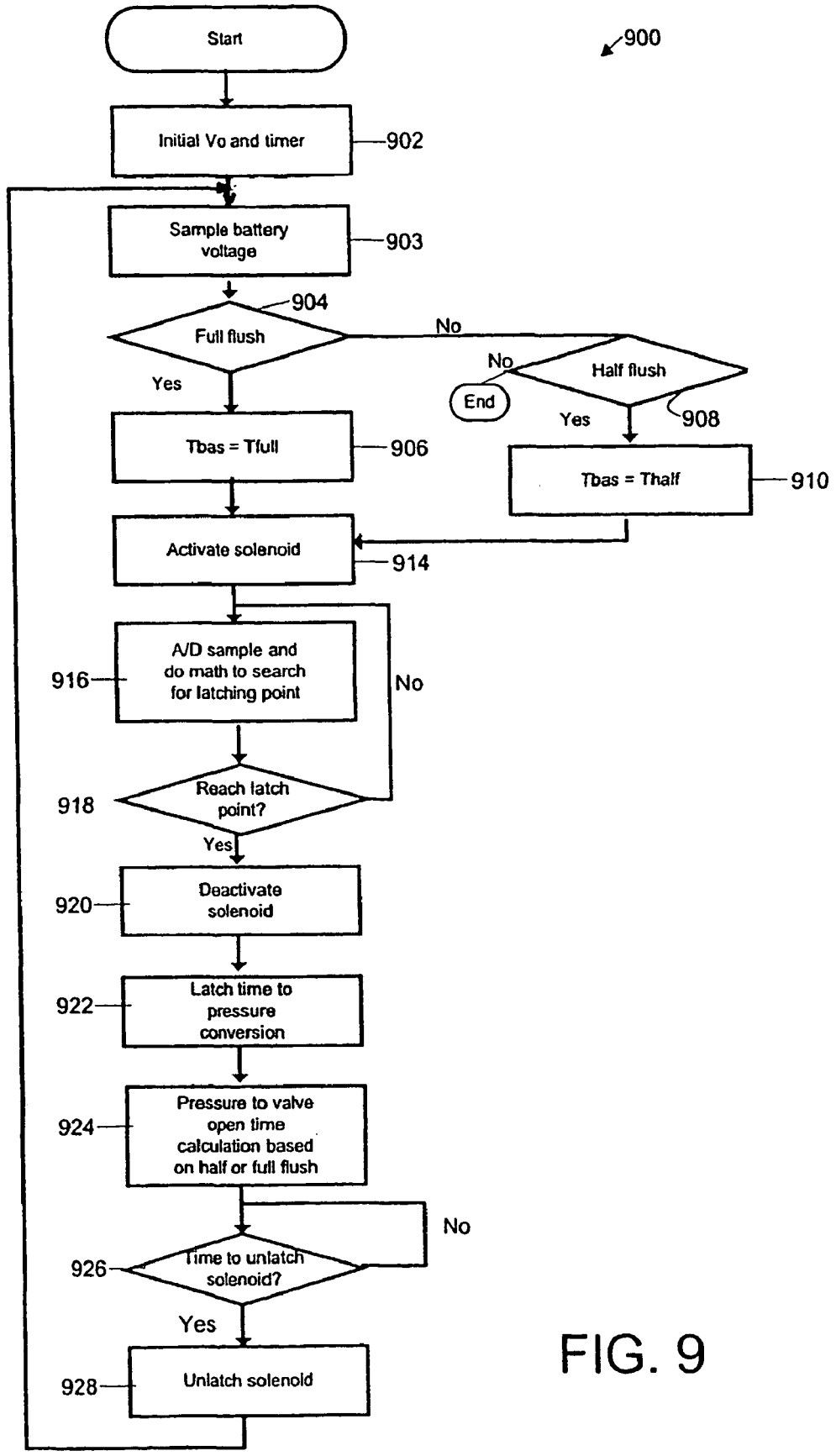
FIG. 9 is a flow diagram of an algorithm for controlling a flushing cycle used with a controller shown in FIG. 8C.
Figure 9A:
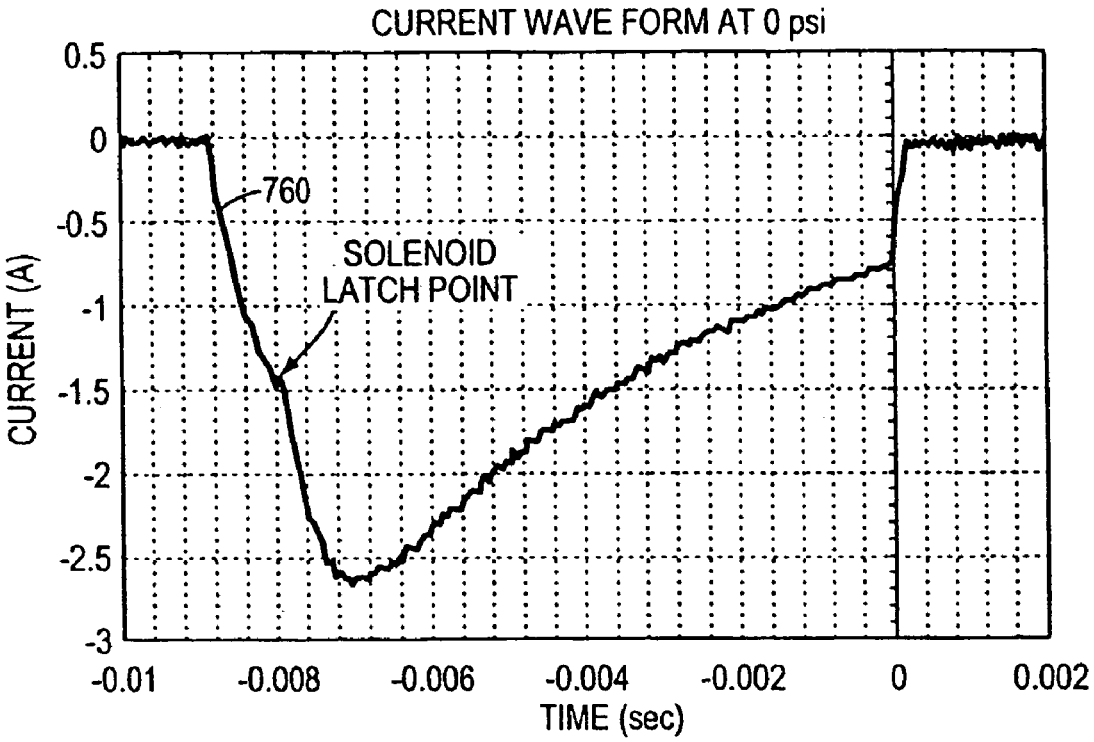
FIGS. 9A and 9B show the relationship of current and time for the valve actuator shown in FIG. 7, 7A, 7B or 7C connected to a water line at 0 psi and 120 psi reverse flow pressure, respectively.
Figure 9B:
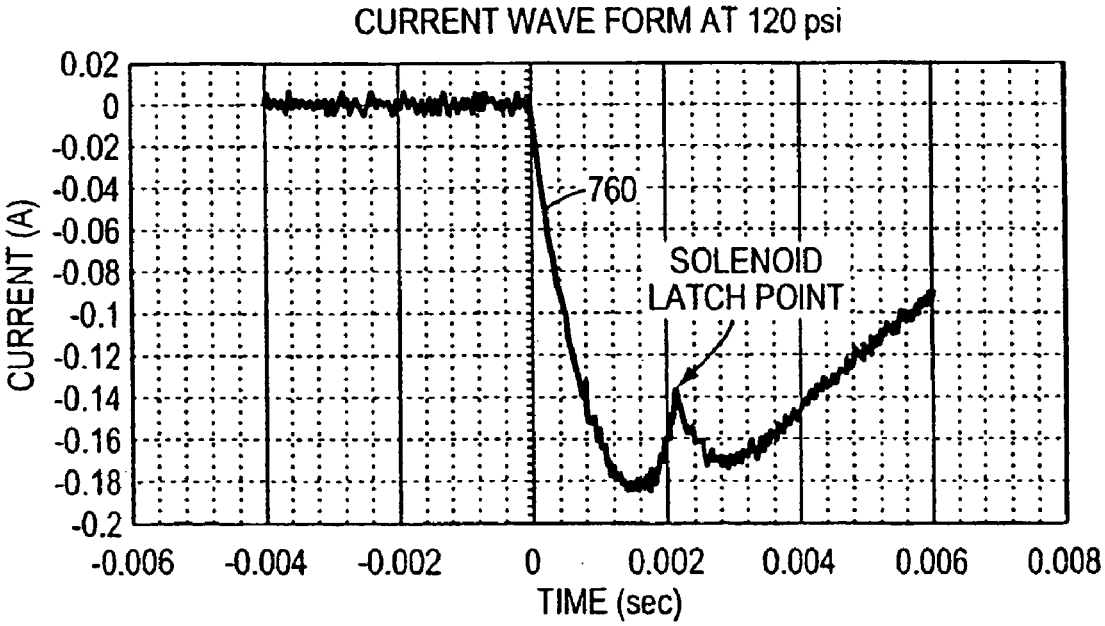
Figure 9C:
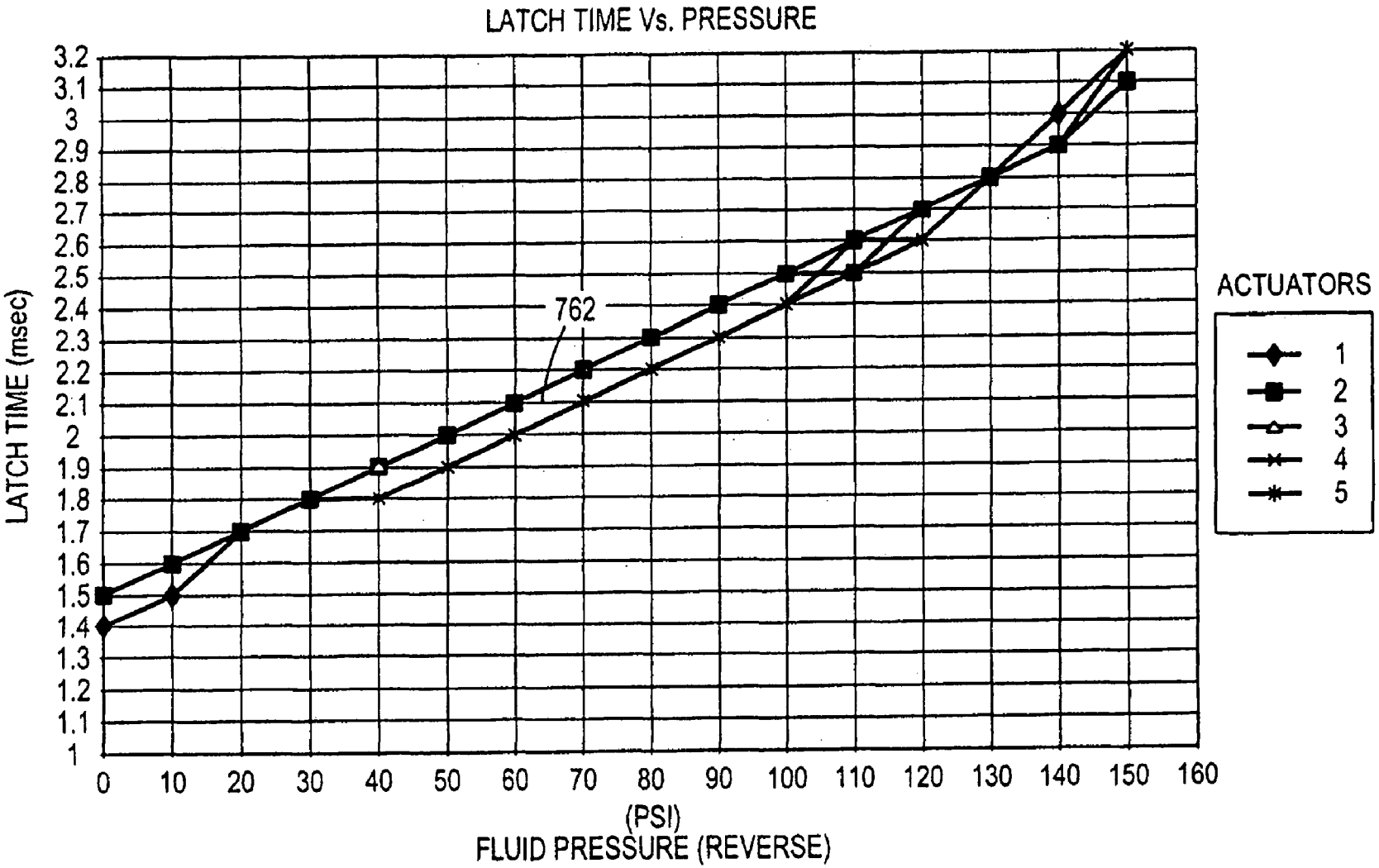
FIG. 9C illustrates a dependence of the latch time on the water pressure for the actuator shown in FIG. 7, 7A, 7B or 7C.

Referring to FIG. 9, flow diagram 900 illustrates the operation of microcontroller 814 during a flushing cycle. Microcontroller 814 is in a sleep mode, as described above. Upon an input signal from the input element or external sensor, microcontroller 814 is initialed and the timer is set to zero (step 902). In step 904, if the valve actuator performs a full flush, the time $T_{bas}$ equals $T_{full}$ (step 906). If there is no full flush, the timer is set in step 910 to $T_{bas}$ equals $T_{half}$. In step 912, microcontroller samples the battery voltage prior to activating the actuator in step 914. After the solenoid of the actuator is activated, microcontroller 814 searches for the latching point (see FIG. 9A or 9B). When the timer reaches the latching point (step 918), microcontroller 814 deactivates the solenoid (step 920). In step 922, based on the latch time, microcontroller 814 calculates the corresponding water pressure, using stored calibration data. Based on the water pressure and the known amount of water discharged by the tank flusher, the microcontroller decides on the unlatch time, (i.e., closing time) of the actuator (step 926). After the latching time is reached, microcontroller 14 provides the "close" signal to current driver 820 (step 928). After this point the entire cycle shown in flow diagram 900 is repeated.

FIGS. 10, 10A, 10B and 10C illustrate an algorithm for detecting an object such as pants (i.e. "pants" detection algorithm). Algorithm 1000 is designed for use with an optical sensor having light source 22 and light detector 24. The microcontroller directs the source driver to provide an adjustable IR emitter current intensity for light emitting diode 22 while maintaining a fixed amplifier gain for IR receiver 24.

In general, this algorithm detects user movement by using up to 32 different IR beam intensities scanned and reflected IR signals detected in succession. For example, the IR current needs to be higher when sensing target far away from the flusher. On the other hand, this algorithm can identify a user moving in or out by using a comparison of detected IR current changes. The IR emitter current is changed form high to low, which shows the detected target or user is moving toward the flusher.

Figure 10:
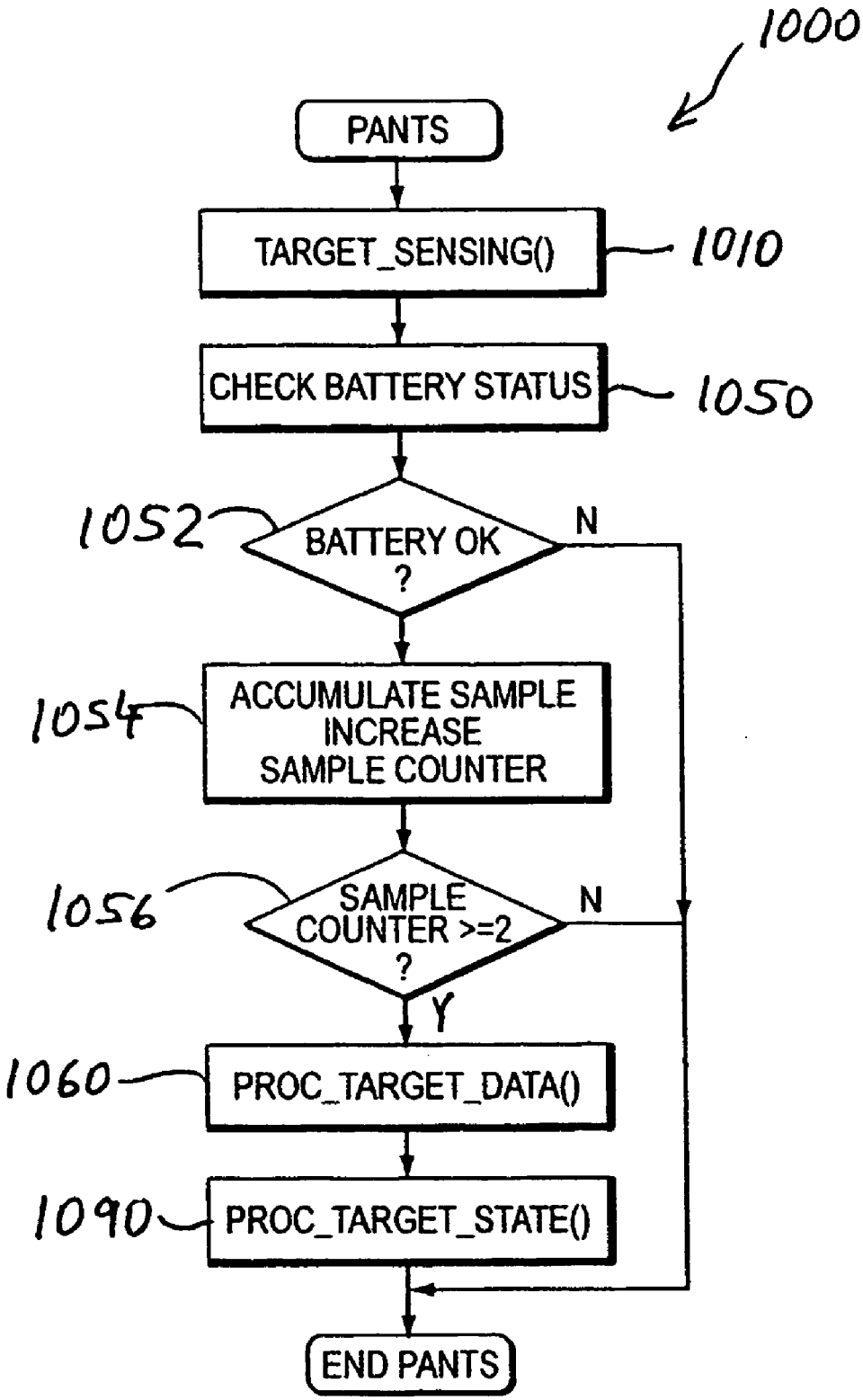
FIGS. 10, 10A, 10B and 10C illustrate an algorithm for use with the optical sensor shown in FIGS. 4, 4A and 5 designed to control the flushers shown in FIG. 1 and FIG. 1A.
Figure 10A:
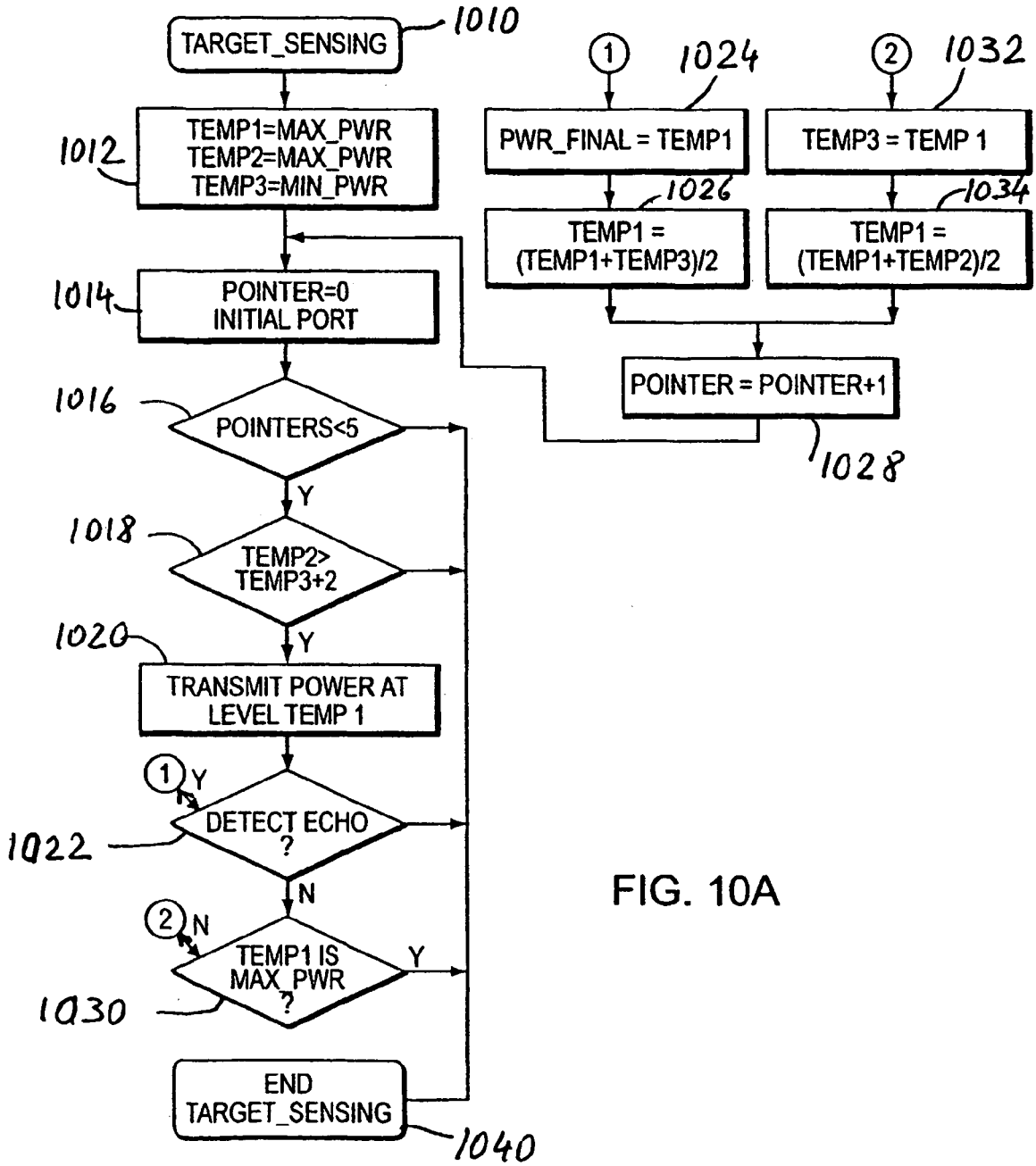
Figure 10B:
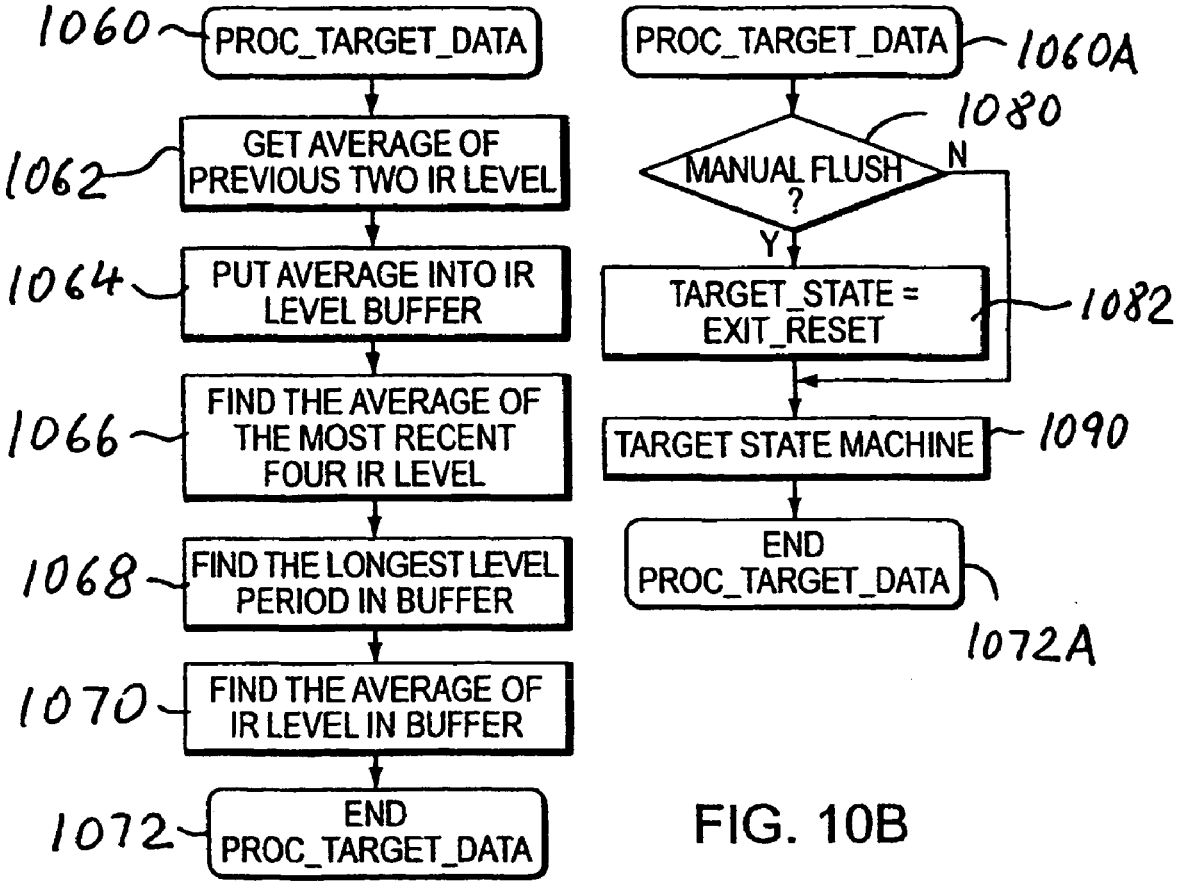
Figure 10C:
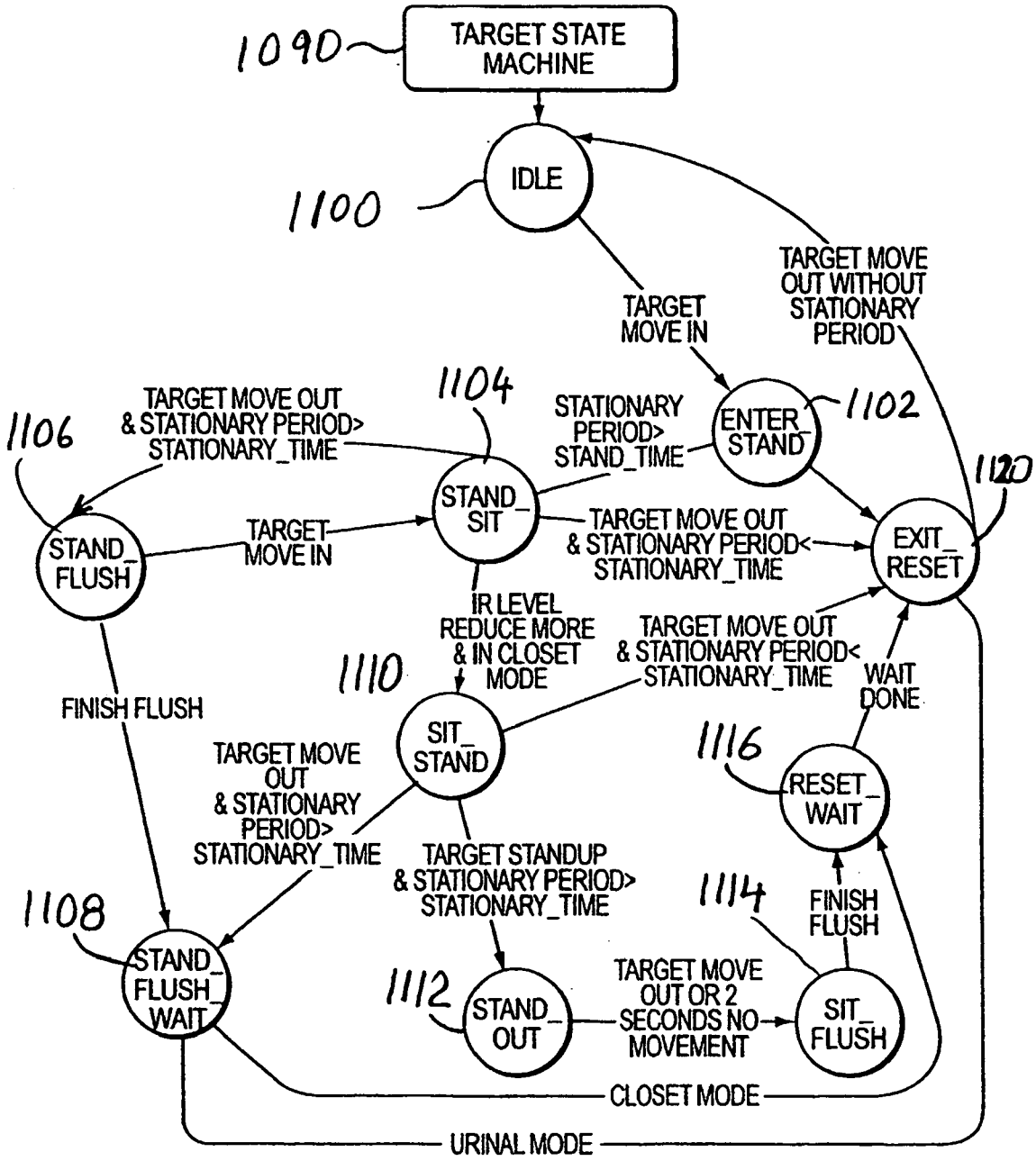

As shown in FIG. 10C, the control logic uses different target states as follows: IDLE 1100, ENTER_STAND 1102, STAND_SIT 1104, SIT_STAND 1110, STAND_FLUSH 1106 STAND_FLUSH_WAIT 1108, STAND_OUT 1112, SIT_FLUSH 1114, RESET_WAIT 1116, and EXIT_RESET 1120. All the states are based upon a target or user behavior in the IR sensing field. When a target or user enters the optical field, the state will be set to ENTER_STAND state. The state will be set into STAND_SIT state while a target stops moving after and ENTER_STAND state set, and so on. Following is a closet user handle cycle:

When a user moves toward the sensing field, the state will change from IDLE to ENTER_STAND. If a user spends enough time in front of toilet flusher, the state will be changed to STAND_SIT. If the target following action is sit down, the state will become SIT_STAND. The state will turn to STAND_OUT STATE, along with sitting time is long enough. Then the user stands up and moves out. In this time the control algorithm will go into SIT_FLUSH state to issue a flush command to solenoid to do flush water operation. The unit will turn back to idle state again.

Referring to FIG. 10, the detection algorithm 1000 uses a target sensing sub-routine 1010 that cycles through up to 20 different levels of light emission intensity emitted from light source 22 (FIG. 4). For each intensity, detector 24 detects the corresponding reflected signal. As shown in FIG. 10A, the maximum and minimum light source powers are selected and stored in temporary buffers (step 1012 through 1018). Light source 22 emits the corresponding optical signal at the power level stored in a temporary buffer 1, and light detector 24 detects the corresponding reflected signal. As shown in step 1022 if no echo is detected, the power level is cycled one step higher up to maximum power. The power increase is performed according to steps 1032 and 1034 and the entire process is repeated starting with step 1014. In step 1022, if the corresponding echo signal is detected, the current power level is assigned the final value (step 1024). The next power level is averaged as shown in block 1026, and the pointer numbering is increased (step 1028). Next, the entire cycle is repeated starting with step 1014. This way, the light source increases the power values up to a specific power value where the corresponding echo is detected.

Referring still to FIG. 10, in steps 1050 through and 1052, the processor checks the battery status and then proceeds to accumulating sample data as shown in step 1054. The accumulated optical data is processed using the algorithm shown in FIG. 10B. In steps 1062 through 1066, the processor finds the average of the most recent four IR detection levels. Next, the processors finds the longest level period in the buffer. Step 1068, (and finds the average of the IR level in the buffer (step 1070)). Before each data is processed, the processor checks if a manual flush was actuated by a user (step 1080). If a manual flush was actuated, the processor exits the present target state as shown in block 1082. Alternatively, if no manual flush was actuated, the processor continues determining the individual target states, as shown in FIG. 10C.

The system may determine whether the absolute value of the difference between the current gain and the gain listed in the top stack entry exceeds a threshold gain change. If it does not, the current call of this routine results in no new entry's being pushed onto the stack, but the contents of the existing top entry's timer field are incremented. The result is instead that the gain change's absolute value was indeed greater than the threshold, then the routine pushes a new entry on to the stack, placing the current gain in that entry's gain field and giving the timer field the value of zero. In short, a new entry is added whenever the target's distance changes by a predetermined step size, and it keeps track of how long the user has stayed in roughly the same place without making a movement as great as that step size.

The routine also gives the entry's in/out field an "out" value, indicating that the target is moving away from the flusher, if the current gain exceeds the previous entry's gain, and it gives that field an "in" value if the current gain is less than the previous entry's gain. In either case, the routine then performs the step of incrementing the timer (to a value of "1") and moves from the stack-maintenance part of the routine to the part in which the valve-opening criteria are actually applied.

Applying the first criterion, namely, whether the top entry's in/out field indicates that the target is moving away. If the target does not meet this criterion, the routine performs the step of setting the flush flag to the value that will cause subsequent routines not to open the flush valve, and the routine returns. If that criterion is met, on the other hand, the routine performs step of determining whether the top entry and any immediately preceding entries indicating that the target is moving away are preceded by a sequence of a predetermined minimum number of entries that indicated that the target was moving in. If they were not, then it is unlikely that a user had actually approached the facility, used it, and then moved away, so the routine again returns after resetting the flush flag. Note that the criterion that the block-318 step applies is independent of absolute reflection percentage; it is based only on reflection-percentage changes, requiring that the reflection percentage traverse a minimum range as it increases.

If the system determines that the requisite number of inward-indicating entries did precede the outward-indicating entries, then the routine imposes the criterion of determining whether the last inward-movement-indicating entry has a timer value representing; at least, say, 5 seconds. This criterion is imposed to prevent a flush from being triggered when the facility was not actually used. Again, the routine returns after resetting the flush flag if this criterion is not met.

If it is met, on the other hand, then the routine imposes the criteria of which are intended to determine whether a user has moved away adequately. If the target appears to have moved away by more then a threshold amount, or has moved away slightly less but has appeared to remain at that distance for greater then a predetermined duration, then, the routine sets the flush flag before returning. Otherwise, it resets the flush flag.

Referring again to FIG. 8A, control circuitry 801 is used for controlling the object sensor shown in FIGS. 2, 2A, 2C and 2D, which can be called a passive system since no light emission occurs. In this system, the circuitry and optical elements related to an IR emitter are eliminated.

The light receiver may be a photo diode, a photo resistor or some other optical intensity element having proportional electrical output converter/sensor whereby the sensory element will have the desired optical sensitivity ranging from 400–500 nano meters up to 950–1000 nano meters. The system with a photo diode includes an amplification circuitry. This circuitry has during power-up phase a RC value proportional to a particular light intensity when there are no objects within the field of view and the ambient light is set to a predetermined level. Upon introduction of an object into the field of view, the RC value of the system is altered such that its time constant shifts. Furthermore, the constant shifts in the time domain as the target moves toward the detector or away from the detector; this is an important novel design.

Since the constant shifts in the time domain as the target moves toward the detector or away from the detector, the microcontroller can determine whether an object is present, and whether it is moving toward or away from the optical sensor. When employing this phenomenon onto a flusher (or onto a faucet) the ability to achieve a more accurate assessment as to whether water flow should commence is significantly enhanced when employing a photo resistor to the amplification circuitry. Circuitry is altered such that the RC constant shifts due to the changing resistant value proportional to the light intensity as compared to the diode arrangement, whereby the voltage change effects the change of time constant of the integrated signal. This use of a fully passive system further reduces the overall energy consumption.

By virtue of the elimination of the need to employ an energy consuming IR light source, the system can be configured so as to achieve a more accurate means of determining whether water flow should be initiated or terminated to the ability to discern presence, motion and direction of motion. Furthermore, the system can be used in order to determine light or dark in a facility and in turn alter the sensing frequency. That is, in a dark facility the sensing rate is reduced under the presumption that in such a modality the water dispensing device (i.e., a WC, a urinal or a faucet will not be used) whereby said reduction of sensing frequency is a further means of reducing the overall energy use, and thus extending battery life.

The preferred embodiment as it relates to which type of optical sensing element is to be used is dependent upon the following factors: The response time of a photo-resistor is on the order or 20–50 milliseconds, whereby a photo-diode is on the order of several microseconds, therefore the use of a photo-resistor will require a significantly longer time form which impacts overall energy use. However, the use of a photo-diode requires a little more elaborate amplification circuit, which may require more energy per unit time. The cost of the sensing element coupled to the support electronics of the photo resistor approach is likely lower than that of the photodiode.

Having described various embodiments and implementations of the present invention, it should be apparent to those skilled in the relevant art that the foregoing is illustrative only and not limiting, having been presented by way of example only. There are other embodiments or elements suitable for the above-described embodiments, described in the above-listed publications, all of which are incorporated by reference as if fully reproduced herein. The functions of any one element may be carried out in various ways in alternative embodiments. Also, the functions of several elements may, in alternative embodiments, be carried out by fewer, or a single, element.

The invention claimed is:

1. An electrically operated valve comprising:

a valve body coupled to and stationary with respect to a valve inlet and a valve outlet;

a valve closure element for moving between an open state enabling flow from said inlet to said outlet and a closed state preventing said flow from said inlet to said outlet; and an electromagnetic actuator including a solenoid coil and an armature linearly displaceable by application of a drive signal to said solenoid coil, said actuator being attached to move together with said valve closure element with respect to said valve body, while said valve closure element is operating between said open state and said closed state, said actuator controlling operation of said valve.

2. An electrically operated valve, comprising:

a valve body having a water inlet and a water outlet, a valve closure element located within said valve body and constructed to move between an open state enabling water flow from said inlet to said outlet and a closed state preventing said water flow from said inlet to said outlet;

an electromagnetic actuator attached to move with said valve closure element, with respect to said valve body, said actuator being constructed to displace a sealing member; and a pilot mechanism constructed to control said movement of said valve closure element between said open state and said closed state based on a position of said sealing member.

3. The electrically operated valve of claim 1 wherein said valve closure element is a valve diaphragm.

4. The electrically operated valve of claim 2 wherein said valve closure element includes a valve diaphragm and wherein said pilot mechanism and said actuator are attached to said diaphragm and arranged to move with said diaphragm between said open and said closed state.

5. The electrically operated valve of claim 4 wherein said pilot mechanism includes a pilot diaphragm controlled by said actuator.

6. The electrically operated valve of claim 5 wherein said valve diaphragm and said pilot mechanism, including said pilot diaphragm, are arranged to form a hydraulic amplifier having two fluid stages.

7. The electrically operated valve of claim 1 wherein said valve element is a valve piston.

8. The electrically operated valve of claim 2 wherein said valve element includes a valve piston and wherein said pilot mechanism and said actuator are attached to said valve piston and arranged to move with said diaphragm between said open and said closed state.

9. The electrically operated valve of claim 8 wherein said pilot mechanism includes a pilot piston controlled by said actuator.

10. The electrically operated valve of claim 9 wherein said valve piston and said pilot mechanism, including said pilot piston, are arranged to form a hydraulic amplifier having two fluid stages.

11. The electrically operated valve of claim 8 wherein said pilot mechanism includes a pilot diaphragm controlled by said actuator.

12. The electrically operated valve of claim 2 further including a filter for filtering particles located in water flowing between said water inlet and said water outlet.

13. The electrically operated valve of claim 1 used to control water flow in a bathroom flusher.

14. The electrically operated valve of claim 2 wherein operation of said actuator is triggered by control circuitry connected to receive signals from an optical sensor.

15. The electrically operated valve of claim 2 wherein said actuator is a solenoid.

16. The electrically operated valve of claim 2 wherein said actuator is a solenoid and said sealing member is a plunger.

17. The electrically operated valve of claim 2 used to control water flow in a bathroom flusher.

18. The electrically operated valve of claim 2 further including a control circuitry, including a microcontroller, constructed to provide signals to said actuator.

19. The electrically operated valve of claim 2 further including a control circuitry, including a microcontroller, constructed to control signals to said actuator said microcontroller being constructed to calculate water pressure in said water inlet and thus control amount or water delivered by the bathroom flusher.

20. The electrically operated valve of claim 2 wherein operation of said actuator is triggered by control circuitry connected to a capacitive sensor.

21. The electrically operated valve of claim 2 wherein operation of said actuator is triggered by a control circuitry connected to an ultrasonic sensor.

22. The electrically operated valve of claim 15 wherein said solenoid includes a solenoid coil and an armature linearly displaceable by application of a drive signal to said solenoid coil to displace said sealing member.

23. The electrically operated valve of claim 1 wherein said application of the coil drive is triggered by a control circuitry connected to receive signals from an optical sensor.

24. The electrically operated valve of claim 1 wherein said application of the coil drive is triggered by a control circuitry connected to a capacitive sensor.

25. The electrically operated valve of claim 1 wherein said application of the coil drive is triggered by a control circuitry connected to an ultrasonic sensor.

26. The electrically operated valve of claim 1 adapted to control water flow in a bathroom flusher including a control circuitry comprising a microcontroller constructed to initiate signals to said actuator.

27. The electrically operated valve of claim 26 wherein said microcontroller is constructed to calculate water pressure at said valve inlet and thus control amount of water delivered by the bathroom flusher.

* * * * *